US010066183B2

(12) United States Patent
Aswath et al.

(10) Patent No.: US 10,066,183 B2
(45) Date of Patent: Sep. 4, 2018

(54) LUBRICANT COMPOSITIONS

(71) Applicant: BOARD OF REGENTS, THE UNIVERSITY OF TEXAS SYSTEM, Austin, TX (US)

(72) Inventors: Pranesh B. Aswath, Grapevine, TX (US); Sujay Bagi, Burlington, WA (US); Ami Shah, Arlington, TX (US); Kush Shah, Arlington, TX (US); Kane Mordaunt, Bellevue, WA (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 15/259,608

(22) Filed: Sep. 8, 2016

(65) Prior Publication Data

US 2017/0066990 A1 Mar. 9, 2017

Related U.S. Application Data

(60) Provisional application No. 62/215,990, filed on Sep. 9, 2015.

(51) Int. Cl.

| | |
|---|---|
| ***C10M 139/00*** | (2006.01) |
| ***C10M 125/22*** | (2006.01) |
| ***C10M 147/02*** | (2006.01) |
| ***C10M 139/06*** | (2006.01) |

(52) U.S. Cl.

CPC ..... *C10M 125/22* (2013.01); *C10M 139/06* (2013.01); *C10M 147/02* (2013.01); *C10M 2201/065* (2013.01); *C10M 2201/066* (2013.01); *C10M 2213/062* (2013.01); *C10M 2219/068* (2013.01); *C10M 2223/045* (2013.01); *C10N 2220/082* (2013.01); *C10N 2250/10* (2013.01)

(58) Field of Classification Search

CPC .... C10M 2207/1206; C10M 2201/065; C10M 2201/066

USPC ..... 508/197

See application file for complete search history.

(56) References Cited

U.S. PATENT DOCUMENTS 5,013,466 A * 5/1991 Obara ..... C10M 169/00 508/141
7,754,662 B2 7/2010 Aswath et al.
7,879,776 B2 2/2011 Patel et al.
(Continued)

FOREIGN PATENT DOCUMENTS

CN 102344588 B 7/2012

OTHER PUBLICATIONS

Kopeliovich, Dr. Dmitri. "Additives in lubricating oils." http://www.substech.com/dokuwiki/doku.
php?id=additives_in_lubricating_oils. Retrieved: Dec. 1, 2016. English Language. 4 pages.

*Primary Examiner* — Vishal Vasisth
(74) *Attorney, Agent, or Firm* — John P. Zimmer; Nexsen Pruet, PLLC

(57) ABSTRACT

In one aspect, lubricant compositions are described herein. In some embodiments, a lubricant composition described herein comprises a grease and milled metal sulfide particles dispersed in the grease. In other cases, a lubricant composition described herein comprises a grease, polytetrafluroethylene particles, zinc dithiophosphate, and molybdenum dialkyldithiocarbamate, wherein the polytetrafluroethylene particles, zinc dithiophosphate, and molybdenum dialkyldithiocarbamate are dispersed in the grease.

19 Claims, 50 Drawing Sheets

(56) References Cited

U.S. PATENT DOCUMENTS

| | | | | |
|---|---|---|---|---|
| 2008/0312111 | A1* | 12/2008 | Malshe | C10M 171/06 508/155 |
| 2014/0212587 | A1* | 7/2014 | Malshe | C10M 171/06 427/331 |
| 2014/0231145 | A1* | 8/2014 | Kverel | C09K 8/032 175/65 |

* cited by examiner

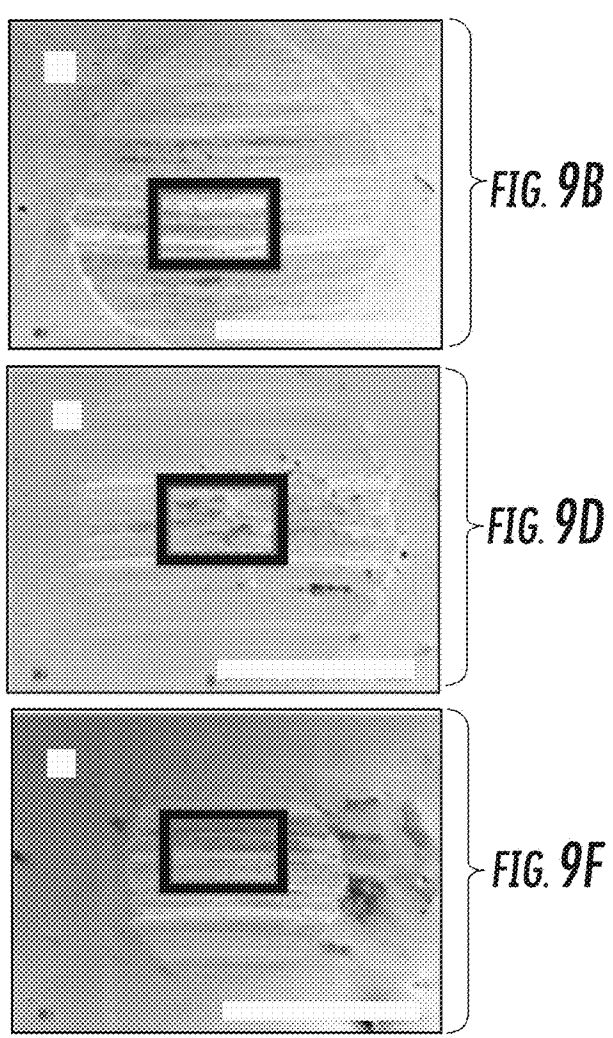
FIG. 9B
FIG. 9D
FIG. 9F
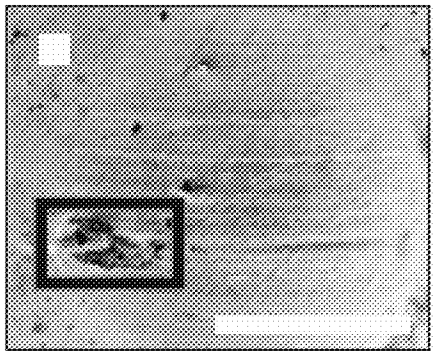
FIG. 9A
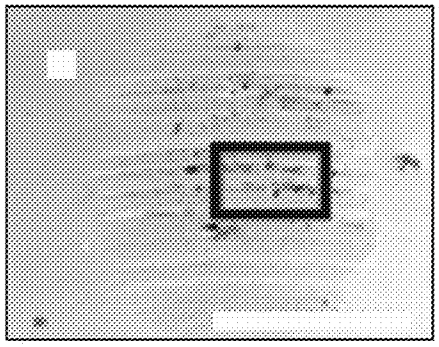
FIG. 9C
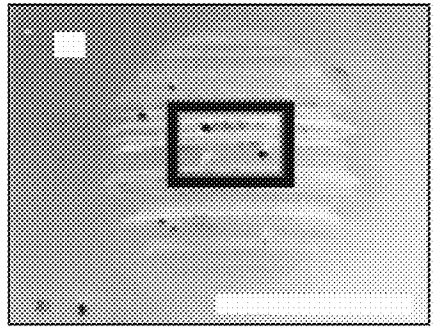
FIG. 9E

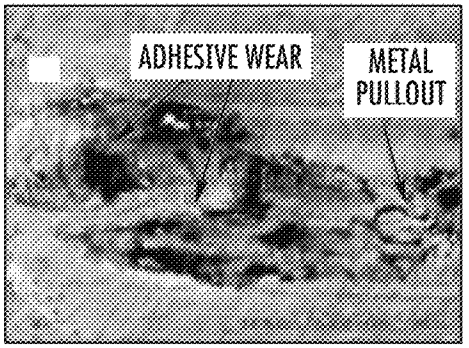
FIG. 10A
FIG. 10B
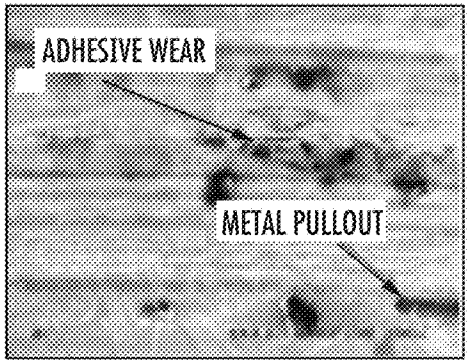
FIG. 10C
FIG. 10D
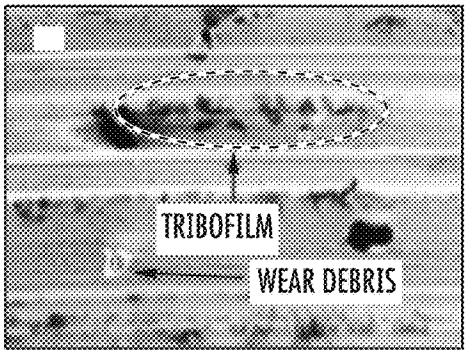
FIG. 10E
FIG. 10F WEAR SURFACE EXHIBITS SIGNS OF:
1. ABRASIVE WEAR
2. METAL PULL-OUT
3. DEEP SCRATCH MARKS
4. TRIBOFILM FORMATIONS
5. POLISHING WEAR WEAR SURFACE EXHIBITS SIGNS OF:
1. ABRASIVE WEAR
2. TRIBOFILM FORMATIONS
3. POLISHING WEAR

LUBRICANT COMPOSITIONS

CROSS REFERENCE TO RELATED APPLICATIONS

This application claims priority pursuant to 35 U.S.C. § 119(e) to U.S. Provisional Patent Application Ser. No. 62/215,990, filed on Sep. 9, 2015, which is hereby incorporated by reference in its entirety.

FIELD

This invention relates to lubricant compositions and, in particular, to lubricant compositions that may be used under a wide variety of lubrication conditions, such as a wide variety of loads.

BACKGROUND

Grease-based lubricants are among the oldest and most common lubricants known. Further, such lubricants can be used in a variety of applications. However, many if not all previous grease-based lubricants fail to provide adequate performance over a wide range of lubrication conditions. For example, many previous grease-based lubricants fail to provide adequate performance across a wide spectrum of loads, from low loads to extreme loads. Therefore, there exists a need for improved lubricant compositions and improved methods of making lubricant compositions for a wide range of lubrication conditions.

SUMMARY

In one aspect, lubricant compositions are described herein which, in some cases, can provide one or more advantages compared to other lubricant compositions. For example, in some embodiments, a lubricant composition described herein can provide high performance across a wide spectrum of load conditions. Additionally, in some cases, a lubricant composition described herein can provide reduced wear and/or a reduced average coefficient of friction for lubricated metal parts. Moreover, a lubricant composition described herein, in some instances, can exhibit properties under a variety of lubrication conditions that permit the lubricant composition to be useful as a "universal" grease or lubricant, including for aerospace applications.

In some embodiments, a lubricant composition described herein comprises, consists, or consists essentially of a grease and milled metal sulfide particles dispersed in the grease. In some cases, the grease is a lithium grease. Moreover, in some instances, the milled metal sulfide particles are formed from molybdenum disulfide ($MoS_2$) or tungsten disulfide ($WS_2$). Alternatively, in other embodiments, a lubricant composition described herein may be a "dry" or powder-based lubricant composition consisting essentially of milled metal sulfide particles, including milled metal sulfide particles having rounded edges.

In still other embodiments, a lubricant composition described herein may not comprise milled metal sulfide particles or unmilled metal sulfide particles. For instance, in some embodiments described herein, a lubricant composition comprises, consists, or consists essentially of a grease, polytetrafluroethylene (PTFE) particles, zinc dithiophosphate (ZDDP), and molybdenum dialkyldithiocarbamate (MoDTC), wherein the PTFE particles, ZDDP, and MoDTC are dispersed in the grease. Moreover, in some such cases, each of the PTFE particles, ZDDP, and MoDTC are present in the grease in an amount of 0.5 to 5 weight percent, based on the total weight of the lubricant composition.

In another aspect, methods of making a lubricant composition are described herein. In some embodiments, a method of making a lubricant composition described herein comprises dispersing one or more additives in a grease. For example, in some cases, a method of making a lubricant composition described herein comprises milling metal sulfide particles and dispersing the milled metal sulfide particles in a grease. Further, in some cases, milling is carried out by mixing metal sulfide particles and a liquid to form a mixture and milling the mixture. As described further hereinbelow, milling metal sulfide particles in a manner described herein can round the edges or reduce agglomeration of the metal sulfide particles, resulting in improved lubrication properties. In other instances, a method of making a lubricant composition described herein comprises dispersing PTFE particles, ZDDP, and MoDTC in a grease, wherein each of the PTFE particles, ZDDP, and MoDTC are dispersed in the grease in an amount of 0.5 to 5 weight percent, based on the total weight of the lubricant composition.

In yet another aspect, methods of lubricating a metal part are described herein. In some embodiments, a method of lubricating a metal part comprises applying a lubricant composition described hereinabove to a metal part. Moreover, in some instances, a method of lubricating a metal part described herein comprises placing the metal part under a load and forming molybdenum disulfide particles and/or a molybdenum film in situ at one or more contacting surfaces of the metal part.

These and other embodiments are described in greater detail in the detailed description which follows.

BRIEF DESCRIPTION OF THE FIGURES

FIGS. 9A-F illustrates SEM images of wear scars on metal parts lubricated with a lubricant composition according to some embodiments described herein.

FIGS. 10A-F illustrate SEM images of types of wear on lubricated metal parts.

DETAILED DESCRIPTION

Figure 1A:
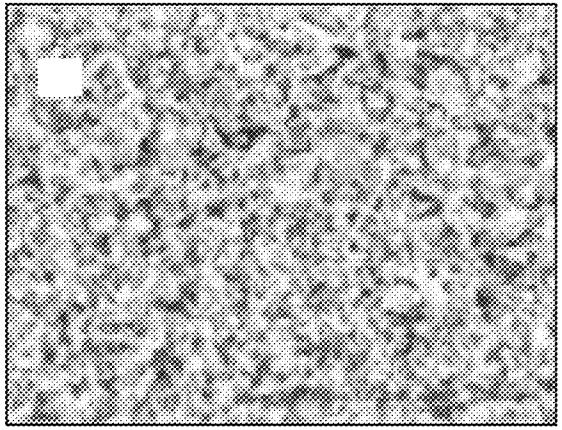
FIGS. 1A-D illustrate scanning electron microscopy (SEM) images of milled and unmilled metal sulfide particles.

Embodiments described herein can be understood more readily by reference to the following detailed description, examples, and figures. Elements, apparatus, and methods described herein, however, are not limited to the specific embodiments presented in the detailed description, examples, and figures. It should be recognized that these embodiments are merely illustrative of the principles of the present invention. Numerous modifications and adaptations will be readily apparent to those of skill in the art without departing from the spirit and scope of the invention.

In addition, all ranges disclosed herein are to be understood to encompass any and all subranges subsumed therein. For example, a stated range of "1.0 to 10.0" should be considered to include any and all subranges beginning with a minimum value of 1.0 or more and ending with a maximum value of 10.0 or less, e.g., 1.0 to 5.3, or 4.7 to 10.0, or 3.6 to 7.9.

All ranges disclosed herein are also to be considered to include the end points of the range, unless expressly stated otherwise. For example, a range of "between 5 and 10" should generally be considered to include the end points 5 and 10.

Further, when the phrase "up to" is used in connection with an amount or quantity; it is to be understood that the amount is at least a detectable amount or quantity. For example, a material present in an amount "up to" a specified amount can be present from a detectable amount and up to and including the specified amount.

I. Lubricant Compositions Comprising Milled Metal Sulfide Particles

In one aspect, a lubricant composition described herein comprises, consists, or consists essentially of milled metal sulfide particles. As described further hereinbelow, such milled metal sulfide particles can have rounded edges and/or reduced surface energy compared to non-milled particles. The milled metal sulfide particles may also be surface-functionalized with an additional chemical moiety, such as a polythiol. Additionally, in some cases, the milled metal sulfide particles of a lubricant composition described herein are dispersed in a grease. Moreover, in some embodiments, a lubricant composition further comprises a dispersant for the milled metal sulfide particles.

Turning now to specific components of lubricant compositions, in some cases, a lubricant composition described herein comprises a grease. Any grease not inconsistent with the objectives of the present invention may be used. In some embodiments, for example, the grease comprises or is formed of a base oil and a thickener. In such instances, the base oil typically is present in an amount of about 60 to 98 weight percent, based on the total weight of the grease, but other amounts may also be used. Non-limiting examples of base oils suitable for use in a grease described herein include mineral oil, polyalphaolefin, ester oil, polyglycol, silicone oil, and perfluoroalkyl ethers. Other base oils may also be used. When used, the thickener of a grease may typically be present in an amount of about 2 to 30 weight percent, based on the total weight of the grease, but other amounts may also be used. Non-limiting examples of thickeners suitable for use in a grease described herein include metal salts of soaps, polyureas, gels, bentonite, and PTFE. In some embodiments, the thickener comprises a lithium salt of a fatty acid. In such instances or other cases where a lithium-based thickener is used, the resulting grease may be referred to as a lithium grease. For example, in one exemplary embodiment, a lithium grease of a lubricant composition described herein can be a NLGI grade 2 having a dropping point of 188° C., having a lithium 12-hydroxystearate thickener, and having a base oil having a kinematic viscosity of 220 centistokes (cSt) at 40° C. The grease of a lubricant composition described herein, in some instances, may also contain one or more performance additives, such as one or more anti-aging additives, anti-corrosion additives, extreme pressure additives, and viscosity-modifying additives.

The grease of a lubricant composition described herein can be present in the lubricant composition in any amount not inconsistent with the objectives of the present invention. In some embodiments, for example, the grease is present in the lubricant composition in an amount of at least about 50, at least about 60, at least about 70, at least about 80, at least about 90, or at least about 95 weight percent, based on the total weight of the lubricant composition. In some cases, the grease is present in an amount of about 50 to 99 weight percent, about 60 to 99 weight percent, about 70 to 99 weight percent, about 80 to 99 weight percent, about 80 to 95 weight percent, about 80 to 90 weight percent, about 90 to 99 weight percent, or about 90 to 95 weight percent, based on the total weight of the lubricant composition.

Moreover, as described above, in some embodiments, a lubricant composition described herein does not contain a grease, or is substantially grease-free. A substantially grease-free lubricant composition, in some cases, comprises less than about 5 weight percent, less than about 3 weight percent, or less than about 1 weight percent grease, based on the total weight of the lubricant composition. In some instances, a grease-free or substantially grease-free lubricant composition described herein is a powder lubricant composition consisting or consisting essentially of milled metal sulfide particles, such as milled metal sulfide particles described hereinbelow.

The milled metal sulfide particles of a lubricant composition described herein can comprise any metal sulfide not inconsistent with the objectives of the present invention. In some embodiments, for example, metal sulfide particles have the general chemical formula XS or $XS_2$, where X is a metal such as a transition metal. In some cases, the milled metal sulfide particles are formed from molybdenum disulfide ($MoS_2$) or tungsten disulfide ($WS_2$).

Additionally, the milled metal sulfide particles of a lubricant composition described herein can have any size or shape not inconsistent with the objectives of the present disclosure. In some cases, for instance, the milled metal sulfide particles can have an average diameter or length in one dimension of about 1-50 μm, 1-30 μm, 1-20 μm, 3-30 μm, 5-20 μm, 10-50 μm, 10-20 μm, or 30-50 μm. Milled metal sulfide particles may also have an average diameter or length in one dimension of less than 500 nm or less than 100 nm. In some instances, the milled metal sulfide particles of a lubricant composition described herein have an average diameter or length in one dimension of 1-500 nm, 1-100 nm, 1-50 nm, 10-500 nm, 10-100 nm, 50-500 nm, or 50-100 nm. Further, in some embodiments, the milled metal sulfide particles can have a flat, plate, flake, or disc-like shape, and the average length or width of the faces of the particles (as opposed to the average thickness of the particles) can have a value described hereinabove. Moreover, it is to be understood that the milled metal sulfide particles of a lubricant composition described herein may comprise a mixture of particle shapes. In such instances, the average diameter or length in one dimension of the milled metal sulfide particles can be the average for all of the milled metal sulfide particles, regardless of shape. In other instances, the average diameters or lengths described hereinabove may refer to a specific shape of particle in a mixture of differently shaped particles. Additionally, in some instances, milled metal sulfide particles described herein have an average length describe hereinabove in more than one dimension, such as two dimensions or three dimensions. Further, in some cases, an average length or diameter of a population of milled metal sulfide particles is the mass-median-diameter ($D_{50}$) value of the population.

Figure 1B:
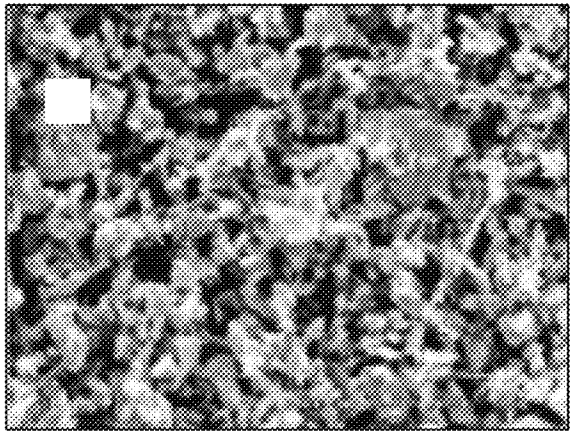
Figure 1C:
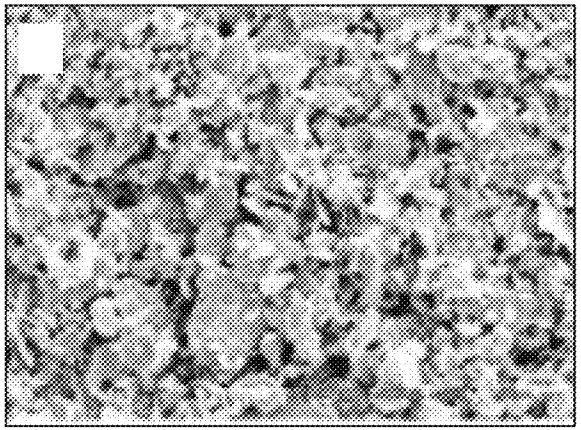
Figure 1D:
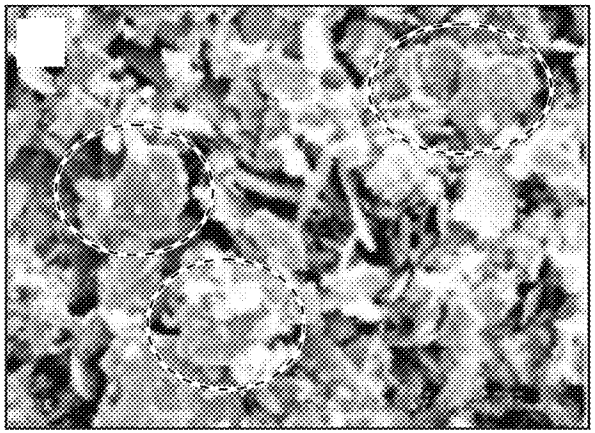

In lubricant compositions described herein, the metal sulfide particles have been subjected to milling. Such milling can include any milling, grinding, or other treatment of the metal sulfide particles to remove material from the particles and/or to reduce asperities of the particle edges. For instance, in some cases, ball milling or attrition milling may be used. In some embodiments, rod milling, semi-autogenous grinding (SAG), buhrstone milling, vertical shaft impactor (VSI) milling, tower milling, or high pressure rolling may be used. Further, in some instances, the metal sulfide particles have been subjected to milling for a time period sufficient to round or dull or soften or reduce the asperities of the edges of the particles. Thus, in some embodiments, the milled metal sulfide particles may have rounded or dulled or softened edges compared to metal sulfide particles that are otherwise substantially similar but have not been milled in this manner. The milled metal sulfide particles may also have a decreased degree of agglomeration, including within a grease, compared to metal sulfide particles that are otherwise substantially similar but that have not been milled. Moreover, in some cases, the milled metal sulfide particles may have reduced surface energy and/or reduced asperities compared to metal sulfide particles that are otherwise substantially similar. It is further to be understood that the milled metal sulfide particles do not necessarily have a spherical shape during or after milling. In some embodiments, the milled metal sulfide particles may remain substantially flat or plate like during or following milling but may have edges that have be rounded, dulled, or softened in a manner described hereinabove. The effect of milling metal sulfide particles according to one embodiment described herein is illustrated in FIG. 1. FIG. 1A illustrates an SEM image of unmilled $MoS_2$ particles (500× magnification); FIG. 1B illustrates an SEM image of unmilled $MoS_2$ particles (1000× magnification); FIG. 1C illustrates an SEM image of milled $MoS_2$ particles (at 500× magnification); and FIG. 1D illustrates an SEM image of milled $MoS_2$ particles (at 1000× magnification). As described further herein, the use of milled metal sulfide particles in a lubricant composition described herein can provide a reduced average wear scar diameter or a reduced average coefficient of friction compared to a lubricant composition comprising non-milled metal sulfide particles.

Milled metal sulfide particles can be present in a lubricant composition described herein in any amount not inconsistent with the objectives of the present invention. In some cases, the milled metal sulfide particles are present in the lubricant composition in an amount no greater than about 10 weight percent, no greater than about 5 weight percent, or no greater than about 4 weight percent, based on the total weight of the lubricant composition. In some cases, the milled metal sulfide particles are present in the lubricant composition in an amount of about 0.5-50, 0.5-40, 0.5-30, 0.5-20, 0.5-15, 0.5-10, 0.5-4, 1-10, 1-5, 1-4, 2-10, 2-5, or 2-4 weight percent, based on the total weight of the lubricant composition. Moreover, in some instances, the milled metal sulfide particles form a percolation network within the grease. Further, the milled metal sulfide particles may form a percolation network within the grease at a lower loading of metal sulfide particles, as compared to a grease including non-milled metal sulfide particles that are otherwise similar to the milled metal sulfide particles.

In addition, in some embodiments, a lubricant composition described herein further comprises one or more additives, such as one or more dispersants, polythiols, extreme pressure additives, anti-aging additives, anti-corrosion additives, or viscosity-modifying additives. In some cases, one or more such additives are present during the milling of the metal sulfide particles. In other cases, one or more additives may be combined with previously milled metal sulfide particles to provide a lubricant composition described herein. Any additives not inconsistent with the objectives of the present invention may be used. In some cases, for instance, a dispersant comprises a chemical species having at least one polar moiety and at least one non-polar moiety, such as a non-ionic surfactant, an anionic surfactant, and/or a zwitterionic surfactant. In some instances, the polar moiety of a dispersant described herein is selected from succinimides, succinates, alkylphenolamines, polyamines, polyethers, sulfonates, phenates, carboxylic acids, carboxylic acid salts, esters, quaternary ammonium salts, sugars, polar oligomers, polar polymers. Other polar moieties may also be used. The non-polar moiety of a dispersant described herein may be selected from polyisobutylene, any straight-chain or branched-chain alkane, non-polar oligomers, or non-polar polymers. Other non-polar moieties may also be used. In some cases, a dispersant comprises a sorbitan ester (such as a Span® sorbitan esters) or an ethoxylated sorbitan ester. Further, the sorbitan unit may be mono-, di-, or poly-functionalized. For instance, sorbitan laurate, sorbitan palmitate, sorbitan stearate, and/or sorbitan oleate may be used in a lubricant composition described herein. In some cases, the dispersant comprises sorbitan monooleate (sold under the trade name Span® 80). In other embodiments, the dispersant comprises a succinic anhydride wherein the non-polar moiety is a polyisobutylene. In some embodiments, for instance, the dispersant comprises polyisobutylene succinic anhydride (PIBSA).

A dispersant can be present in a lubricant composition described herein in any amount not inconsistent with the objectives of the present invention. In some cases, the dispersant is present in the lubricant composition in an amount up to about 5 weight percent, up to about 3 weight percent, up to about 2 weight percent, or up to about 1 weight percent, based on the total weight of the lubricant composition. In some instances, the dispersant is present in the lubricant composition in an amount of about 1-5, 1-3, or 3-5 weight percent, based on the total weight of the lubricant composition.

A lubricant composition described herein, in some cases, further comprises one or more sulfurized additives such as one or more polythiols. Moreover, in some embodiments, the milled metal sulfide particles are surface-functionalized with a sulfurized additive such as a polythiol. It is to be understood that a "polythiol," as used herein, is a chemical species which contains two or more mercapto moieties (—S—H) and/or organic disulfide moieties (—S—S—). The polythiol may also comprise hydrocarbon moeities which may be branched or unbranched, and which may be saturated or unsaturated. The polythiol may also contain ester moieties, ether moieties, or any other additional moiety not inconsistent with the objectives of the present invention. In some instances, the polythiol is ditertiarybutyl polysulfide (available under the trade name TPS® 44).

A polythiol can be present in a lubricant composition in any amount not inconsistent with the objectives of the present disclosure. In some cases, the polythiol is present in the lubricant composition in an amount up to about 5 weight percent, up to about 3 weight percent, up to about 2 weight percent, or up to about 1 weight percent, based on the total weight of the lubricant composition. In some instances, the polythiol is present in the lubricant composition in an amount of about 1-5, 1-3, or 3-5 weight percent, based on the total weight of the lubricant composition.

Lubricant compositions described herein can exhibit a variety of desirable properties and/or provide improved lubrication performance, including for the lubrication of metals or metal parts. For example, in some embodiments, a lubricant composition described herein can reduce the occurrence of abrasive wear, adhesive wear, corrosive wear, and/or fatigue on lubricated metals or metal parts. Further, in some embodiments, a lubricant composition described herein can reduce wear on lubricated metal parts subjected to spectrum loading conditions. In some cases, wear of lubricated metal parts may be reduced by 5% or more, 10% or more, or 15% or more, compared to metal parts lubricated with otherwise similar or identical compositions containing non-milled metal sulfide particles. In some instances, wear of lubricated metal parts may be reduced by 5-30%, 10-30%, 10-25%, 15-30%, or 15-25%. Additionally, in some cases, a lubricant composition described herein can reduce the torque and/or coefficient of friction (COF) exhibited by metal parts lubricated by the composition. For example, in some cases, the COF may be reduced by 15% or more, 20% or more, 25% or more, or 30% or more, compared to metal parts lubricated with a lubricant composition containing non-milled metal sulfide particles but otherwise similar or identical to a lubricant composition described herein. In some instances, the COF is reduced by 5-35%, 5-30%, 10-30%, 10-25%, 10-20%, 15-35%, 15-30%, or 15-25%. Moreover, a lubricant composition described herein may provide improved lubrication performance in hydrodynamic, elastohydrodynamic, mixed, and/or boundary lubrication regimes.

Lubricant compositions described herein can be produced in any manner not inconsistent with the objectives of the present invention. In some embodiments, for instance, a method of making lubricant compositions described herein comprises first milling metal sulfide particles and then dispersing the milled metal sulfide particles in a grease. The metal sulfide particles can be any metal sulfide particles described hereinabove, such as $MoS_2$ particles. Similarly, the grease can be any grease described hereinabove, such as a lithium grease. In addition, the milled metal sulfide particles can be dispersed in the grease in any amount not inconsistent with the objectives of the present invention, including an amount described hereinabove. For example, in some instances, the milled metal sulfide particles are dispersed in the grease in an amount of about 1-5 weight percent, based on the total weight of the lubricant composition. Further, the metal sulfide particles can be dispersed in the grease in any manner not inconsistent with the objectives of the present invention. For example, in some embodiments, dispersing the milled metal sulfide particles is carried out using a mixer or blender that mixes or blends the metal sulfide particles and the grease until a homogeneous mixture is obtained.

Similarly, milling may also be carried out in any manner not inconsistent with the objectives of the present invention, including in a manner previously described herein. For example, in some cases, the metal sulfide particles are milled in the presence of one or more additives described herein, such as one or more dispersants and/or polythiols described herein. Moreover, in some instances, milling is carried out by mixing metal sulfide particles and a liquid to form a mixture and then milling the mixture. Any liquid not inconsistent with the objectives of the present invention may be used. For example, in some cases, the liquid is an organic solvent. Additionally, in some such embodiments, the liquid from the mixture may be evaporated prior to dispersing the milled metal sulfide particles in the grease.

Further, in some instances, milling is carried out using a ball mill, a rod mill, a semi-autogenous grinding mill, a buhrstone mill, a vertical shaft impactor (VSI) mill, or a tower mill. High pressure grinding rolls may also be used to carry out a milling step described herein. In addition, in some embodiments wherein balls are used to mill or grind metal sulfide particles, the balls comprise zirconia balls. Other balls may also be used.

Moreover, milling may be carried out for any period of time not inconsistent with the objectives of the present invention. In general, the time period used for milling can be selected based on the type of milling used and/or the degree of rounding, smoothing, or reducing in size or agglomeration desired for the milled metal sulfide particles. For example, in some cases, milling is carried out for a time period sufficient to round or dull or soften the metal sulfide particle edges or to reduce the surface energy or asperities of the metal sulfide particles by an amount or percentage described herein. In some embodiments, milling is carried out for at least 12 hours, at least 18 hours, at least 24 hours, at least 30 hours, or at least 48 hours. In some instances, milling is carried out for 12-48 hours, 12-24 hours, or 18-30 hours. In some cases, milling is carried out for less than 12 hours or more than 48 hours.

II. Lubricant Compositions Comprising PTFE Particles, ZDDP, and MoDTC

In another aspect, a lubricant composition described herein comprises, consists, or consists essentially of a grease, polytetrafluroethylene (PTFE) particles, zinc dithiophosphate (ZDDP), and molybdenum dialkyldithiocarbamate (MoDTC), wherein the PTFE particles, ZDDP, and MoDTC are dispersed in the grease. In some cases, the grease is a lithium grease. Additionally, in some instances, each of the PTFE particles, ZDDP, and MoDTC are present in the grease in an amount of up to about 7 weight percent, up to about 5 weight percent, up to about 4 weight percent, or up to about 3 weight percent, based on the total weight of the lubricant composition. In some embodiments, each of the PTFE particles, ZDDP, and MoDTC are present in the grease in an amount of 0.5 to 6 weight percent, about 1 to 5 weight percent, or about 2 to 4 weight percent, based on the total weight of the lubricant composition. It has surprisingly been found that a lubricant composition including such a combination of components can provide improved performance for the lubrication of parts such as metal parts, as described further hereinbelow. Moreover, in some cases, a lubricant composition described herein further comprises one or more additives (such as one or more dispersants, polythiols, extreme pressure additives, anti-aging additives, anti-corrosion additives, or viscosity modifying additives) in addition to the PTFE particles, ZDDP, and MoDTC.

Turning now to specific components of such lubricant compositions, lubricant compositions described herein include a grease. Any grease not inconsistent with the objectives of the present invention may be used. In some cases, the grease is a grease described hereinabove in Section I, such as a lithium grease. Other greases may also be used. Moreover, in some embodiments, the grease of a lubricant composition described herein has a dropping point of 190 to 220° C. and/or a worked penetration value between about 265 and about 295 mm at 25° C., when measured according to ASTM D217. In addition, in some cases, the grease of a lubricant composition described herein has an NLGI consistency number or NLGI grade of 2. Further, in some such embodiments, the grease of a lubricant composition described herein is an NLGI-2 lithium grease. Moreover, in some instances, the grease of a lubricant composition described herein does not chemically react with organo molybdenum compounds, PTFE, ZDDP, $MoS_2$, and/or $WS_2$. Additionally, a grease described herein may also disperse one or more solid and/or liquid additives described herein. Non-limiting examples of greases suitable for use in some embodiments of lubricant compositions described herein include Mobil 33 grease or a Aeroshell, Texaco, or Lubrication Engineers grease.

The grease may be present in a lubricant composition described herein in any amount not inconsistent with the objectives of the present invention. In some instances, the grease is present in the lubricant composition in an amount of about 80-97 weight percent, 85-95 weight percent, or 89-93 weight percent, based on the total weight of the lubricant composition.

Figure 15C:
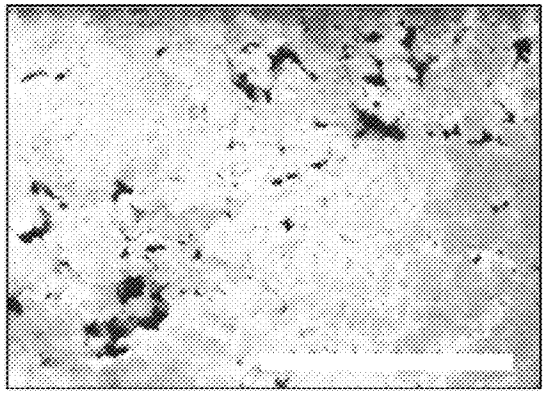
FIGS. 15A-D illustrate scanning electron microscopy (SEM) images of unmilled metal sulfide particles and of PTFE particles according to some embodiments described herein.
Figure 15D:
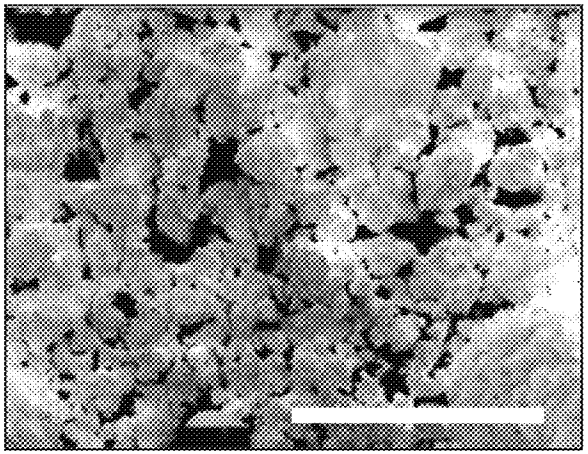
Figure 15A:
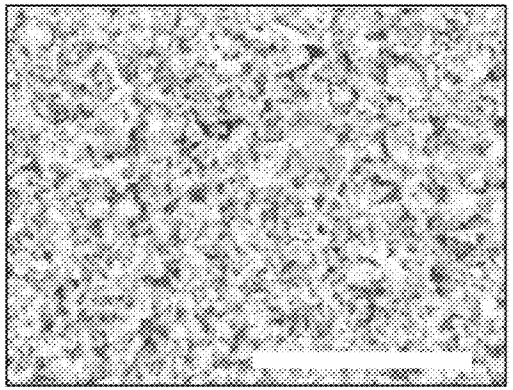
Figure 15B:
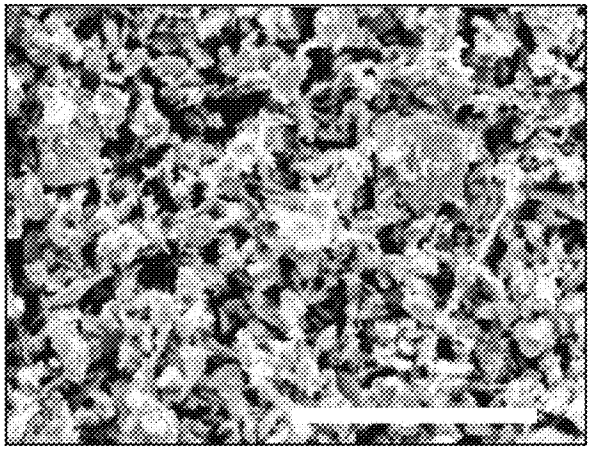

Lubricant compositions described herein also comprise PTFE particles. The PTFE particles can have any size or shape not inconsistent with the objectives of the present disclosure. In some cases, for instance, the PTFE particles can have an average diameter or length in one dimension of about 50-200 μm. In other cases, the PTFE particles can have an average diameter or length in one dimension of about 5-500 μm or about 25-350 μm. In addition, in some embodiments, the PTFE particles can have a flat, plate, flake, or disc-like shape, and the average length or width of the faces of the particles (as opposed to the average thickness of the particles) can have a value described hereinabove. Further, the PTFE particles may comprise a mixture of particle shapes. In some instances, the average diameter or length in one dimension of the PTFE particles can be the combined average for all of the PTFE particles, regardless of shape. In other instances, the average diameters or lengths described hereinabove may refer to a specific shape of particle in a mixture of differently shaped particles. Additionally, in some instances, the PTFE particles described herein have an average length describe hereinabove in more than one dimension, such as two dimensions or three dimensions. Further, in some cases, an average length or diameter of a population of the PTFE particles is the mass-median-diameter ($D_{50}$) value of the population. PTFE particles suitable for use in some embodiments described herein are shown in FIG. 15C and FIG. 15D, which illustrate SEM images of PTFE particles at 50× and 100× magnification, respectively.

Lubricant compositions described herein also comprise ZDDP. As stated above, the ZDDP may be present in a lubricant composition in an amount up to about 7 weight percent, up to about 5 weight percent, up to about 4 weight percent, or up to about 3 weight percent, based on the total weight of the lubricant composition. In some embodiments, the ZDDP is present in an amount of about 0.5 to 6 weight percent, about 1 to 5 weight percent, or about 2 to 4 weight percent, based on the total weight of the lubricant composition. Moreover, it is to be understood that these amounts of ZDDP may be in addition to any ZDDP that is present in the base grease of the lubricant composition, where the "base grease" refers to the grease component itself, prior to the addition of the PTFE particles, ZDDP, and MoDTC components described hereinabove. Alternatively, in other instances, the foregoing amounts of ZDDP can be inclusive of any ZDDP that is present in the base grease.

Lubricant compositions described herein also include an MoDTC. Any MoDTC not inconsistent with the objectives of the present invention may be used. In some embodiments, for example, the MoDTC comprises molybdenum dibutyldithiocarbamate. In other cases, the MoDTC contains a branched or unbranched, saturated or unsaturated, substituted or unsubstituted C2-C20 alkyl group other than a butyl group, wherein a "Cn" alkyl group is an alkyl group including n carbon atoms.

Moreover, in some embodiments, a lubricant composition described herein includes one more additives in addition to the PTFE particles, ZDDP, and MoDTC described above. Any such additives not inconsistent with the objectives of the present invention may be used. For example, in some cases, one or more such additives include one or more additives described hereinabove in Section I. Further, one or more such additives can be present in the lubricant composition in an amount described hereinabove in Section I.

Lubricant compositions described herein can exhibit a variety of desirable properties and/or provide improved lubrication performance, including for the lubrication of metals or metal parts. For example, in some embodiments, a lubricant composition described herein can reduce the occurrence of abrasive wear, adhesive wear, corrosive wear, and/or fatigue on lubricated metals or metal parts. Further, in some embodiments, a lubricant composition described herein can reduce wear on lubricated metal parts subjected to spectrum loading conditions. In some cases, wear of lubricated metal parts may be reduced by 5% or more, 10% or more, 15% or more, 30% or more, 40% or more, or 50% or more, compared to metal parts lubricated with otherwise similar or identical compositions lacking the PTFE particles, ZDDP, and/or MoDTC. In some instances, wear of lubricated metal parts may be reduced by 5-60%, 10-60%, 20-60%, 15-30%, 15-50%, 20-60%, 20-50%, 30-60%, 30-50%, or 40-60%, wherein the percentage is based on wear scar diameter (WSD). Additionally, in some cases, a lubricant composition described herein can reduce the torque and/or coefficient of friction (COF) exhibited by metal parts lubricated by the composition. For example, in some cases, the COF may be reduced by 15% or more, 20% or more, 25% or more, or 30% or more, compared to metal parts lubricated with a lubricant composition lacking the PTFE particles, ZDDP, and/or MoDTC. In some instances, the COF is reduced by 5-35%, 5-30%, 10-30%, 10-25%, 10-20%, 15-35%, 15-30%, or 15-25%. Moreover, a lubricant composition described herein may provide improved lubrication performance in hydrodynamic, elastohydrodynamic, mixed, and/or boundary lubrication regimes.

Lubricant compositions described herein can be produced in any manner not inconsistent with the objectives of the present invention. In some embodiments, for instance, a method of making a lubricant composition described herein comprises dispersing PTFE particles, ZDDP, and MoDTC in a grease, wherein the PTFE particles, ZDDP, and MoDTC are dispersed in the grease in an amount described hereinabove. The PTFE particles, ZDDP, and MoDTC can be dispersed in the grease in any manner not inconsistent with the objectives of the present invention. For example, in some embodiments, dispersing is carried out using a mixer or blender that mixes or blends the PTFE particles, ZDDP, MoDTC, and the grease until a homogeneous mixture is obtained.

III. Methods of Lubricating a Metal Part

In another aspect, methods of lubricating a metal part are described herein. In some embodiments, a method of lubricating a metal part comprises applying a lubricant composition described hereinabove in Section I or Section II to a metal part. Moreover, in some instances, a method of lubricating a metal part described herein comprises placing the metal part under a load and forming molybdenum disulfide particles and/or a molybdenum film in situ at one or more contacting surfaces of the metal part. In particular, when a lubricant composition of Section II is used, a method of lubricating a metal part described herein may further comprise forming a molybdenum disulfide film in situ at one or more contacting surfaces of the metal part under the load. It is to be understood that the contacting surfaces of the metal part can be external surfaces that are subjected to metal-on-metal moving contact. It is further to be understood that a lubricant composition described herein can be disposed between the contacting surfaces to provide lubrication to the surfaces. Therefore, in some embodiments, a lubricant composition described herein can be used to lubricate metal parts, such as axles and/or bearings, by applying the lubricant composition to contacting surfaces of the metal parts prior to movement of the parts, thereby reducing or preventing seizing, galling, friction, and/or wear of moving parts. Moreover, as described further herein, in some instances, a lubricant composition described herein can be used as a "universal" or near "universal" lubricant for aerospace applications, where a wide variety of lubrication conditions may be encountered.

Some embodiments described herein are further illustrated by the following non-limiting examples.

Example 1

Lubricant Composition Comprising Milled Metal Sulfide Particles

A lubricant composition according to one embodiment described herein was prepared as follows. This grease blend is denoted as Lubricant Composition 1. Molybdenum disulfide (TECHFINE,™ Climax Molybdenum, Phoenix, Ariz.) with average particle size in the range of 5-20 μm was mixed with hexane in a 1:1 weight ratio and placed in a 250 ML high density polyethylene (HDPE) bottle. To this mixture 40 weight percent of zirconia balls of varying sizes (0.625 mm to 12.5 mm) were added, 40 weight percent, based on the combined weight of $MoS_2$, hexanes, and zirconia balls. The resulting mixture was then subjected to milling in a planetary ball-mill for 48 hours. After milling was completed, the contents of the bottle were filtered through a steel mesh to separate the zirconia balls. The filtrate was stored in a fume hood at room temperature for 24 hours to evaporate the hexane. A total of 3 weight percent of the milled $MoS_2$ particles was added to a lithium-containing base grease, based on the total weight of the lubricant composition. The base grease used was a NLGI grade 2 that had a dropping point of 188° C., had a lithium 12-hydroxystearate thickener, and had a base oil having a kinematic viscosity of 220 centistokes at 40° C.

The lubricant composition was blended for two hours with a stand mixer (Kitchen Aid) with a power rating of 250 Watts and a capacity of 1 gallon; after each interval of 15 to 20 minutes, the mixer was stopped and the grease blend was manually mixed using a spatula so as to homogenize the contents in the bowl of the mixer. These conditions will be referred to hereinafter as "standard blending conditions". A comparative composition denoted as Comparative Composition 1 was prepared identically, except that $MoS_2$ particles were not ball-milled prior to being added to the base grease. These compositions are shown in Table 1.

TABLE 1

| Composition | Base Grease | Metal Sulfide | Wt % Metal Sulfide |
|---|---|---|---|
| Lubricant Composition 1 | Lithium 12[1] hydroxystearate | Ball-milled TECHFINE $MoS_2$ | 3 wt % |
| Comparative Composition 1 | Lithium 12 hydroxystearate | TECHFINE $MoS_2$ (unmilled) | 3 wt % |

[1]NLGI grade 2

Images of unmilled $MoS_2$ and of $MoS_2$ milled were obtained using an environmental scanning electron microscope (SEM) (Hitachi S-3000N) at 500× and 1000× magnification at an acceleration of 10 to 15 kV and at a working distance of 14 to 15 mm. SEM images in FIG. 1 are of unmilled $MoS_2$ at 500× (FIG. 1A); unmilled $MoS_2$ at 1000× (FIG. 1B); milled $MoS_2$ at 500× (FIG. 1C); milled $MoS_2$ at 1000× (FIG. 1D). The unmilled $MoS_2$ has sharp edges and corners compared to the milled $MoS_2$. There is no observed agglomeration of milled $MoS_2$ particles.

Lubricant Composition 1 ("LC1') and Comparative Composition 1 (CC1) were tested in a four ball tribometer (Phoenix Tribology TE92) to evaluate the wear and friction performance. Each composition was stirred with a spatula immediately before testing in order to ensure the consistency and to ensure that bleeding did not alter the compositions' performance.

Four-ball tribometer wear tests were conducted in a continuous sliding mode under boundary lubrication regime using LC1 or CC1 as the lubricant. Six different tests that varied load and speed were conducted, as shown in Table 2. The tests where the load was varied while keeping other variables fixed were termed as "Cyclic Loading" tests. The tests where the speed was varied while keeping other variables fixed were termed as "Cyclic Frequency" tests. Tests were conducted with three steel balls placed in a chuck that were locked using a cage, and a fourth ball rotated against the three stationary balls with the LC1 or CC1 in between. Test balls were E5100 steel (bearing quality aircraft grade steel) and were ½" in diameter.

TABLE 2

Figure 2A:
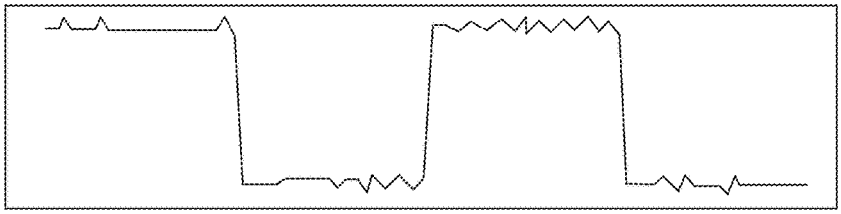
FIGS. 2A-F illustrate graphical representations of loads.
Figure 2B:
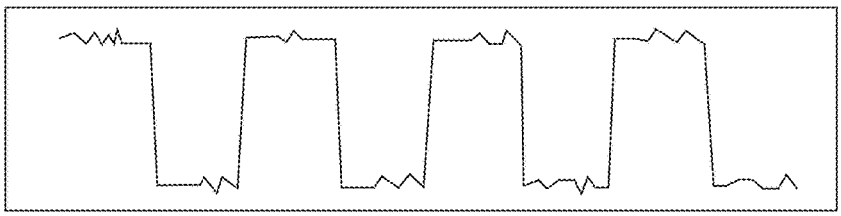
Figure 2C:
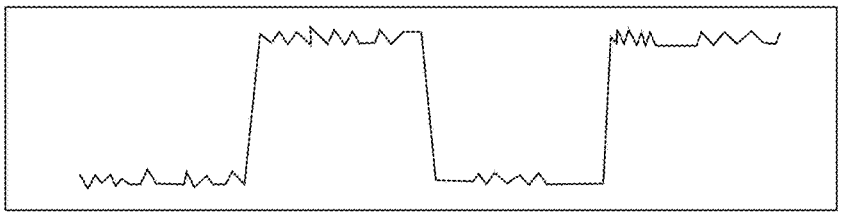

| Test | Test Conditions | Test Type | Constant Values | Graphical Representation |
|---|---|---|---|---|
| 1 | 80-40-80-40 (kg)-15 min step | Ramp-down | 1200 RPM 75° C. 7200 cycles | See FIG. 2A |
| 2 | 80-40-80-40 (kg)-7.5 min step | Ramp-down | 1200 RPM 75° C. 7200 cycles | See FIG. 2B |
| 3 | 40-80-40-80 (kg)-15 min step | Ramp-up | 1200 RPM 75° C. 7200 cycles | See FIG. 2C |

TABLE 2-continued

Figure 2D:
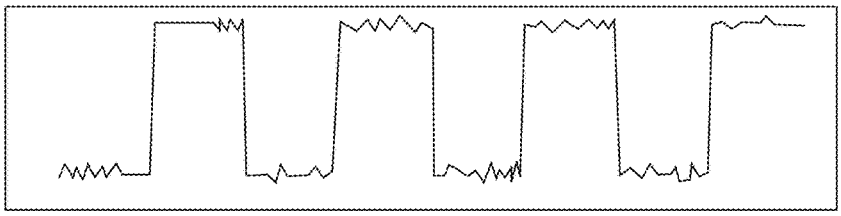
Figure 2E:
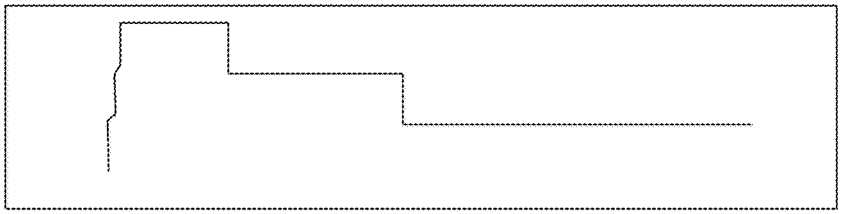
Figure 2F:
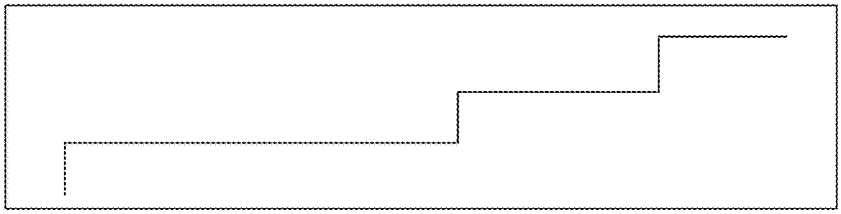

| Test | Test Conditions | Test Type | Constant Values | Graphical Representation |
|---|---|---|---|---|
| 4 | 40-80-40-80 (kg)-7.5 min step | Ramp-up | 1200 RPM 75° C. 7200 cycles | See FIG. 2D |
| 5 | 1800-1200-600 (RPM) 40-20-13.3 min | Ramp-down | 40 KG 75° C. 7200 cycles | See FIG. 2E |
| 6 | 600-1200-1800 (RPM) 13.3-20-40 min | Ramp-up | 40 KG 75° C. 7200les | See FIG. 2F |

Tests 1 to 4 were cyclic loading tests and Tests 5 and 6 were cyclic frequency tests. Tests 1, 2, and 5 can be further categorized as "Ramp-down" tests where the text begins at a higher load or frequency and terminates at a correspondingly lower value. Similarly, Tests 3, 4, and 6 can be further categorized as "Ramp-up" tests where the text begins at a lower load or frequency and terminates at a correspondingly higher value. These test conditions will be referred to as "the six test conditions". All tests were run in duplicate to avoid discrepancies in the data and had 7200 cycles maintained constant for each test.

The cyclic loading tests were started with an initial load of 40 kilograms (kg) and were ramped up to 80 kg in the Ramp-up tests and were started with an initial load of 80 kilograms (kg) and were ramped down to 40 kg in the Ramp-down tests. The tests were further classified on the basis of load step sizes of 7.5 min and 15 min for each cycle. The rotations per minute (rpm) and test temperature were maintained at 1200 rpm and 75±5° C. in the cyclic loading tests. The cyclic frequency tests were started with an initial frequency of 600 rpm and ramped up to 1800 rpm in steps of 600 rpm and vice versa. The load and test temperature were maintained at 40 kg and 75±5° C. in the cyclic frequency tests. In all cases the friction was measured for the duration of the test and recorded. After the termination of every test, the three stationary steel balls were retrieved and analyzed to determine the Wear Scar Diameter (WSD). The tribofilm formed on the surface was analyzed and the wear mechanism was studied for each case.

Stereo-Optical Microscopy and Scanning Electron Microscopy (SEM) Studies: A stereo-optical microscope (Nikon SMZ 1500) was used to image the wear scars formed on the three stationary steel balls after the four-ball tribometer tests were conducted using LC1 and CC1 as the lubricants. The steel balls were cleaned using hexanes and were mounted on a specially designed sample holder. The balls were then imaged at a magnification of 100×, and the resulting images were analyzed using software provided by Quartz Imaging Corporation. An environmental scanning electron microscope (SEM) (Hitachi S-3000N) was used in the secondary electron (SE) mode to image the wear surfaces at an accelerating voltage of 15-20 kV. Carbon tape was used to maintain good electrical contact between the steel ball and the sample holder. The wear mechanism in play on the surface as well as the tribofilm was evaluated. Specific areas on the surface which were of interest were imaged at a higher magnification to evaluate the wear mechanism. The energy dispersive spectroscopy (EDS) microanalyzer unit (EDAX Genesis) attached to the SEM was used to study the elemental composition of the wear surface. These SEM settings will be referred to as "standard SEM settings".

Figure 3A:
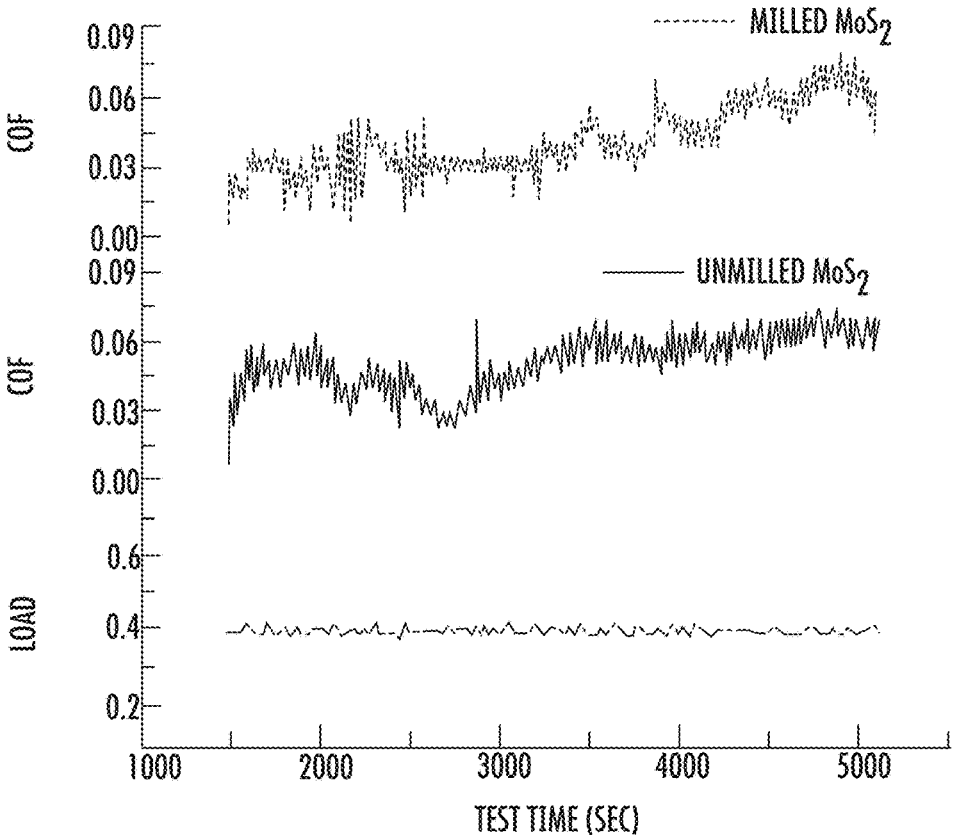
FIGS. 3A and 3B illustrate Coefficient of Friction (COF) and Wear Scar Diameter (WSD) values for metal parts lubricated with a comparative composition and with a lubricant composition according to some embodiments described herein.
Figure 3B:
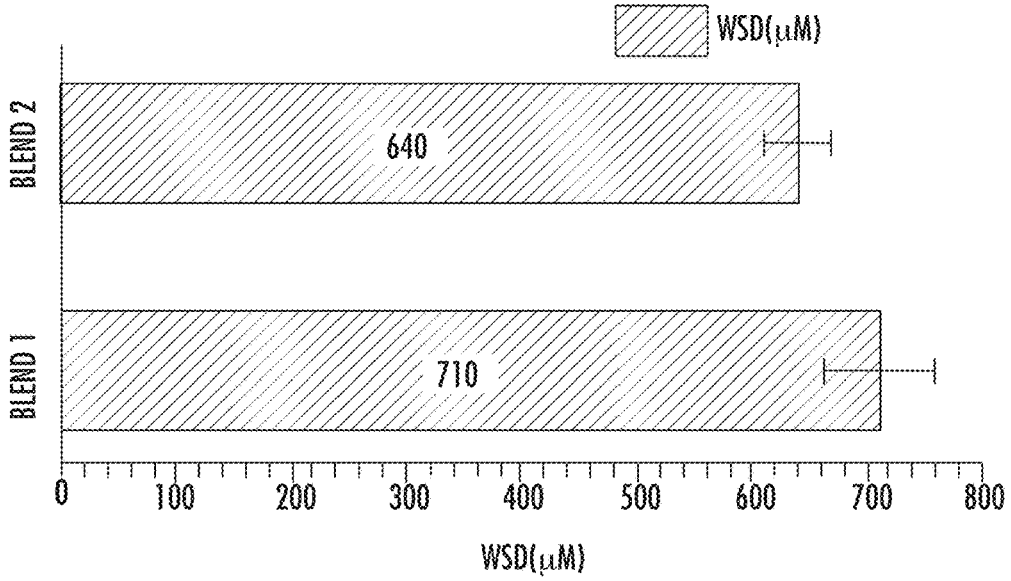

LC1 (denotes as Blend 2) and CC1 (denoted as Blend 1) were tested according to ASTM D2266, FIG. 3A compares the coefficient of friction. The coefficient of friction (COF) in the case of CC1 increases to 0.07 and stays high for the duration of the test with minimal drops. For LC1, the COF remains lower for a longer period of time before it gradually increases to 0.07. The WSD was obtained for all the test balls from the four-ball tribometer tests, and an average values were reported in μm in FIGS. 3B and 3C. In FIG. 3B it can be seen that balls lubricated with CC1 exhibit a higher wear number than balls lubricated with LC1.

Figure 3C:
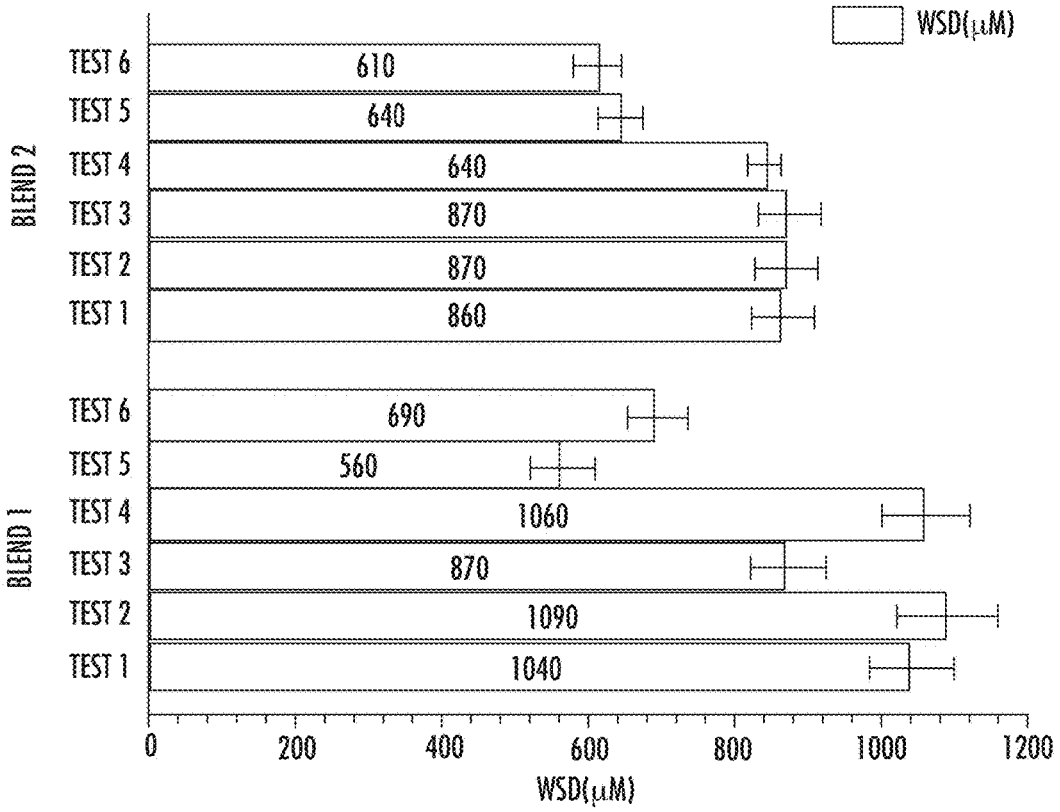
FIG. 3C illustrates WSD values for metal parts lubricated with a comparative composition and with a lubricant composition according to some embodiments described herein.
Figure 4B:
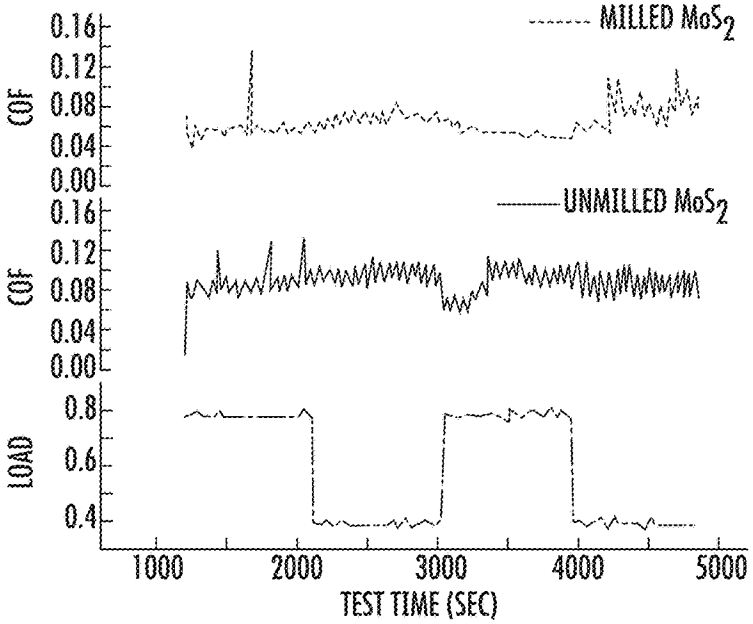
FIGS. 4A-D illustrate torque and COF values for metal parts lubricated with a comparative composition and with a lubricant composition according to some embodiments described herein.
Figure 4A:
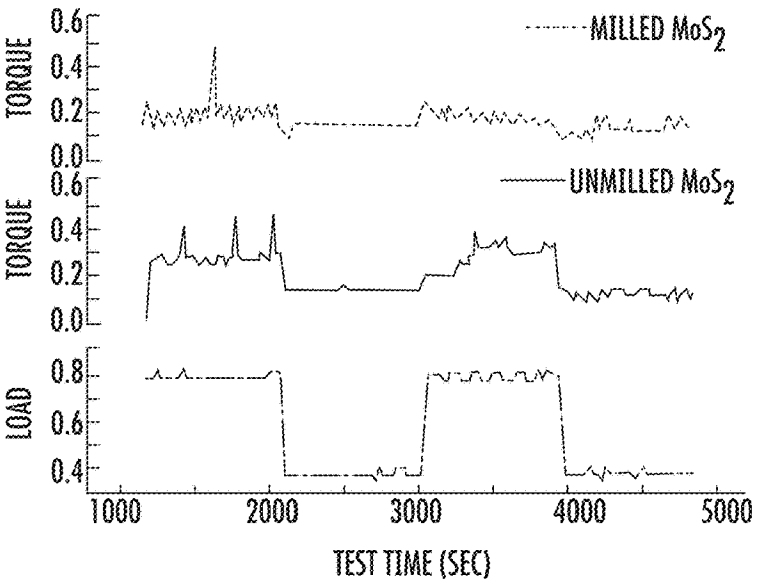
Figure 4D:
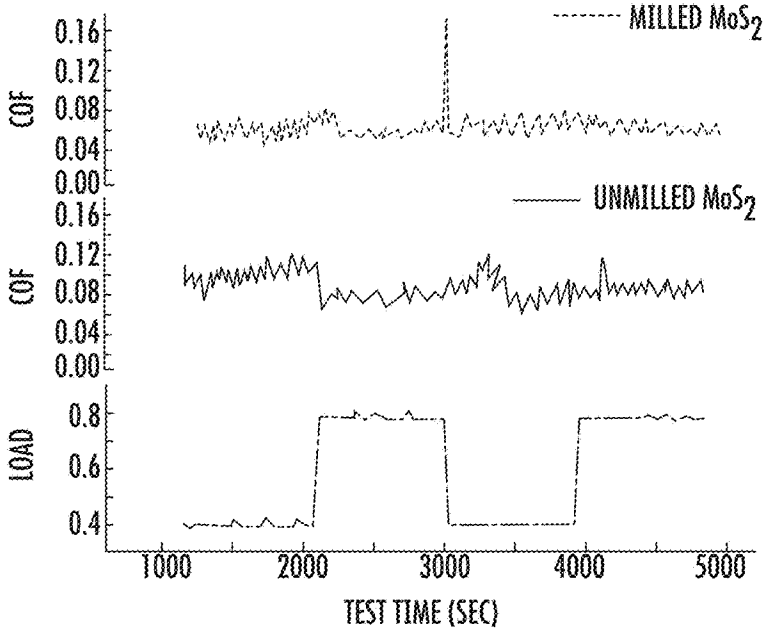
Figure 4C:
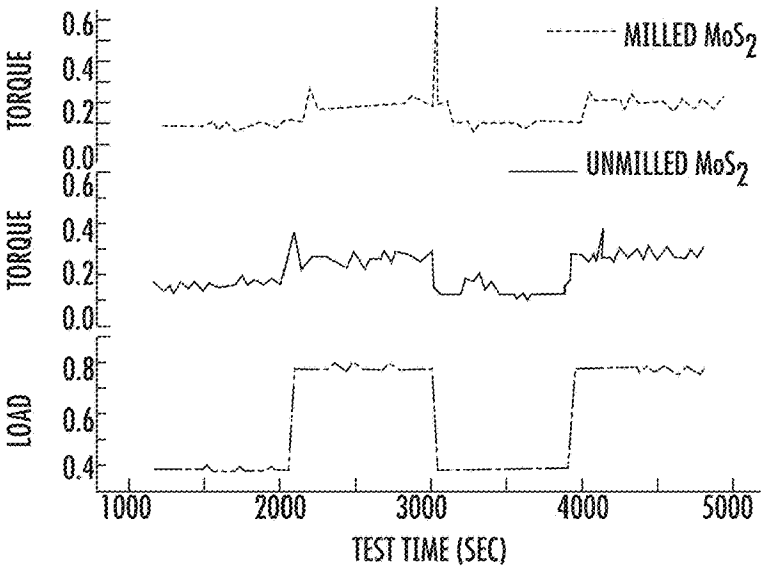
Figure 5B:
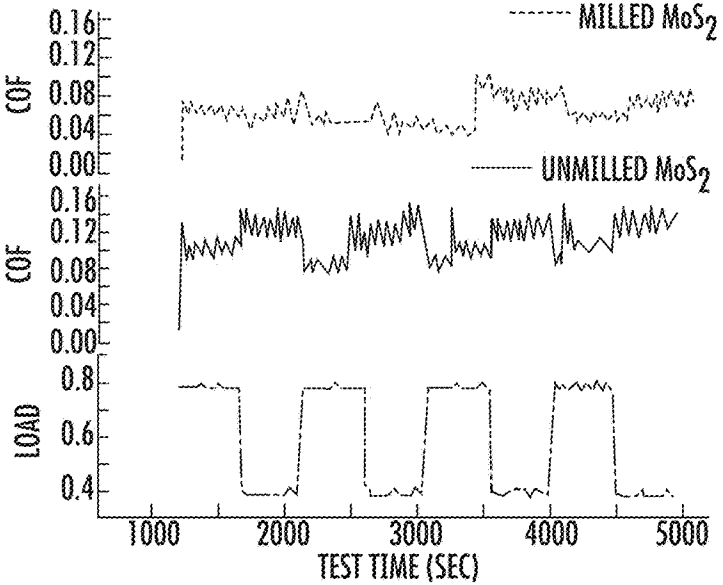
FIGS. 5A-D illustrate torque and COF values for metals lubricated with a comparative composition and with a lubricant composition according to some embodiments described herein.
Figure 5A:
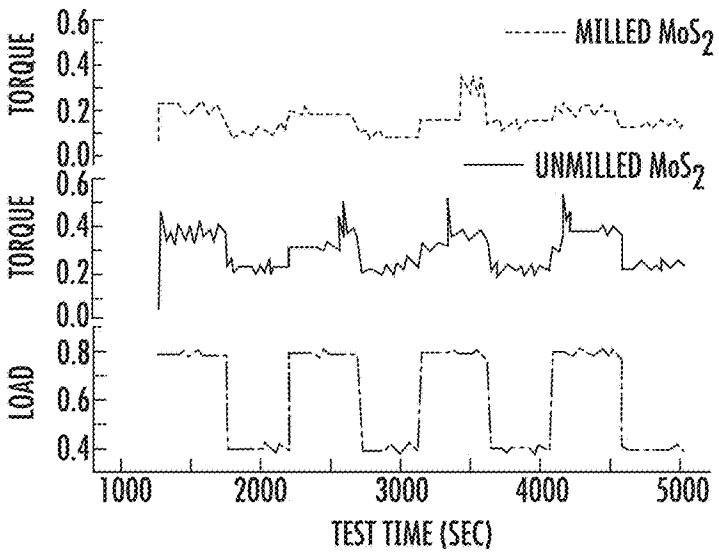
Figure 5D:
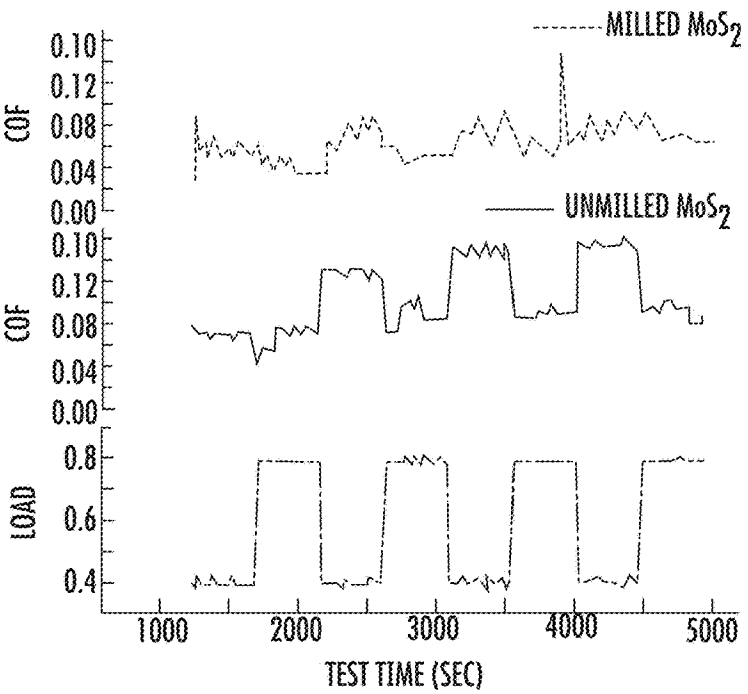
Figure 5C:
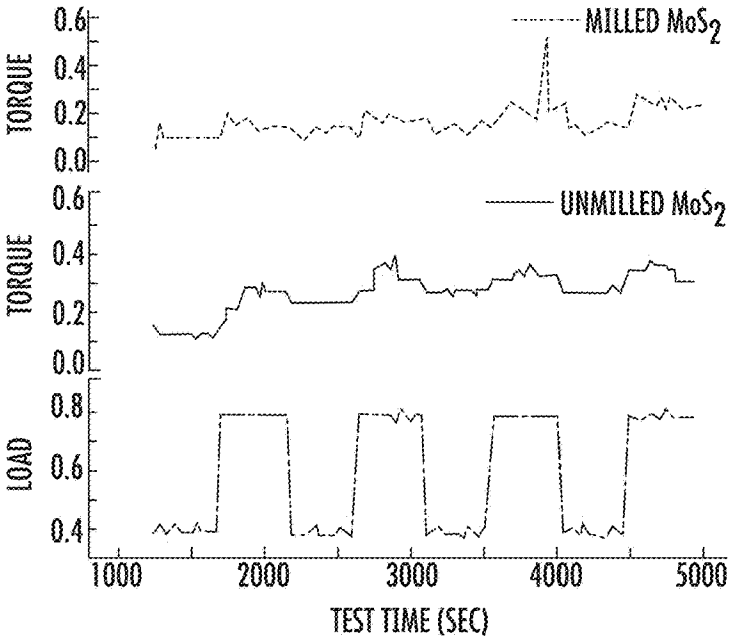
Figure 6B:
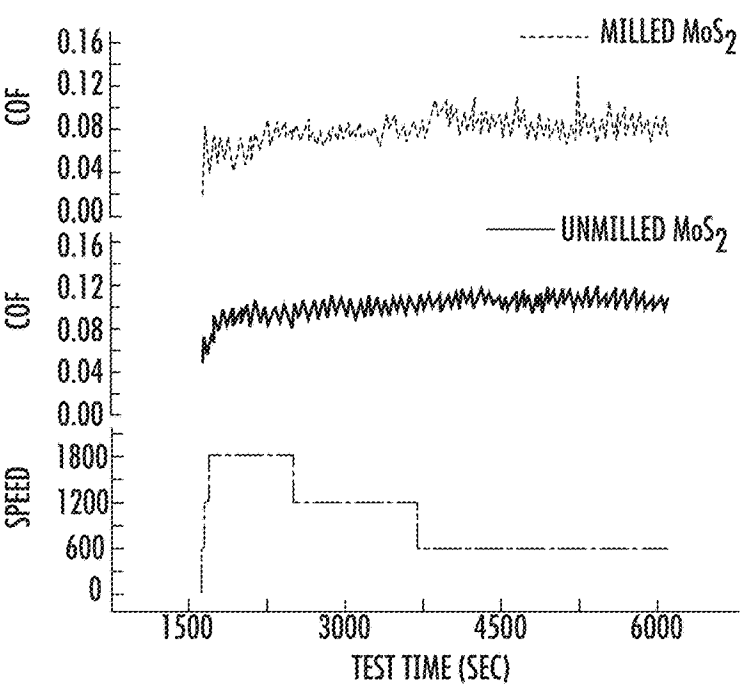
FIGS. 6A-D illustrate torque and COF values for metals lubricated with a comparative composition and with a lubricant composition according to some embodiments described herein.
Figure 6A:
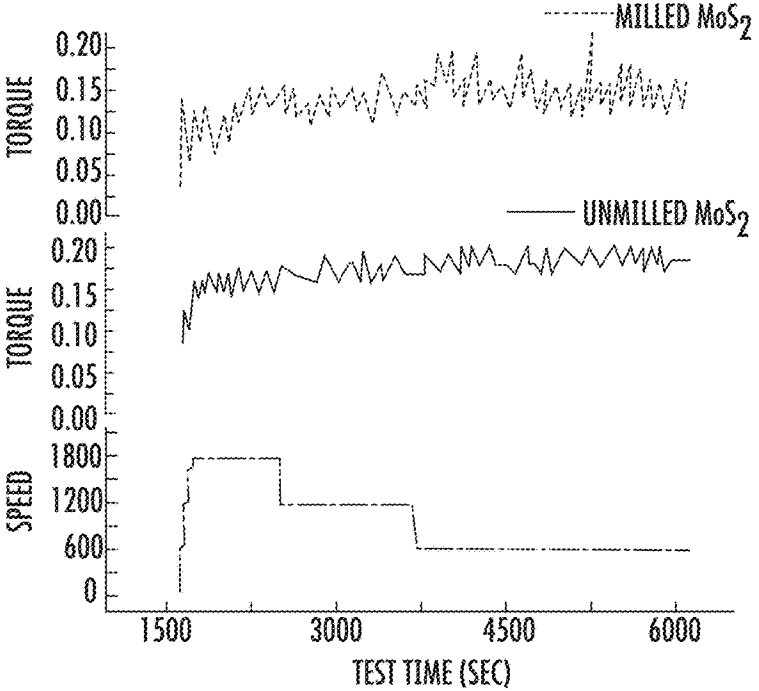
Figure 6D:
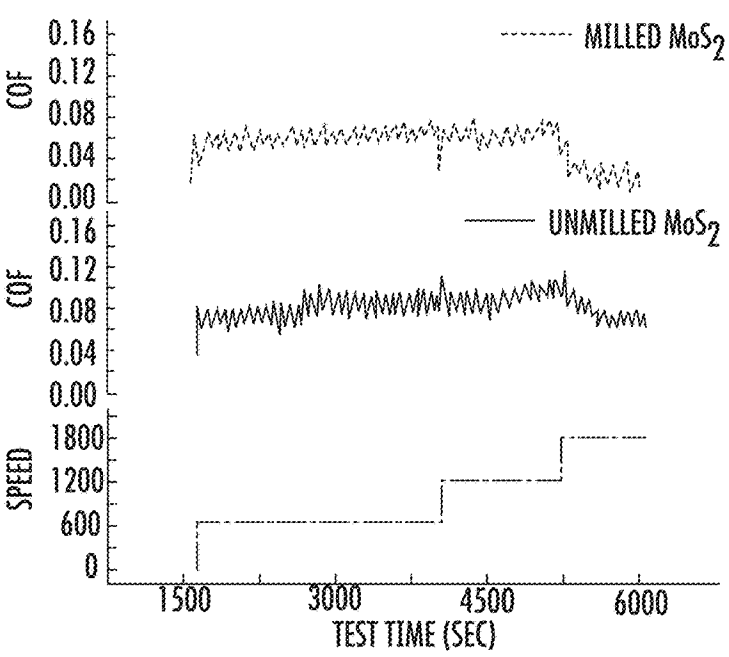
Figure 6C:
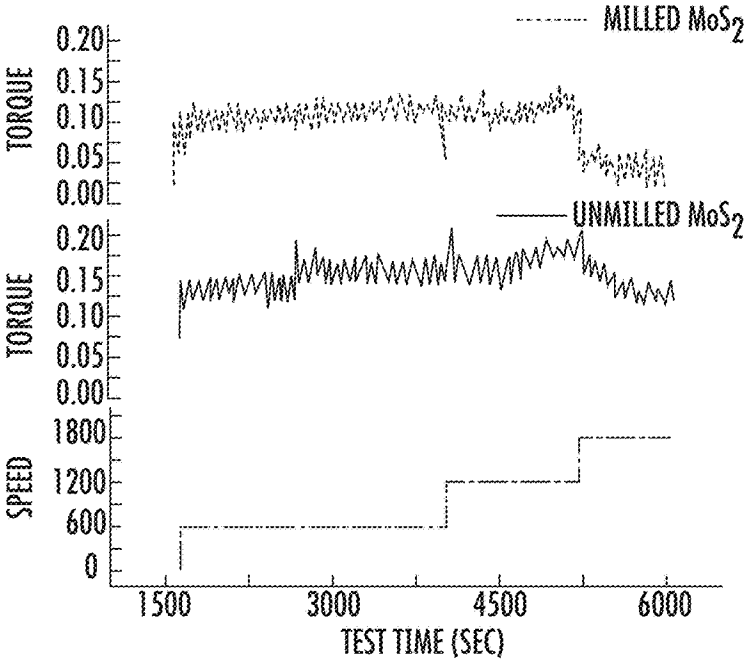
Figure 7A:
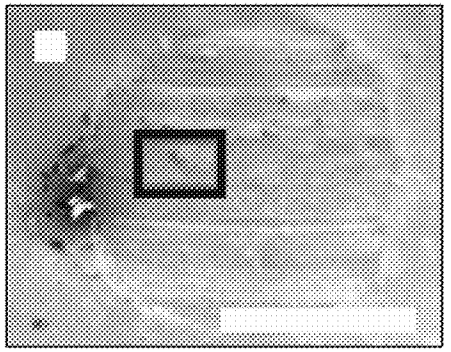
FIGS. 7A-F illustrate SEM images of wear scars on metal parts lubricated with a comparative composition.
Figure 7B:
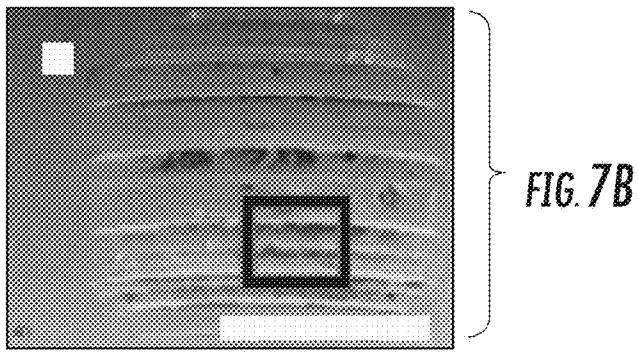
Figure 7C:
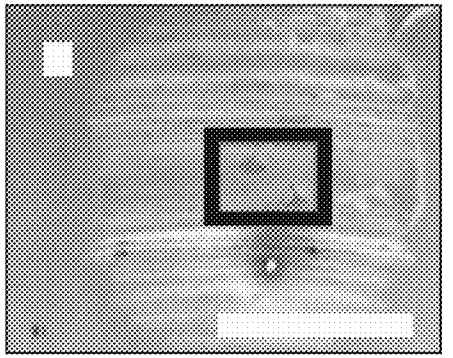
Figure 7D:
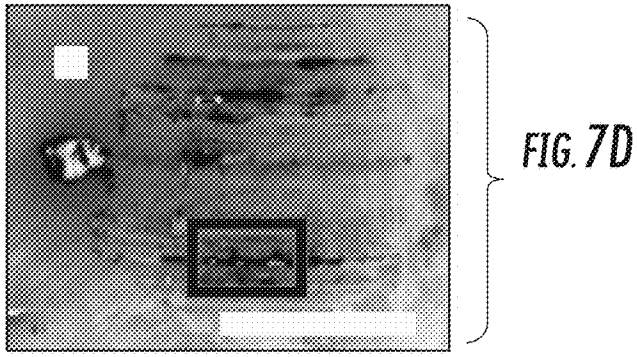
Figure 7E:
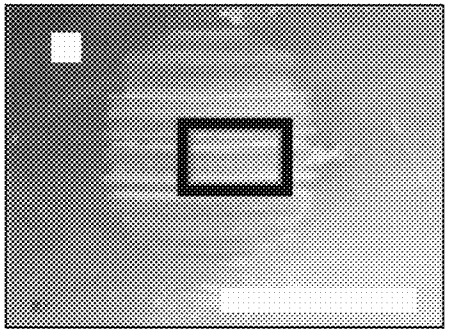
Figure 7F:
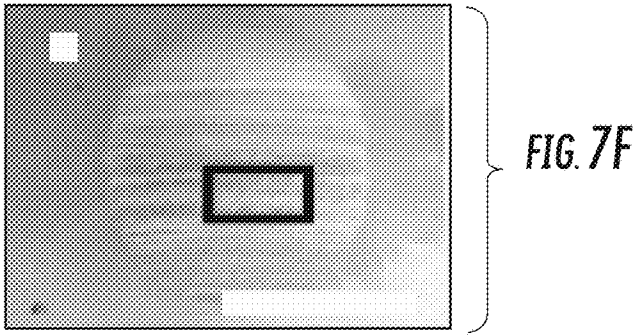
Figure 8A:
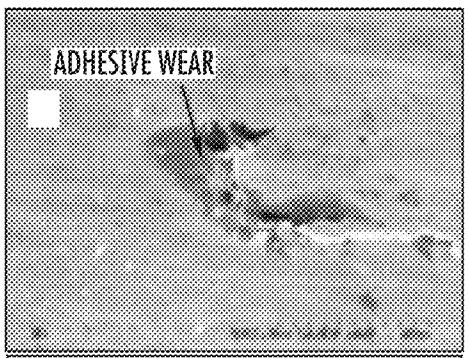
FIGS. 8A-F illustrate SEM images of wear scars on metal parts lubricated with a lubricant composition according to some embodiments described herein.
Figure 8B:
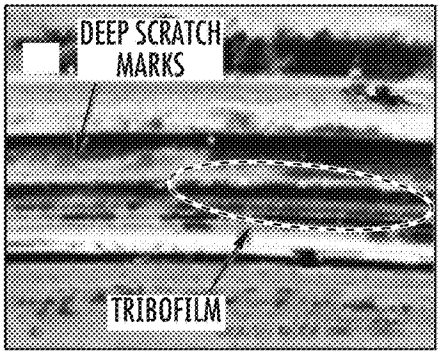
Figure 8C:
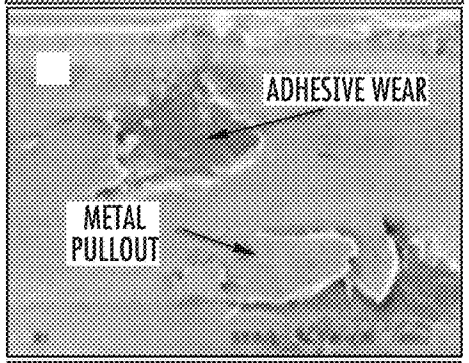
Figure 8D:
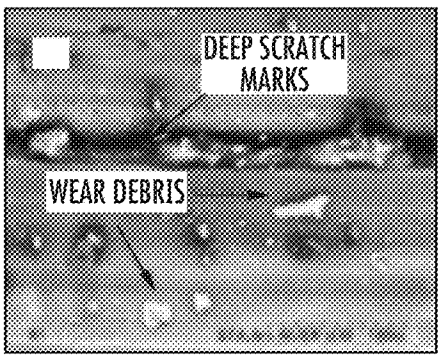
Figure 8E:
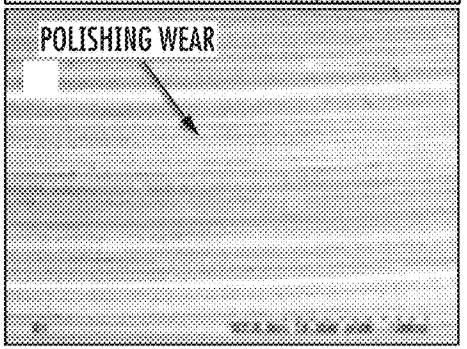
Figure 8F:
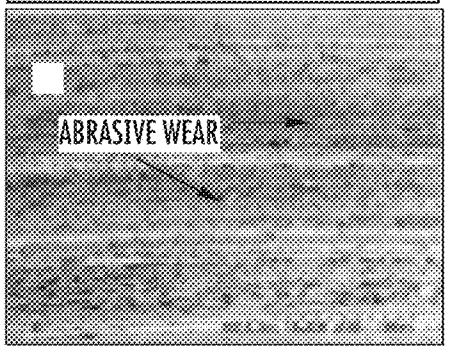

FIG. 3C shows wear numbers for testing conducted under the six test conditions. The wear numbers are in the form of a bar chart for the tests, which were previously described in Table 2 and FIG. 2. All the values for WSD are reported in μm with the average values inset at the center of each bar. The error bars represent the corresponding variation in the WSD values. Balls lubricated with CC1 exhibit a higher wear number than balls lubricated with LC1 in almost all cases, and the differences are statistically significant. In addition, the wear numbers obtained from cyclic frequency tests for both blends are lower than the wear numbers obtained from cyclic loading tests.

Torque and Coefficient of Friction (COF) were obtained from the tests conducted using the four-ball tribometer using LC1 and CC1. Torque values are measured whereas COF values are derived and hence were calculated using the procedure described in ASTM D5183-05. FIGS. 4-6 represent the torque and COF values for both LC1 and CC1 for the six test conditions. The load values are plotted in kilonewtons (kN), the frequency or the sliding speed values are in rotations per minute (rpm) and the torque values are in newton-meters (Nm). FIGS. 4 and 5 compare the torque and friction response of the LC1 and CC1 under cyclic loading conditions, whereas FIG. 6 compares the torque and friction response of the LC1 and CC1 under cyclic frequency conditions. On comparing the torque and COF values, a clear observation can be made in all the cases that LC1 containing milled $MoS_2$ has smaller variation in the torque and COF coupled with absolute lower values of COF when compared to CC1 containing unmilled $MoS_2$.

FIG. 4 compares the ramp-up and ramp-down conditions under cyclic loading regimes having a load step size of 15 minutes. FIG. 4A and FIG. 4C compare the torque responses for CC1 and LC1 and FIG. 4B and FIG. 4D compare the COF values of both LC1 and CC1 for corresponding loading conditions. These tests consist of 4 load steps of 15 minutes, each consisting of 18000 cycles that result in a total of 72000 cycles for the duration of the test.

FIG. 5 compares the ramp-up and ramp-down conditions under cyclic loading regimes having a load step size of 7.5 minutes. When the torque and COF output obtained from tests with load step sizes of 7.5 minutes is compared to the torque and COF output obtained from tests with load step sizes of 15 minutes, a higher number of load variations leads to a coarser corresponding torque and COF data. In addition, the data obtained from CC1 has more excursions than the data obtained from LC1. FIG. 5A and FIG. 5C compares the torque responses for CC1 and LC1 and FIG. 5B and FIG. 5D compares the COF values of both blends for the corresponding loading conditions. These tests consist of 8 load steps of 7.5 minutes, each consisting of 9000 cycles that result in a total of 72000 cycles throughout the test.

FIG. 6 compares the ramp-up and ramp-down conditions under cyclic frequency regimes which have a frequency step size of 600 rpm; the speed and torque values are plotted in rpm and Nm, respectively. FIG. 6A and FIG. 6C compares the torque responses for CC1 and LC1, and FIG. 6B and FIG. 6D compares the COF values of both LC1 and CC1 for the corresponding frequency conditions. These tests consist of 3 frequency steps, each consisting of 24000 cycles that result in a total of 72000 cycles throughout the test. The torque and COF variations in the case of cyclic frequency conditions are almost flat in both the LC1 and CC1. During the ramp-up tests at a frequency step of 1800 rpm, there is a drop in the COF in both the LC1 and CC1 at higher rpm.

SEM images of the Wear Surface obtained using CC1 are depicted in FIG. 7. SEM images for cyclic loading conditions (FIGS. 7A-7D) and cyclic frequency conditions (FIG. 7E and FIG. 7F) are shown. Conditions were as follows: (a) Load ramp down test with step length of 15 minutes; (b) Load ramp down test with step length of 7.5 minutes; (c) Load ramp up with step length of 15 minutes; (d) Load ramp down with step length of 7.5 minutes; (e) Frequency ramp down with step size of 600 rpm; and (f) Frequency ramp up with step size of 600 rpm. It is evident that the cyclic loading tests (a-d) have larger WSDs as compared to the cyclic frequency tests (e-f). Details of the types of wear observed are illustrated in FIG. 8.

SEM images of the Wear Surface obtained using LC1 are depicted in FIG. 9. FIGS. 9A-D illustrate SEM images corresponding to cyclic loading conditions and FIGS. 9E-F represent the cyclic frequency conditions. The test conditions were the same as for FIGS. 7A-F. On comparison with FIG. 7, there is a difference with respect to the amount of wear on the surface. Unmilled $MoS_2$ grease results in a greater amount of metal removal and abrasive wear as compared to milled $MoS_2$ grease. It is clearly seen that the images for cyclic frequency conditions show smaller amount of wear as compared to the cyclic loading conditions.

A comparison between the images in FIG. 9 to the corresponding images in FIG. 7 shows a large amount of wear for the cyclic loading tests as compared to the cyclic frequency tests. There is a presence of excessive amount of abrasive wear and metal removal for cyclic loading tests as compared to the presence of polishing wear in the cyclic frequency tests.

SEM images of the Wear Surface obtained using LC1 are depicted in FIG. 10. SEM images for cyclic loading conditions FIGS. 10A-C and cyclic frequency conditions FIG. 10E-F are shown. The images show that abrasive wear mechanisms and metal pull-out are dominant mechanisms in cyclic loading conditions whereas polishing wear is evident in cyclic frequency conditions. There is a presence of tribofilms on the wear surface that protects the surface from further wear and abrasion, thus decreasing the measured wear scar diameter.

Figure 11:
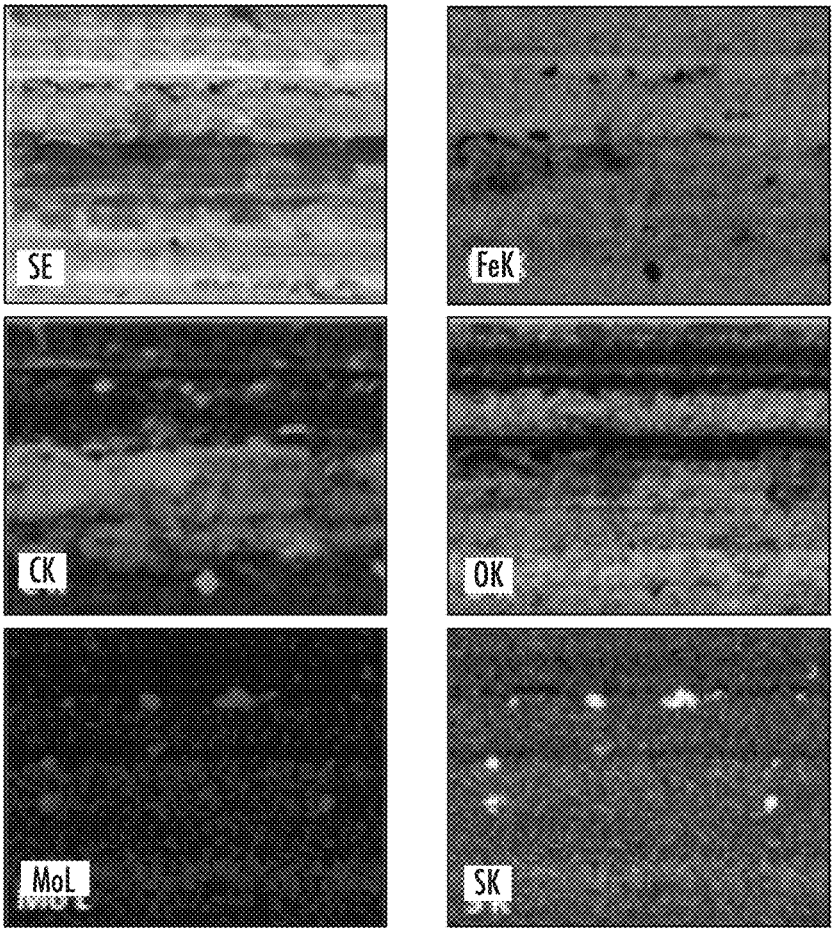
FIG. 11 illustrates Energy Dispersive Spectroscopy (EDS) elemental maps and spectra from the wear surface of a metal lubricated with a lubricant composition according to some embodiments described herein.
Figure 11:
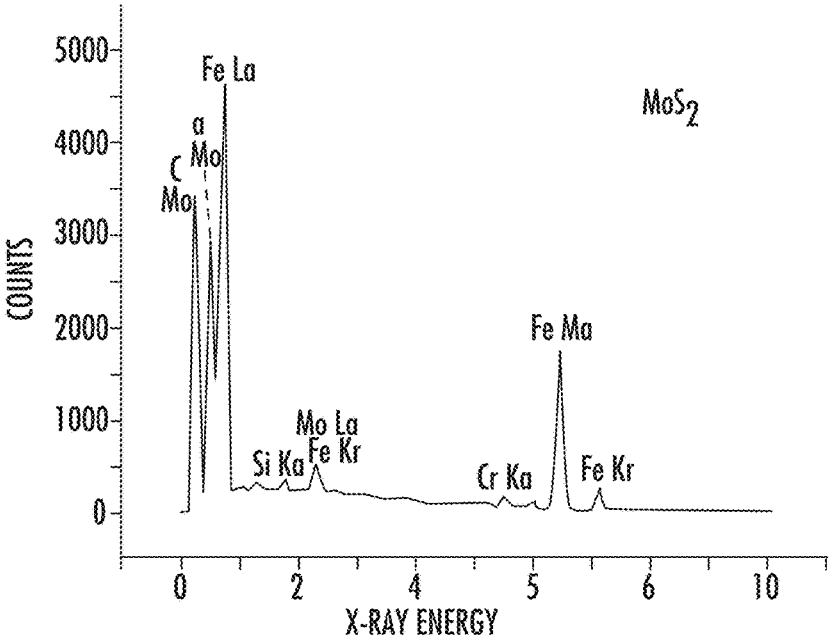

High resolution energy dispersive spectroscopy (EDS) maps and spectra of the wear surface obtained from using LC1 under ASTM 2266 conditions are shown in FIG. 11. EDS data were obtained at an acceleration voltage of 15 kV and a magnification of 750×; elemental maps were collected from the region shown in the SEM image for elements Mo, S, C, O, and Fe (hereinafter "standard EDS conditions"). The darker regions on the Fe map show the presence of tribofilms on the surface. The bright patchy regions on the Mo and S maps show the formation of $MoS_2$ tribofilms that increase the load bearing capability and reduce wear. The C rich regions represent the regions containing degraded grease components. The 0 rich regions indicate formation of oxides of Mo and Fe. The EDS spectrum gives a qualitative comparison of the elements present on the wear surface.

Example 2

Lubricant Composition Comprising Milled Metal Sulfide Particles

Additives for additional Lubricant Compositions were prepared by milling $MoS_2$ (TECHFINE) and nano $MoS_2$ (US Research Nanomaterials, Inc.) in the presence of additives according to Table 3. To each 20 mL mixture from Table 3 was added 20 mL of zirconia balls, and the resulting composition was milled for one hour in a high energy ball mill, then the mixture was separated from the zirconia balls. The resultant blended particles and additives were added to a base grease (lithium hydroxystearate) to yield lubricant compositions containing $MoS_2$ in an amount of 3 weight percent based on the total weight of the lubricant composition.

The total volume of additives was then dispersed in base grease to form additional lubricant compositions under standard blending conditions. Table 4 details the lubricant compositions.

TABLE 3

| Additives for Composition | Metal Sulfide | Dispersant (sorbitan monooleate) | Polythiol (TPS 44) | Base Oil (poly-alfaolefin) | Total Volume |
|---|---|---|---|---|---|
| LC2 | TECHFINE $MoS_2$ 10 g | — | — | 17.6 g | 20 mL |
| LC3 | TECHFINE $MoS_2$ 10 g | 5 g | — | 13.5 g | 20 mL |
| LC4 | TECHFINE $MoS_2$ 10 g | — | 10 g | 8.9 g | 20 mL |
| LC5 | TECHFINE $MoS_2$ 10 g | 5 g | 10 g | 4.7 g | 20 mL |
| LC6 | Nano $MoS_2$ 10 g | — | — | 17.6 g | 20 mL |
| LC7 | Nano $MoS_2$ 10 g | 5 g | — | 13.5 g | 20 mL |
| LC8 | Nano $MoS_2$ 10 g | — | 10 g | 8.9 g | 20 mL |
| LC9 | Nano $MoS_2$ 10 g | 5 g | 10 g | 4.7 g | 20 mL |

TABLE 4

| Lubricant Composition | Metal Sulfide Type | Base Grease | Additives | Additive weight % |
|---|---|---|---|---|
| LC2 | TECHFINE $MoS_2$ | Lithium 12 hydroxystearate[2] | $MoS_2$ | 3 wt % |
| LC3 | TECHFINE $MoS_2$ | Lithium 12 hydroxystearate | $MoS_2$<br>sorbitan monooleate | 3 wt %<br>1.5 wt % |
| LC4 | TECHFINE $MoS_2$ | Lithium 12 hydroxystearate | $MoS_2$<br>TPS 44 | 3 wt %<br>3 wt % |
| LC5 | TECHFINE $MoS_2$ | Lithium 12 hydroxystearate | $MoS_2$<br>sorbitan monooleate<br>TPS 44 | 3 wt %<br>3 wt %<br>1.5 wt % |
| LC6 | Nano $MoS_2$ | Lithium 12 hydroxystearate | $MoS_2$ | 3 wt % |
| LC7 | Nano $MoS_2$ | Lithium 12 hydroxystearate | $MoS_2$<br>sorbitan monooleate | 3 wt %<br>1.5 wt % |
| LC8 | Nano $MoS_2$ | Lithium 12 hydroxystearate | $MoS_2$<br>TPS 44 | 3 wt %<br>3 wt % |
| LC9 | Nano $MoS_2$ | Lithium 12 hydroxystearate | $MoS_2$<br>sorbitan monooleate<br>TPS ® 44 | 3 wt %<br>3 wt %<br>1.5 wt % |

[2]NLGI grade 2

Figure 12:
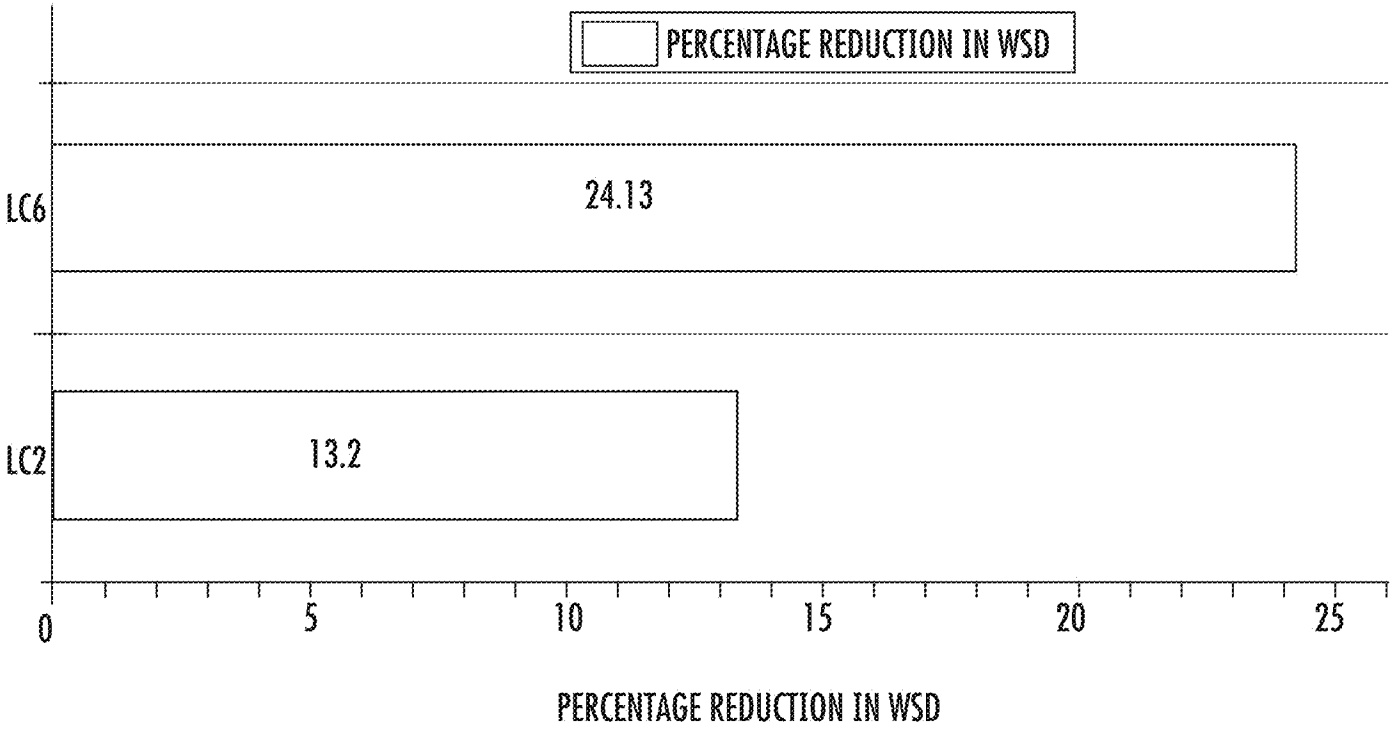
FIG. 12 illustrates percent reduction in WSD on metals lubricated with lubricant compositions according to some embodiments described herein.

FIG. 12 shows the percent reduction in WSD for metals lubricated with LC2 and LC6, compared to CC2 and CC6, which were prepared identically to LC2 and LC6, respectively, except that the metal sulfide particles were not milled. Use of LC2, which contains milled $MoS_2$, results in a 13 percent reduction in WSD compared to CC2, and use of LC6, which contains milled nano $MoS_2$, results in a 24 percent reduction in WSD compared to CC6.

Figure 13:
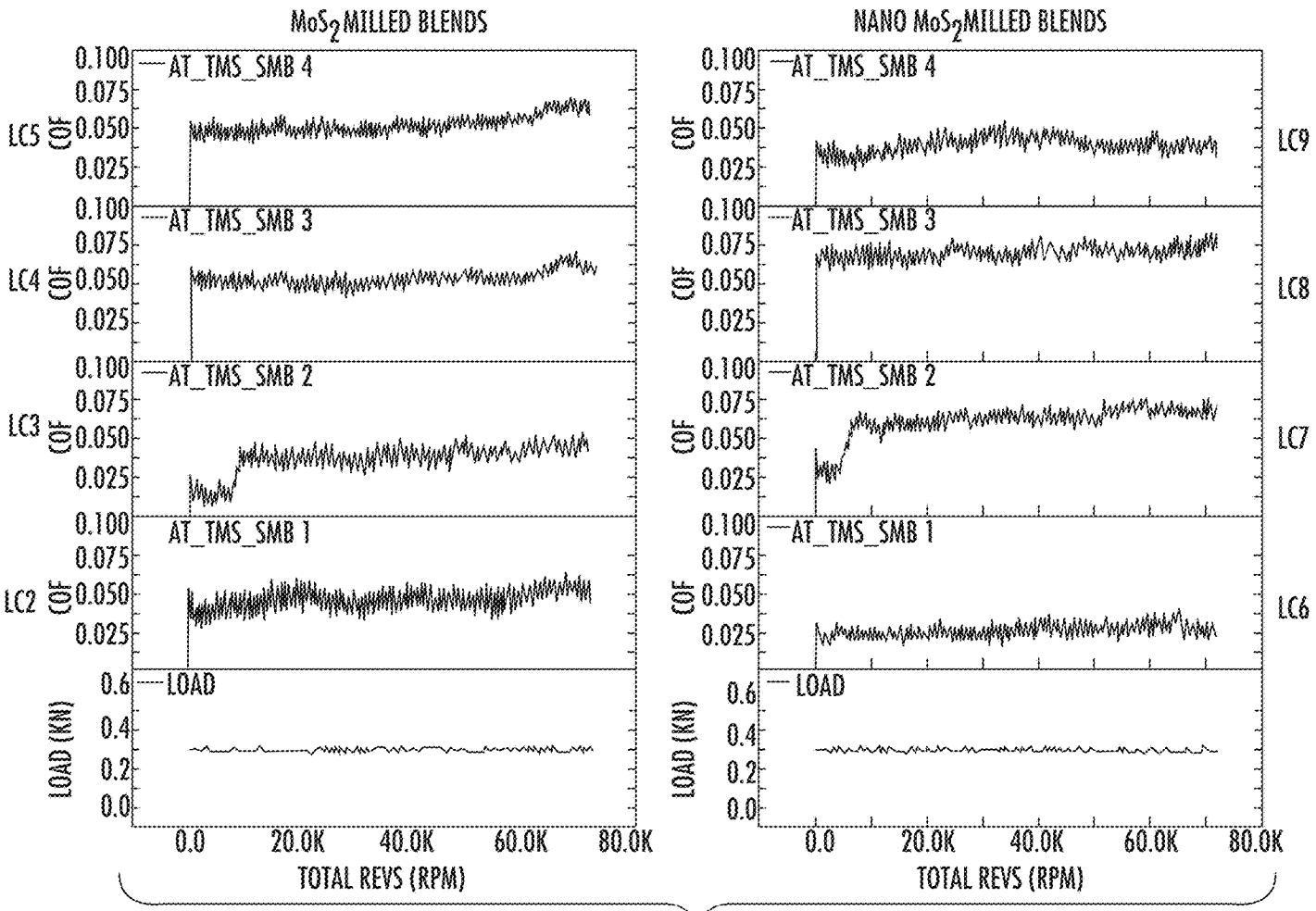
FIG. 13 illustrates torque and COF values on metals lubricated with lubricant compositions according to some embodiments described herein.

FIG. 13 shows the COF for LC2-LC9, which average approximately 0.05.

Figure 14:
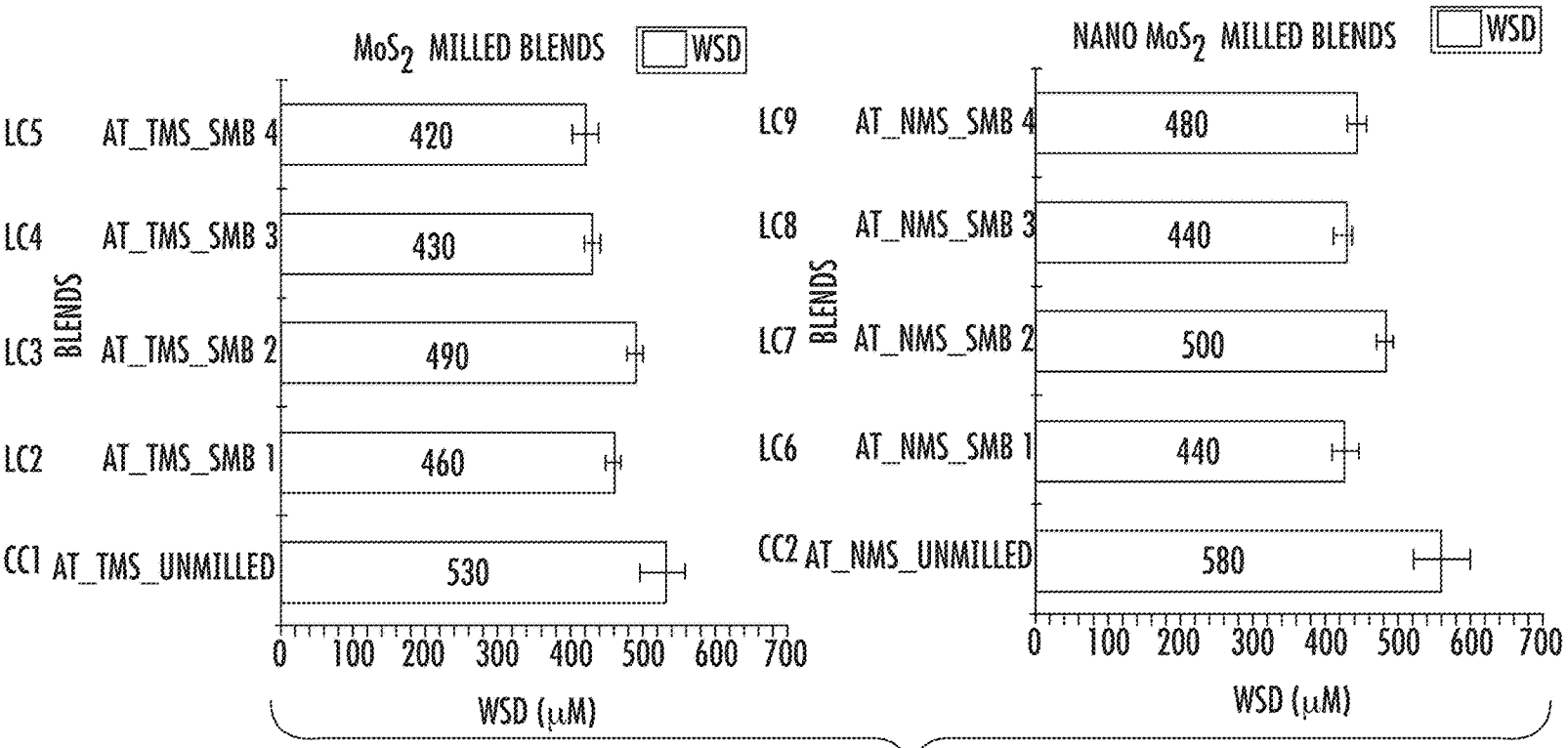
FIG. 14 illustrates WSD on metals lubricated with lubricant compositions according to some embodiments described herein.

FIG. 14 shows the WSD for metals milled with LC2-LC9 and with CC2 and CC6. It is clear that all of LC2-LC5 provided reduced WSD compared to CC2, and that all of LC6-LC9 provided reduced WSD compared to CC6.

Example 3

Lubricant Compositions Comprising PTFE Particles, ZDDP, and MoDTC

A lubricant composition according to one embodiment described herein was prepared as follows. This grease blend is denoted as Lubricant Composition 10 (LC10). A total of 2 weight percent polytetrafluroethylene particles (PTFE), made in-house at UT-Arlington; 3 weight percent zinc dithiophosphate (ZDDP), available from Chevron (Oronite); and 2 weight percent molybdenum dialkylthiocarbamate (MoDTC), specifically, molybdenum dibutylthiocarbamate, available from Vanderbilt Chemicals, was added to a lithium-containing base grease, based on the total weight of the lubricant composition. The base grease used was an NLGI grade 2 grease with the properties described above in Example 1. The lubricant compositions were blended under standard blending conditions.

Images of PTFE and $MoS_2$ particles were obtained using an environmental scanning electron microscope (SEM) (Hitachi S-3000N) at magnification of 50× and 100× for PTFE and at 500× and 1000× for $MoS_2$ under standard SEM conditions. SEM images in FIG. 15 are of (a) Unmilled $MoS_2$ at 500× (b) Unmilled $MoS_2$ at 1000× (c) PTFE at 50× (d) PTFE at 100×.

Another lubricant composition (L11) was prepared identically except that no MoDTC was added. A comparative composition also used in Example 1, denoted as Comparative Composition 1 (CC1) was prepared with 3 weight percent unmilled $MoS_2$ particles (TECHFINE) added to the base grease, based on the total weight of the lubricant composition. No PTFE, ZDDP, or MoDTC was added. These compositions are shown in Table 5.

TABLE 5

| Composition | Base Grease | Additives | Wt % Additive |
|---|---|---|---|
| Lubricant Composition 10 | Lithium 12 hydroxystearate | PTFE<br>ZDDP<br>MoDTC | 2 wt %<br>3 wt %<br>2 wt % |
| Lubricant Composition 11 | Lithium 12 hydroxystearate | PTFE<br>ZDDP | 2 wt %<br>3 wt % |
| Comparative Composition 1 | Lithium 12 hydroxystearate | $MoS_2$ | 3 wt % |

Figure 16A:
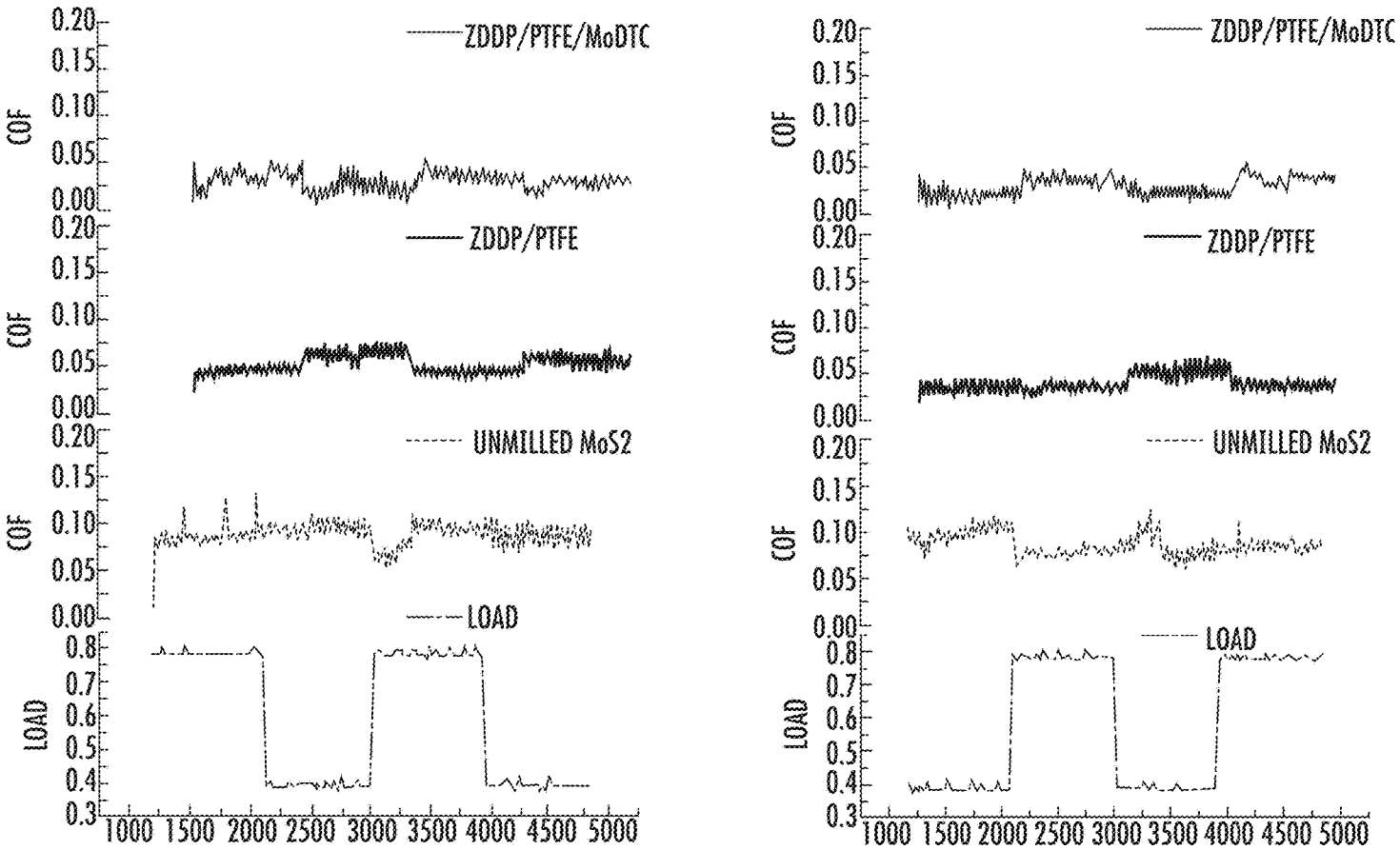
FIGS. 16A and 16B illustrate torque and COF values on metals lubricated with comparative compositions and lubricant compositions according to some embodiments described herein.
Figure 16B:
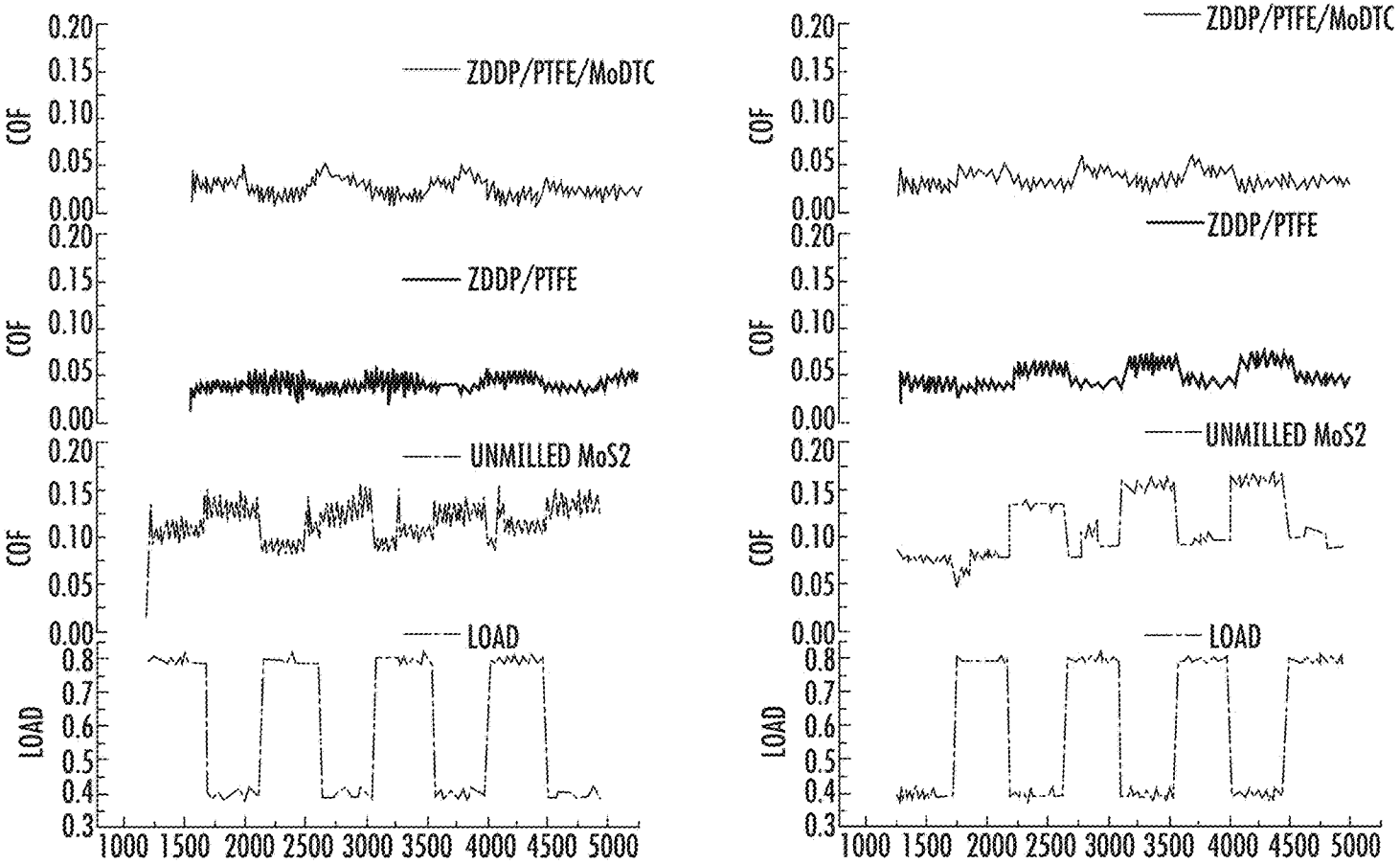

LC10, LC11, and CC1 were tested in a four ball tribometer (Phoenix Tribology TE92) to evaluate the wear and friction performance. Each composition was stirred with a spatula immediately before testing in order to ensure the consistency and to ensure that bleeding did not alter the compositions' performance. Four-ball tribometer wear tests were conducted in a continuous sliding mode under boundary lubrication regime using LC10, LC11, or CC1 as the lubricant. Six different tests that varied load and speed were conducted, as shown in Table 2 above and FIGS. 2A-F, and as described above for the six test conditions. SEM was used to image the wear scars formed on the three stationary steel balls, using standard SEM conditions. LC10 (denoted as ZDDP/PTFE/MoDTC), LC11 (denoted as ZDDP/PTFE), and CC1 (denoted as unmilled $MoS_2$) were tested under cyclic loading ramp-up and ramp-down conditions, according to ASTM D2266. Test temperature was 75±5° C. over 7200 cycles at 1200 rpm. FIG. 16A compares the coefficient of friction (COF) under test conditions 2a and 2b. These tests consist of 4 load steps of 15 minutes, each consisting of 18000 cycles that result in a total of 72000 cycles for the duration of the test. FIG. 16B compares the coefficient of friction under test conditions 2c and 2d, where the step size is 7.5 minutes. In all cases, the COF for LC10 is lower than the COF for LC11, which is in turn lower than the COF for CC1.

Figure 17:
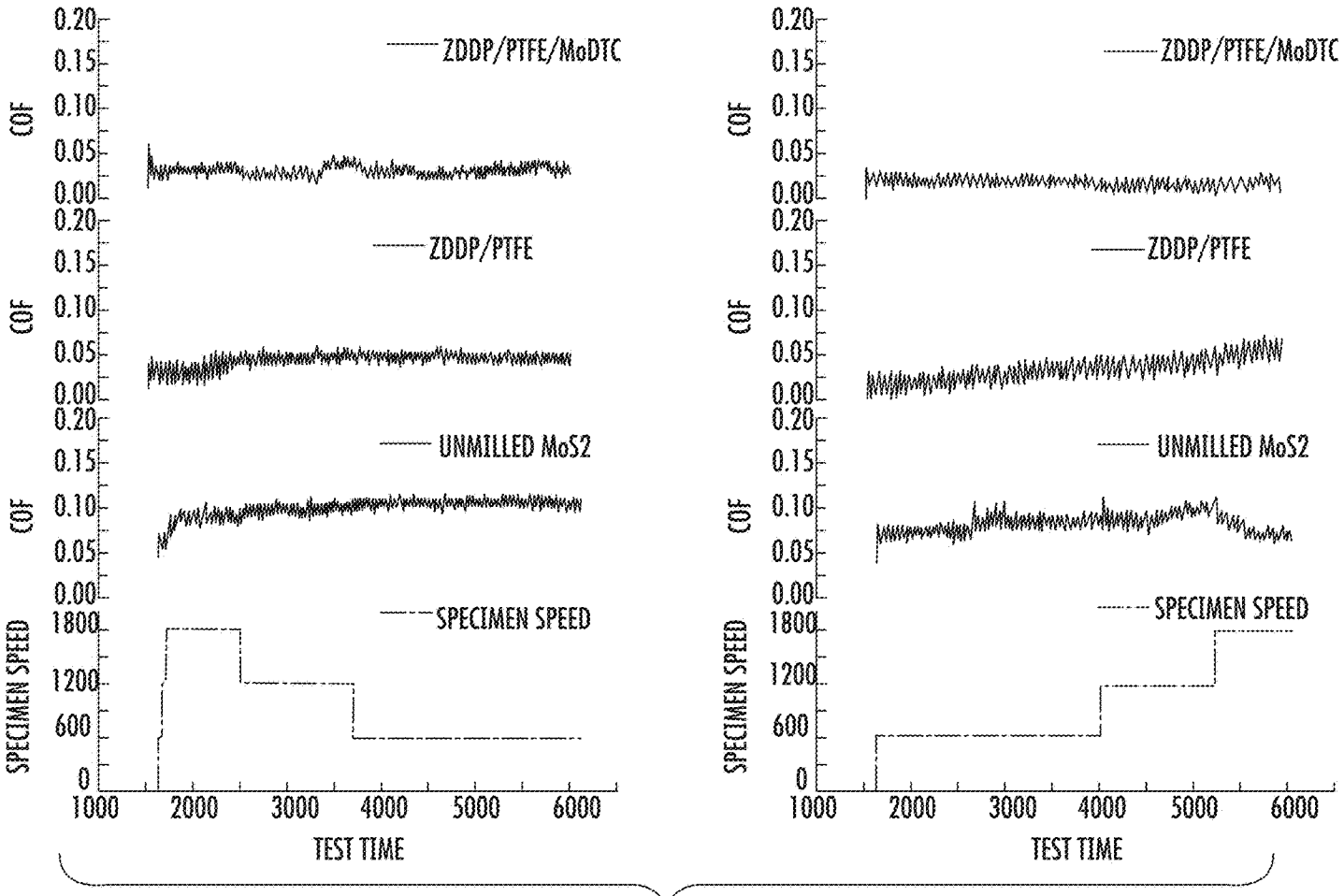
FIG. 17 illustrates torque and COF values on metals lubricated with comparative compositions and lubricant compositions according to some embodiments described herein.

FIG. 17 compares the coefficient of friction under cyclic frequency test conditions 2e and 2f. Test temperature was 75±5° C. over 7200 cycles with constant 40 kg load. Once again, the COF for LC10 is lower than the COF for LC11, which is in turn lower than the COF for CC1.

Figure 18:
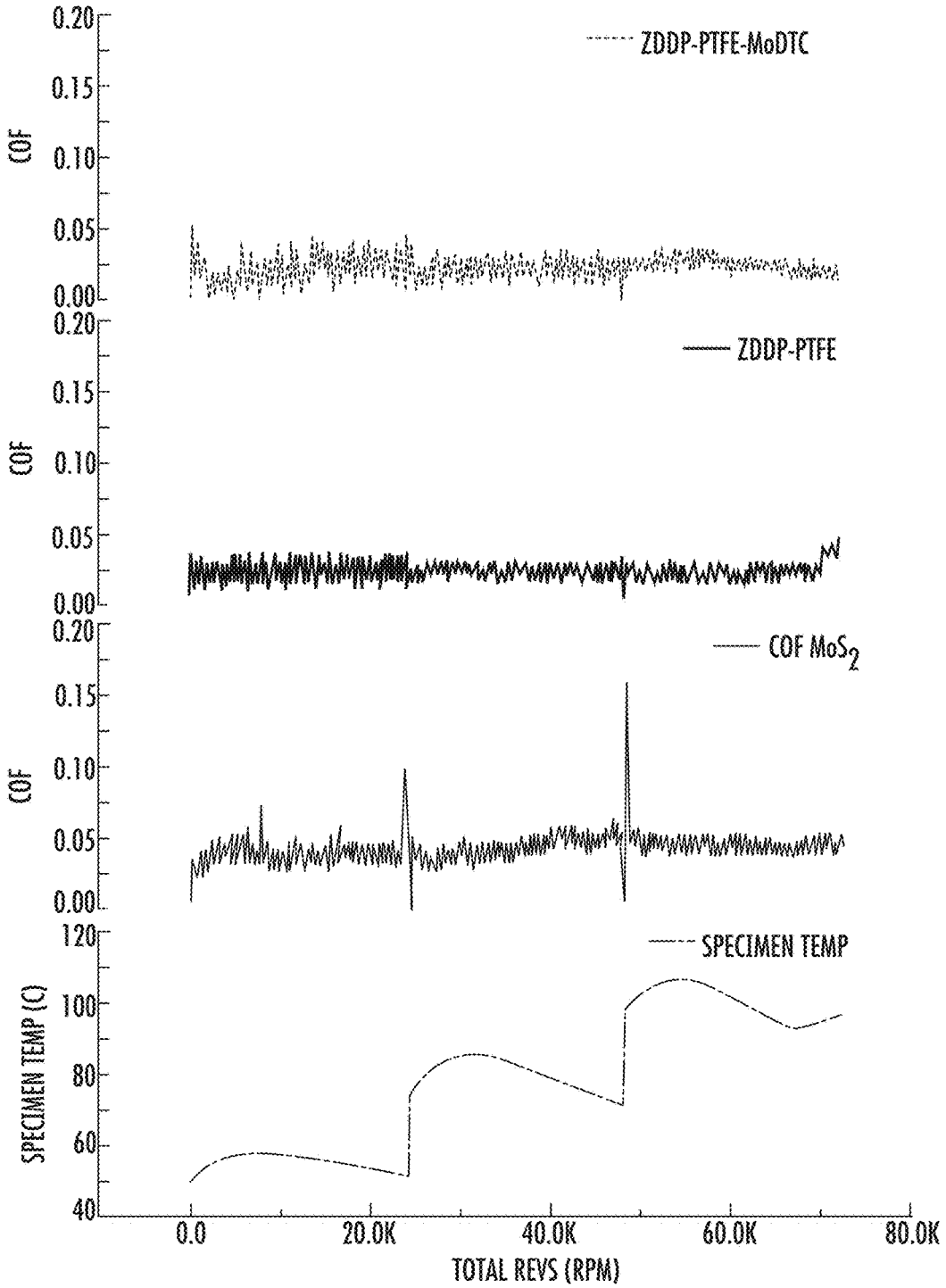
FIG. 18 illustrates torque and COF values on metals lubricated with comparative compositions and lubricant compositions according to some embodiments described herein.

FIG. 18 compares the coefficient of friction under cyclic temperature conditions. Test temperature was in increased from 50±5° to 75±5° to 100±5° C. over 7200 cycles at 1200 rpm with a 40 kg load. Once again, the COF for LC10 is lower than the COF for LC11, which is in turn lower than the COF for CC1.

Figure 19A:
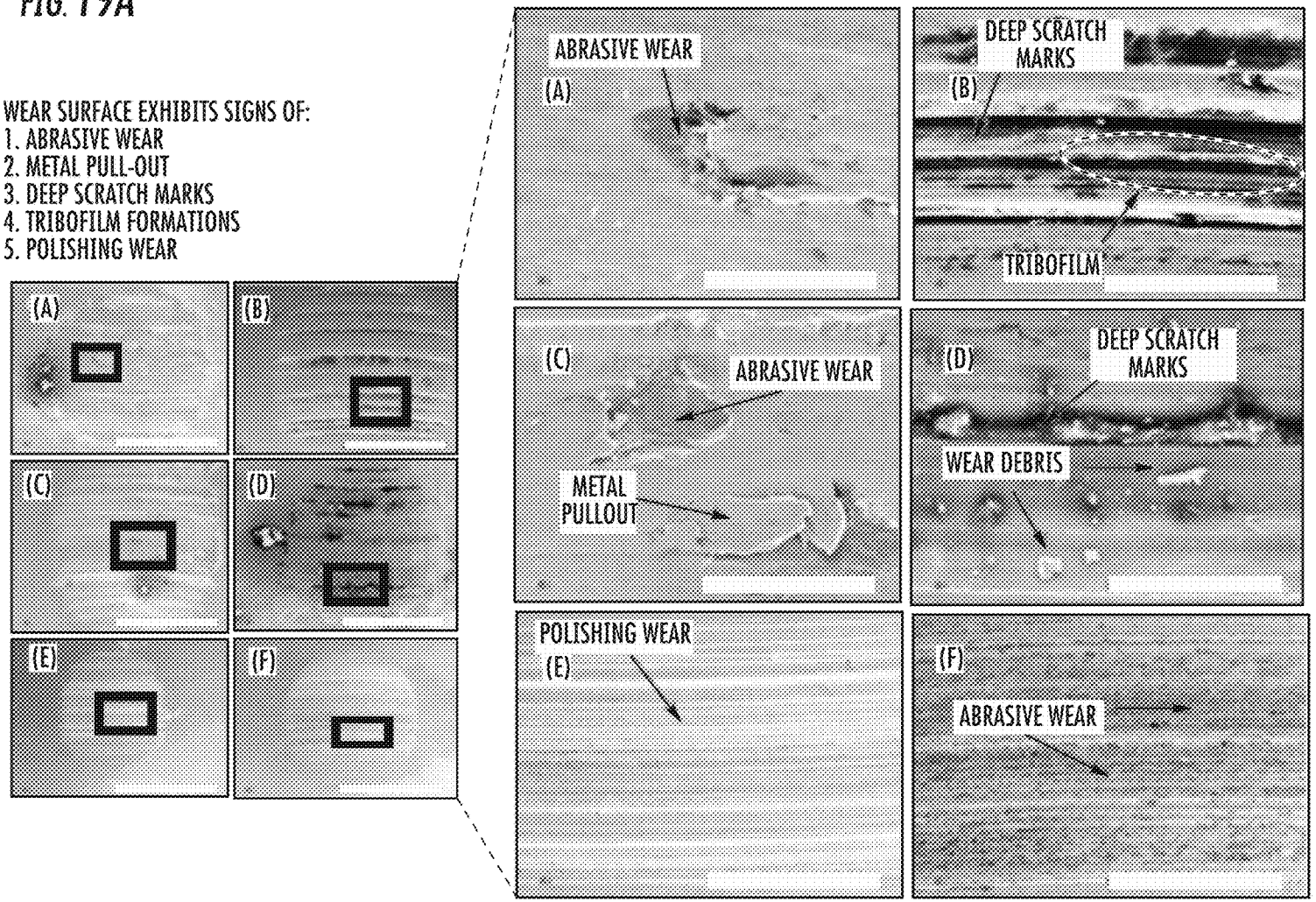
FIGS. 19A-C illustrate SEM images of wear scars on metals lubricated with a comparative composition and lubricant compositions according to according to some embodiments described herein.
Figure 19B:
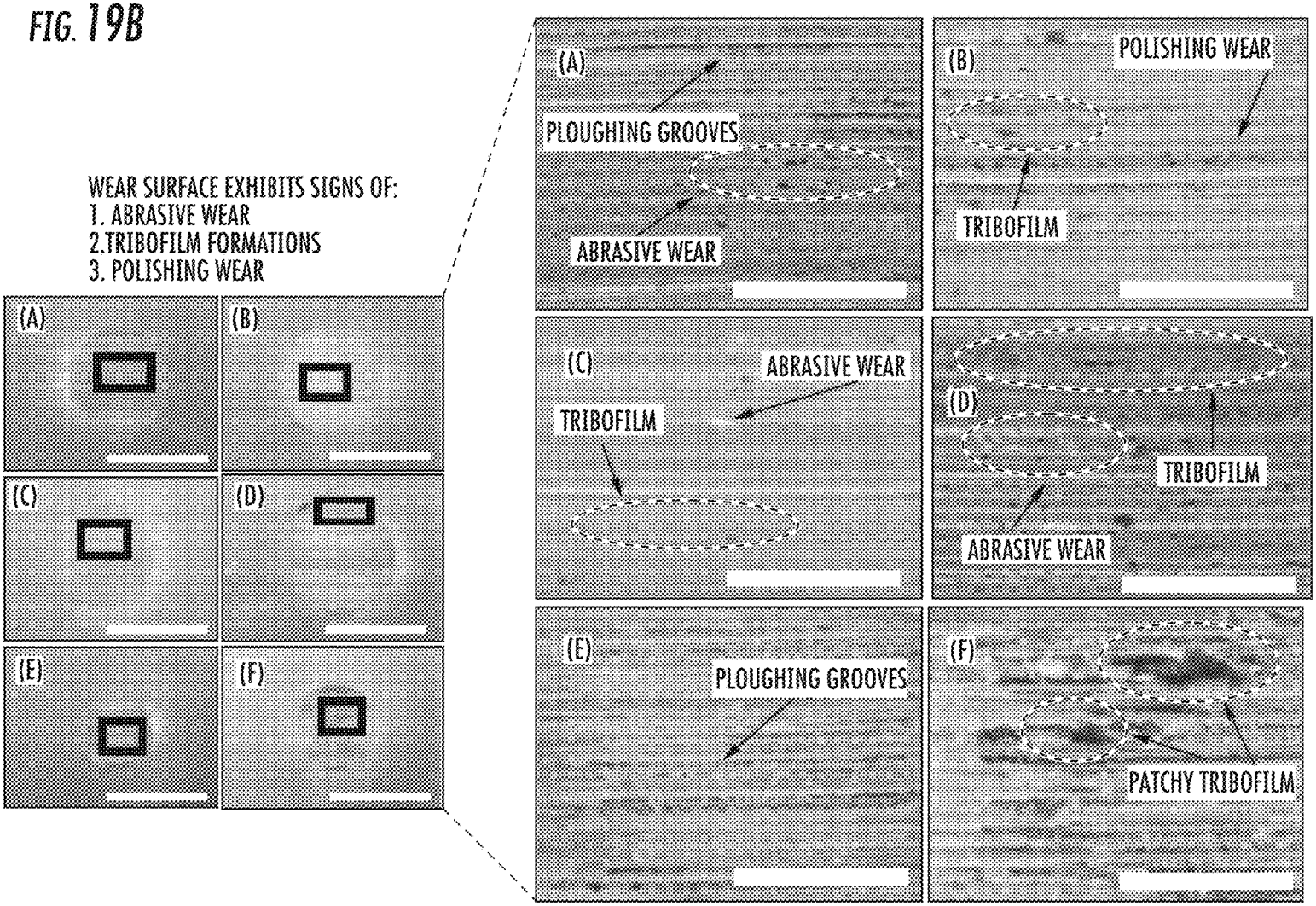
Figure 19C:
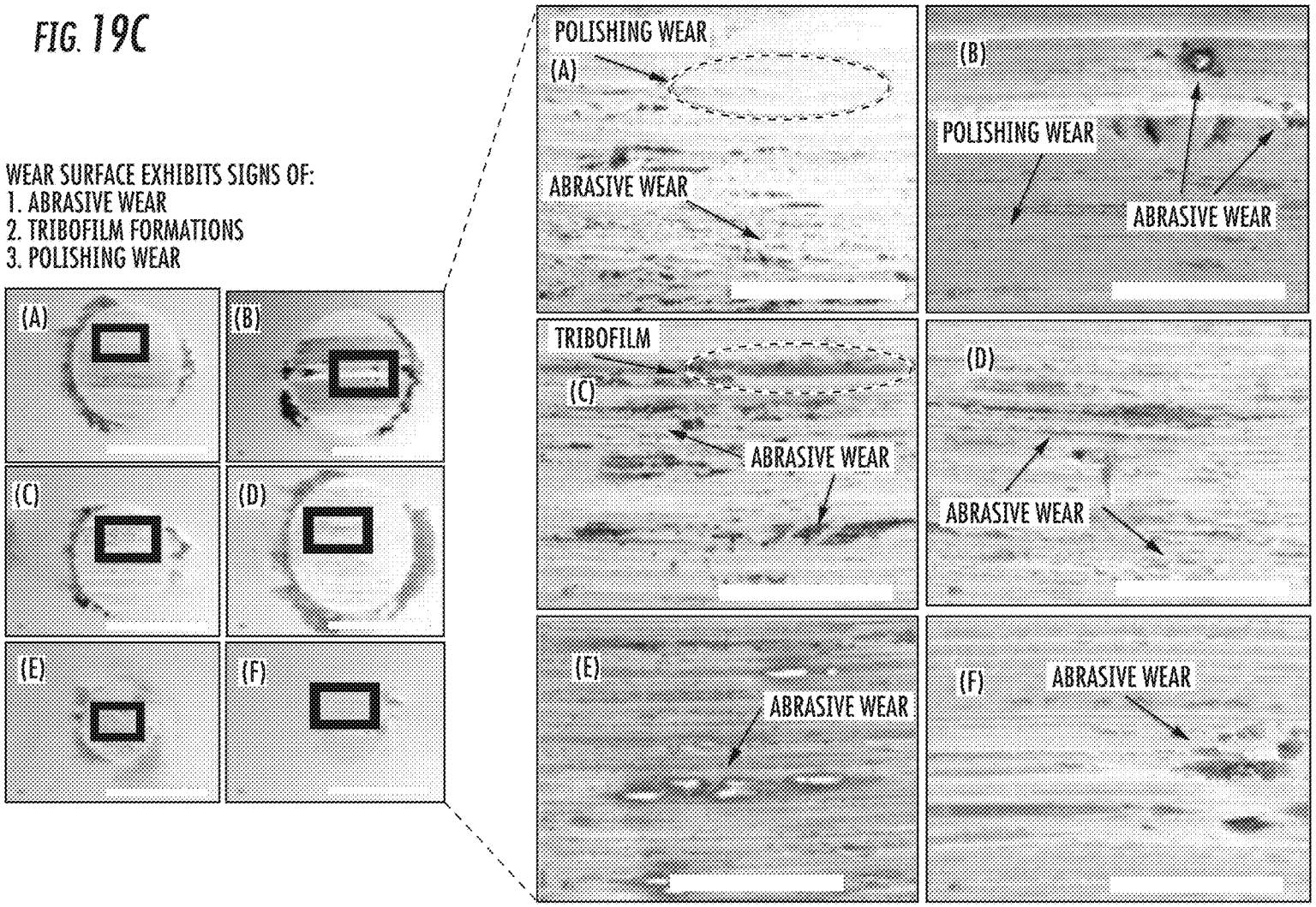

FIGS. 19A-C shows the types of wear present on balls lubricated with CC1, LC10, and LC11, respectively. Balls lubricated LC10 and LC11 do not show metal pull-out or deep scratch marks, whereas balls lubricated with CC1 show these types of wear.

Figure 20A:
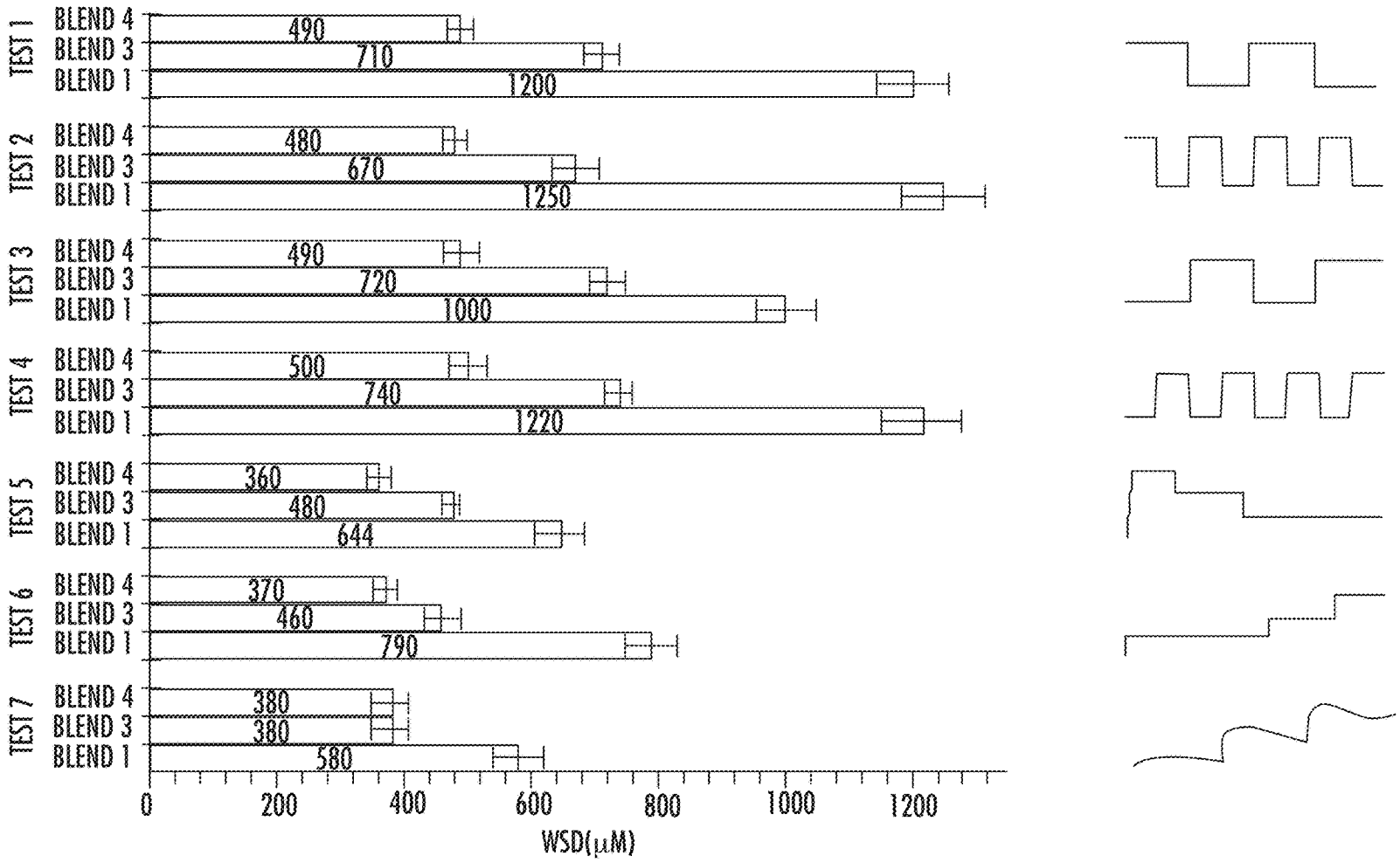
FIGS. 20A and 20B illustrate torque and COF values on metals lubricated with a comparative composition and lubricant compositions according to some embodiments described herein.
Figure 20B:
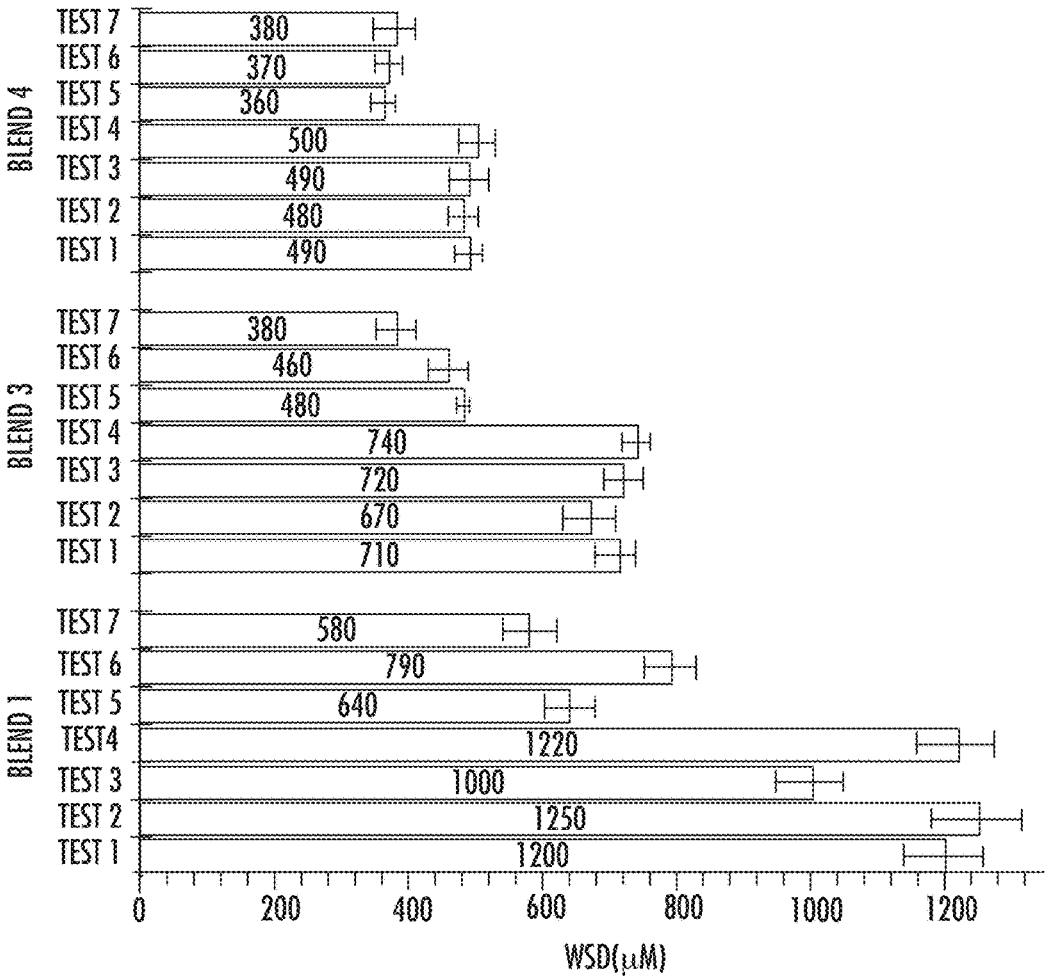

The average wear-scar diameter (WSD) was obtained for all the test balls from the four-ball tribometer tests, and an average values were reported in μm in FIG. 20A for CC1 (denoted as Blend 1), LC10 (denoted as Blend 3), LC11 (denoted as Blend 4). All the values for WSD are reported in μm with the average values inset at the center of each bar. The error bars represent the corresponding variation in the WSD values. Under the variety of test conditions, use of LC10 consistently resulted in less wear than LC11, which in turn resulted in less wear than CC1. FIG. 20B depicts WSD grouped by composition. Use of LC10 consistently resulted in less wear than LC11, which in turn resulted in less wear than CC1.

Example 4

Lubricant Compositions Comprising PTFE Particles, ZDDP, and MoDTC

A lubricant composition according to one embodiment described herein was prepared as follows. This grease blend is denoted as Lubricant Composition 12 (LC12). A total of 3 weight percent polytetrafluroethylene particles (PTFE) and 3 weight percent MOLYVAN® A (molybdenum dibutylthiocarbamate (MoDTC), available from R.T. VANDERBILT) was added to a lithium-containing base grease, based on the total weight of the lubricant composition. The base grease used was MOBIL 33, which contains ZDDP as an anti-wear additive, and that has a dropping point of 188° C., has a lithium 12-hydroxystearate thickener, and has a base oil having a kinematic viscosity of 220 centistokes at 40° C. The lubricant composition was blended under standard blending conditions.

Another lubricant composition (LC13) was prepared identically to LC12, except that the MOLYVAN A was added in 2 weight percent, based on the total weight of the lubricant composition, and MOLYVAN L (molybdenum dialkylphosphorodithioate) was added in 1.5 weight percent based on the total weight of the lubricant composition. Another lubricant composition (LC14) was prepared identically to LC4, except that the MOLYVAN L was replaced with glycerol monooleate (GMO), available from Afton Chemicals as HITEC 7133 that was added in 1.5 weight percent based on the total weight of the lubricant composition. Still another lubricant composition (LC15) was prepared identically to LC3, except that ZDDP that was added in 3 weight percent based on the total weight of the lubricant composition. A comparative composition denoted as Comparative Composition 3 (CC3) consisted of MOBIL 33 base grease with no additional additives. These compositions are shown in Table 6.

TABLE 6

| Composition | Base Grease | Additives | Wt % Additives |
|---|---|---|---|
| Lubricant Composition 12 | MOBIL 33 | PTFE | 3 wt % |
| | | MOLYVAN A | 3 wt % |
| Lubricant Composition 13 | MOBIL 33 | PTFE | 3 wt % |
| | | MOLYVAN A | 2 wt % |
| | | MOLYVAN L | 1.5 wt % |
| Lubricant Composition 14 | MOBIL 33 | PTFE | 3 wt % |
| | | MOLYVAN A | 2 wt % |
| | | GMO | 1.5 wt % |
| Lubricant Composition 15 | MOBIL 33 | PTFE | 3 wt % |
| | | MOLYVAN A | 3 wt % |
| | | ZDDP | 3 wt % |
| Comparative Composition 3 | MOBIL 33 | — | — |

Figure 21A:
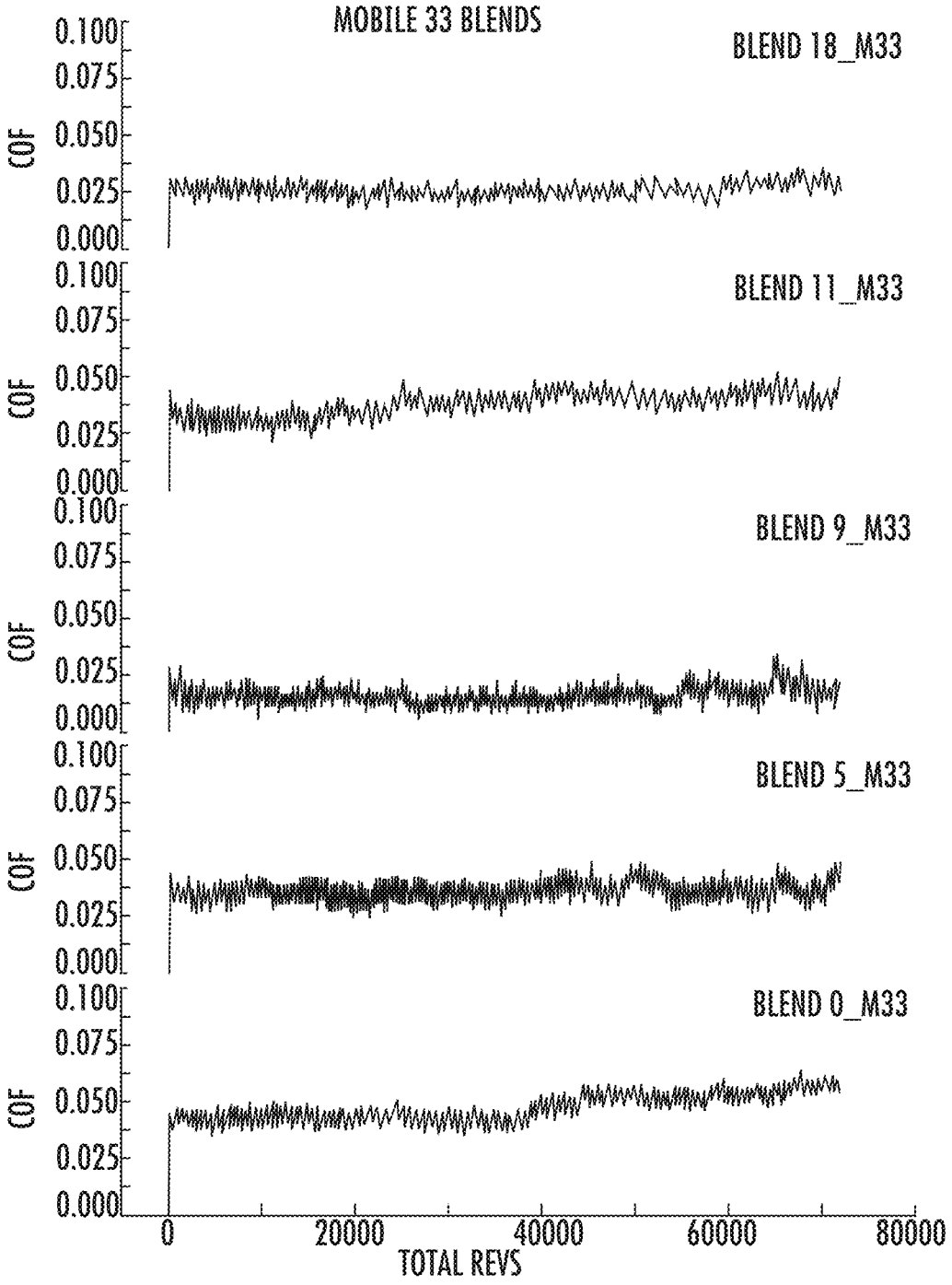
FIGS. 21A and 21B illustrate torque and COF values on metals lubricated with a comparative composition and lubricant compositions according to some embodiments described herein.
Figure 21B:
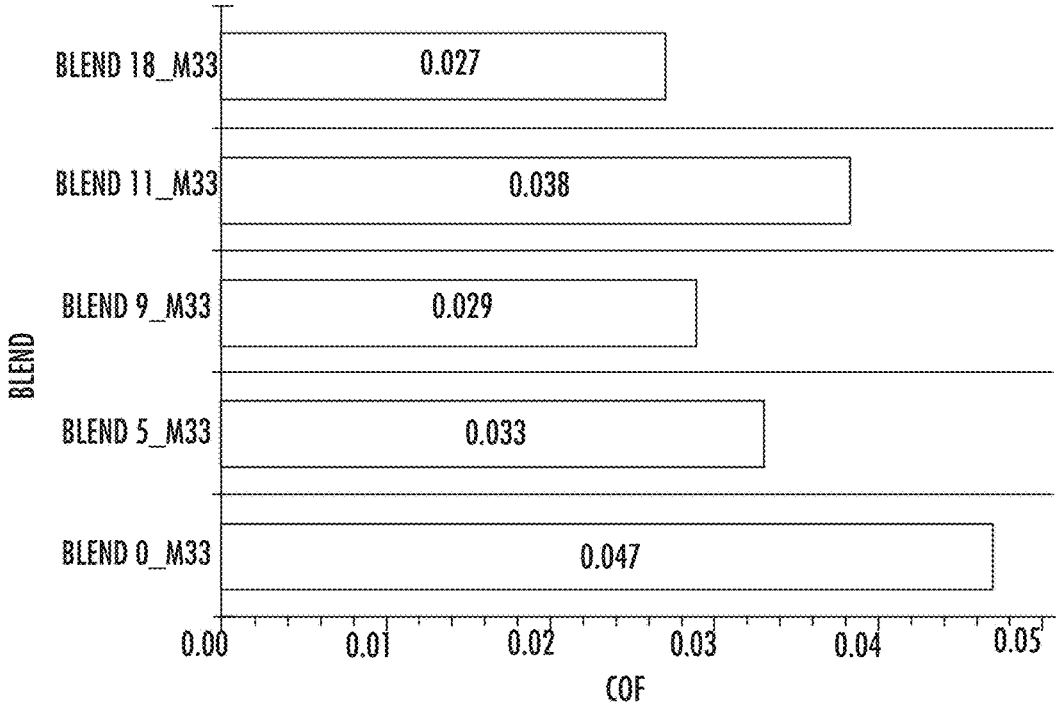
Figure 21C:
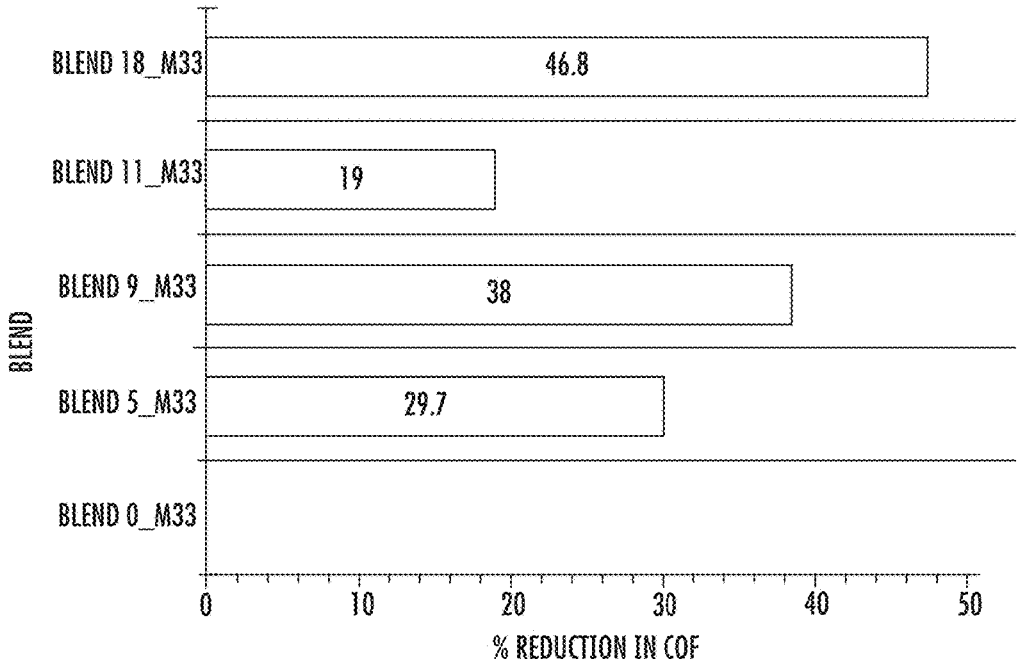
FIG. 21C illustrates percent reduction in WSD on metals lubricated with lubricant compositions according to some embodiments described herein compared to a comparative composition.
Figure 22A:
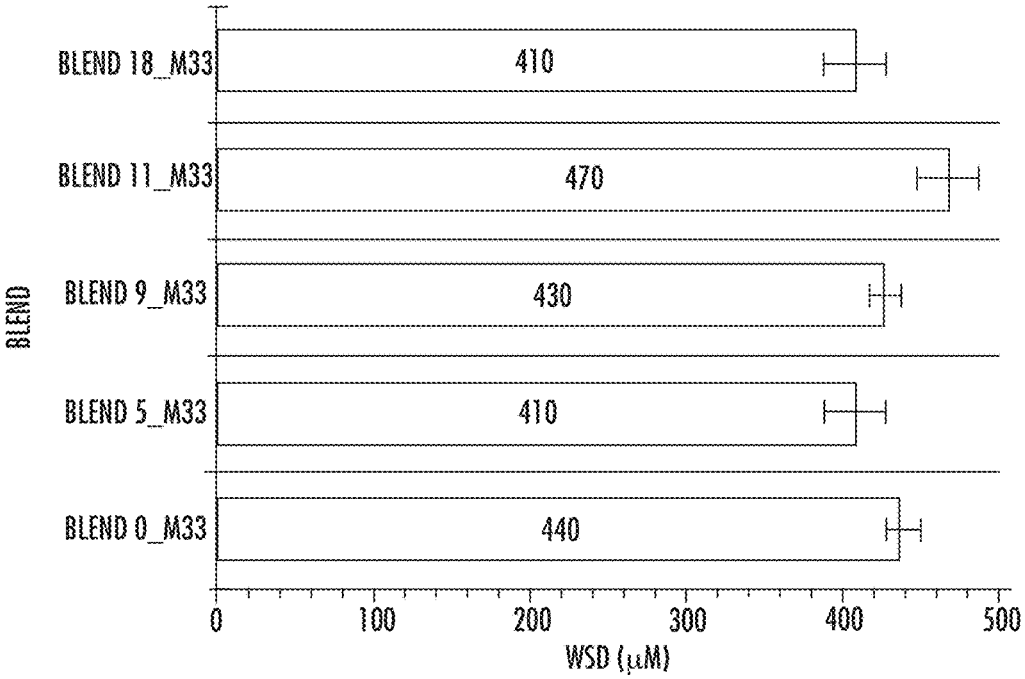
FIGS. 22A and 22B illustrate WSD and percent change in WSD on metals lubricated with lubricant compositions according to some embodiments described herein compared to a comparative composition.
Figure 22B:
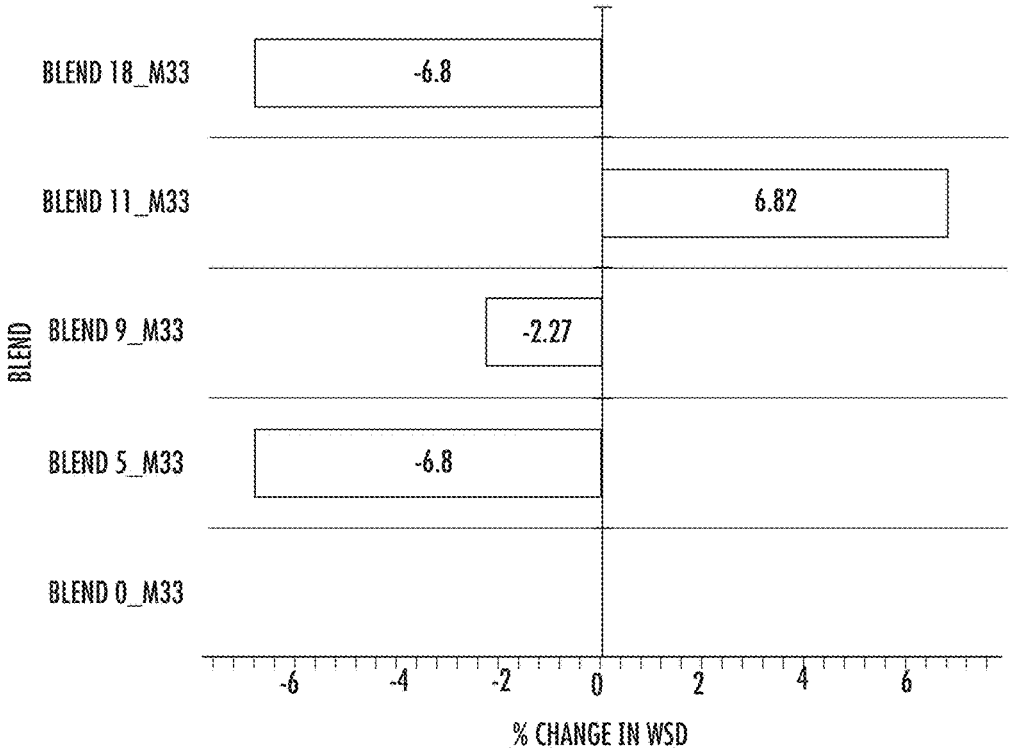

LC12-LC15 and CC3 were tested in a four ball tribometer (Phoenix Tribology TE92) to evaluate the wear and friction performance. Each composition was stirred with a spatula immediately before testing in order to ensure the consistency and to ensure that bleeding did not alter the compositions' performance. Four-ball tribometer wear tests were conducted in a continuous sliding mode under boundary lubrication regime using LC12-LC15 or CC3 as the lubricant. COF results for test under constant 40 kg load, where temperature was 75±5° C. over 7200 cycles, are shown in FIG. 21A. LC12 is denoted as Blend 5, LC13 is denoted as Blend 9, LC14 is denoted as Blend 11, LC15 is denoted as Blend 18, and CC3 is denoted as Blend 0. FIG. 21B shows the COF for each of LC12-LC15 and CC3. All of the blends LC12-LC15 with additives show reduced friction compared to CC3, with LC15 giving the most reduction in friction. Percent reduction in COF for LC12-LC15 compared to CC3 is depicted in FIG. 21C. FIG. 22A shows the WSD for LC12-LC15 and CC3. FIG. 22B shows the percent change in WSD for each of LC12-LC15 compared CC3. LC15 gives the most reduction in WSD.

Another series of lubricant compositions (LC16 to LC19) were prepared identically to LC12-LC15 except that the base grease used was AEROSHELL 33, which contains ZDDP as an anti-wear additive, and that has a dropping point of 188° C., has a lithium 12-hydroxystearate thickener, and has a base oil having a kinematic viscosity of 220 centistokes at 40° C. The lubricant compositions were blended under standard blending conditions. A comparative composition denoted as Comparative Composition 4 (CC4) consisted of AEROSHELL 33 base grease with no additional additives. These compositions are shown in Table 7.

TABLE 7

| Composition | Base Grease | Additives | Wt % Additives |
|---|---|---|---|
| Lubricant Composition 16 | AEROSHELL 33 | PTFE | 3 wt % |
| | | MOLYVAN A | 3 wt % |
| Lubricant Composition 17 | AEROSHELL 33 | PTFE | 3 wt % |
| | | MOLYVAN A | 2 wt % |
| | | MOLYVAN L | 1.5 wt % |
| Lubricant Composition 18 | AEROSHELL 33 | PTFE | 3 wt % |
| | | MOLYVAN A | 2 wt % |
| | | GMO | 1.5 wt % |
| Lubricant Composition 19 | AEROSHELL33 | PTFE | 3 wt % |
| | | MOLYVAN A | 3 wt % |
| | | ZDDP | 3 wt % |
| Comparative Composition 4 | AEROSHELL 33 | — | — |

Figure 23A:
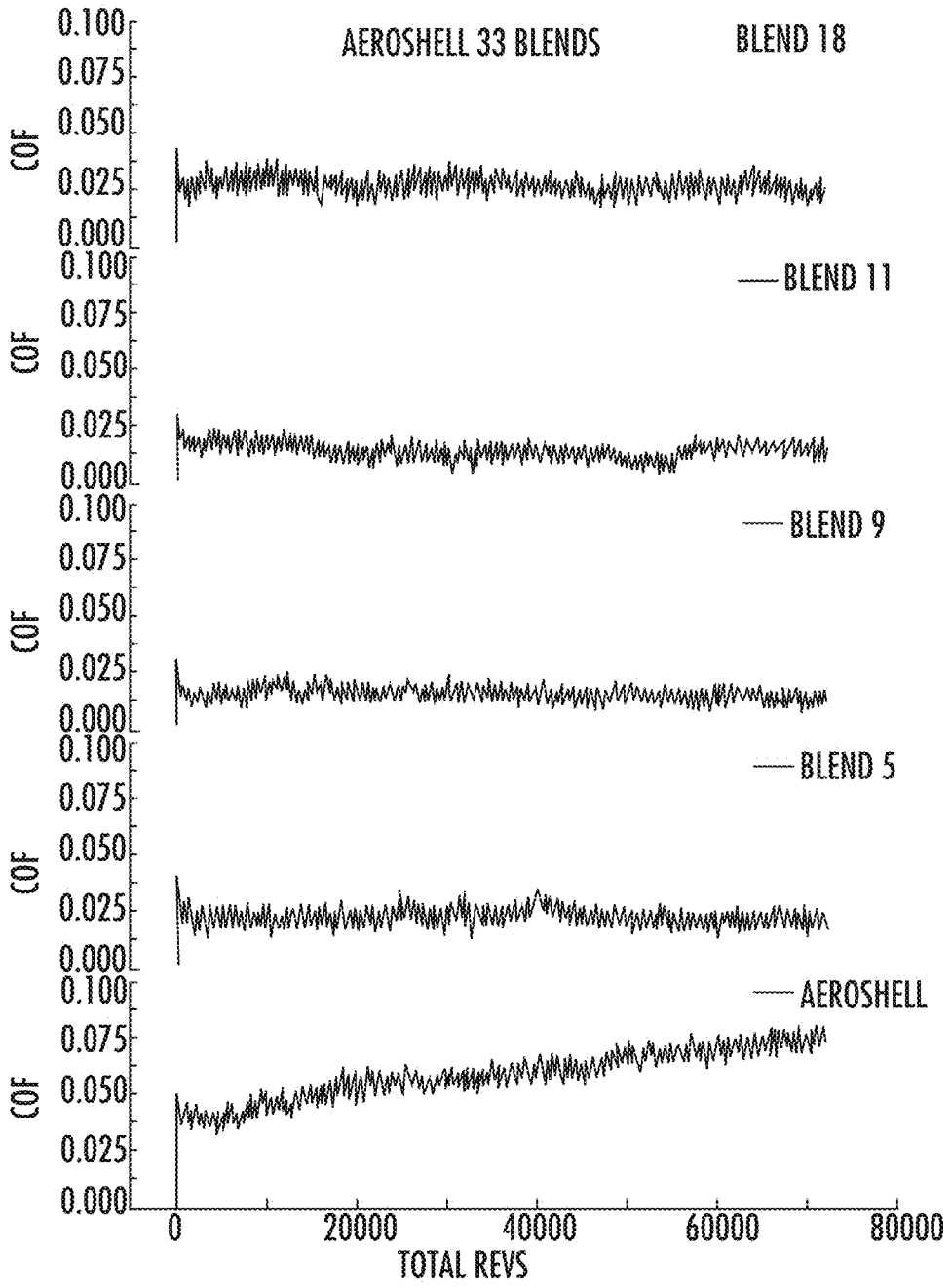
FIGS. 23A-C illustrate torque and COF values on metals lubricated with a comparative composition and lubricant compositions according to some embodiments described herein.
Figure 23B:
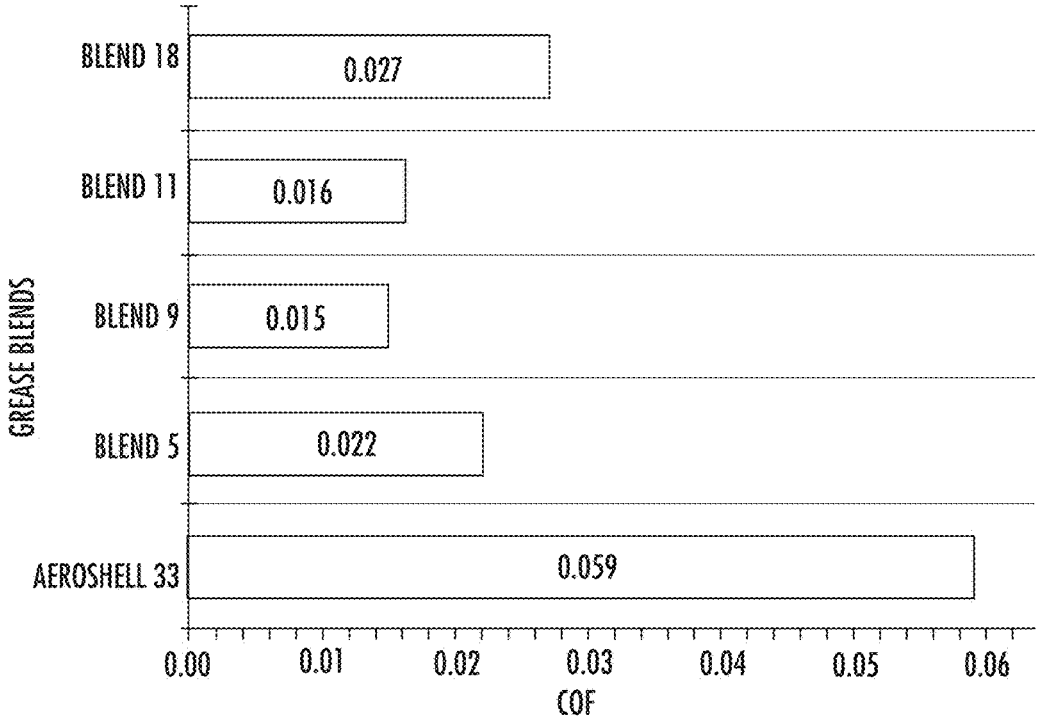
Figure 23C:
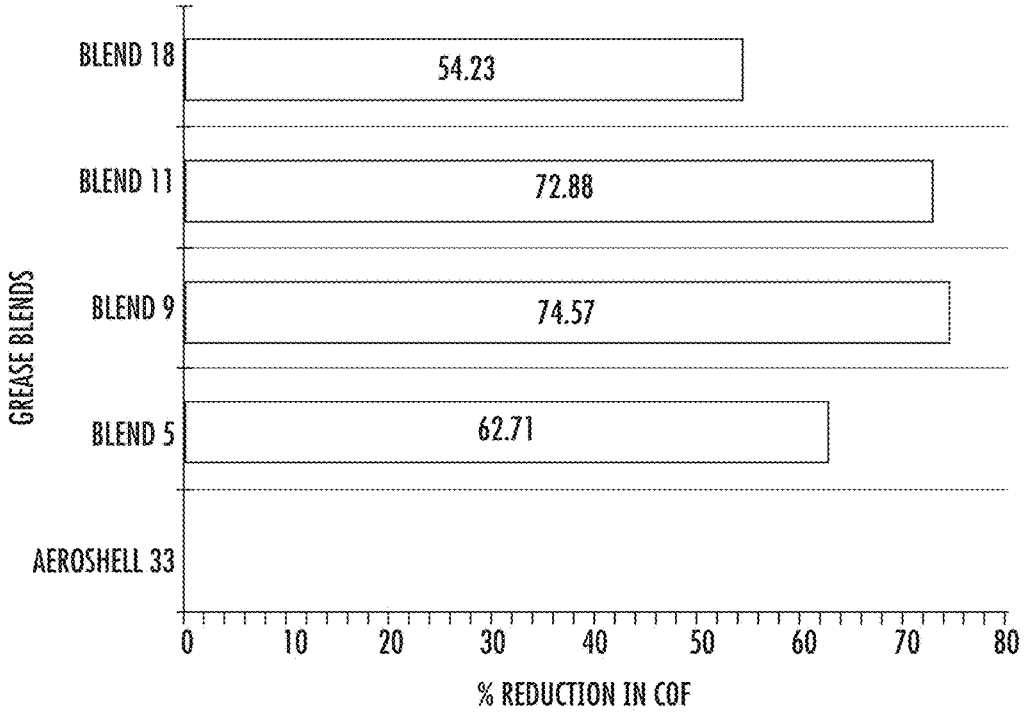
Figure 24A:
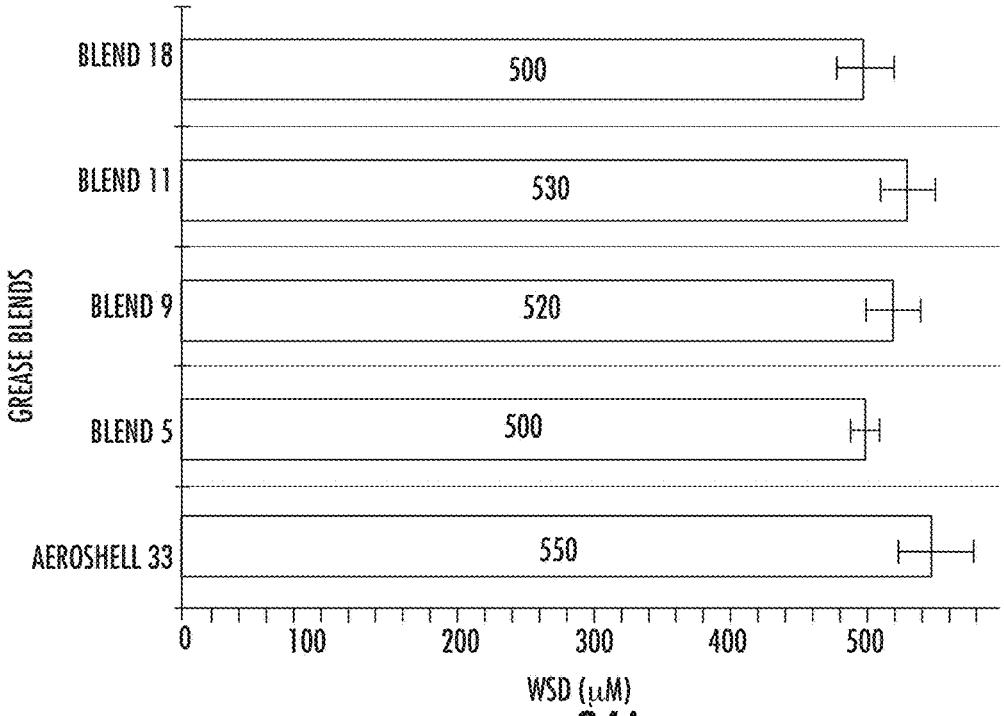
FIGS. 24A and 24B illustrate WSD and percent change in WSD on metals lubricated with lubricant compositions according to some embodiments described herein compared to a comparative composition.
Figure 24B:
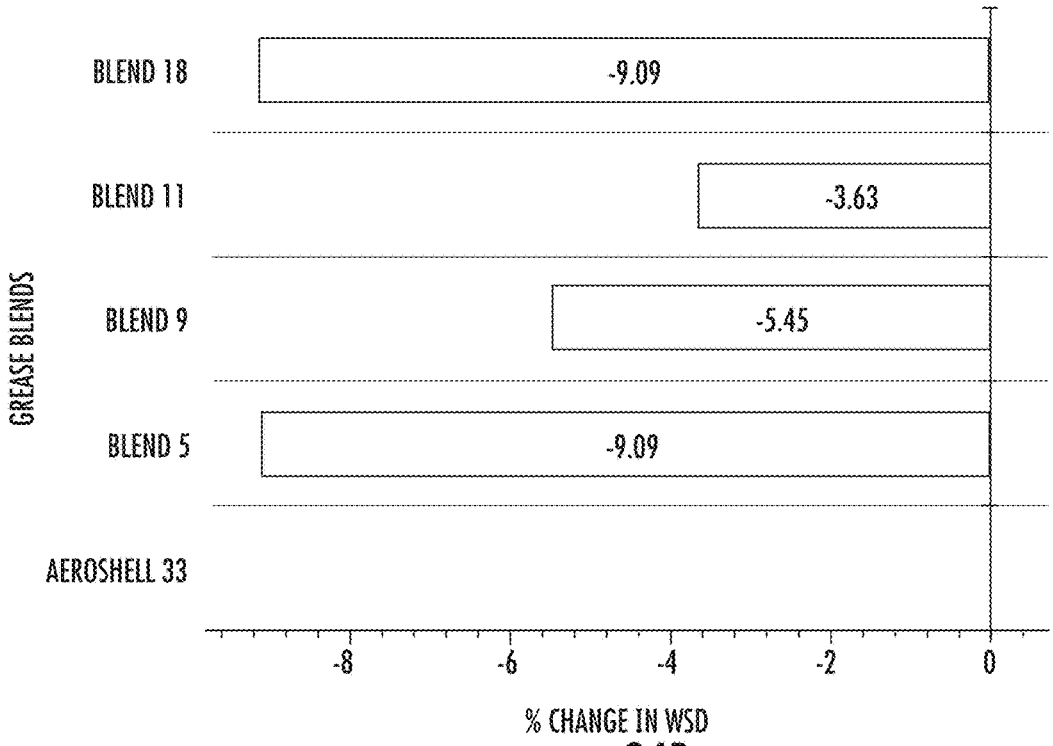

LC16-LC19 and CC4 were tested in a four ball tribometer (Phoenix Tribology TE92) to evaluate the wear and friction performance. Each composition was stirred with a spatula immediately before testing in order to ensure the consistency and to ensure that bleeding did not alter the compositions' performance. Four-ball tribometer wear tests were conducted in a continuous sliding mode under boundary lubrication regime using LC16-LC19 or CC4 as the lubricant. COF results for test under constant 40 kg load, where temperature was 75±5° C. over 7200 cycles, are shown in FIG. 23A. LC16 is denoted as Blend 5, LC17 is denoted as Blend 9, LC18 is denoted as Blend 11, LC19 is denoted as Blend 18, and CC4 is denoted as Blend 0. FIG. 23B shows the COF for each of LC16-LC19 and CC4. All of the blends LC16-LC10 with additives show significantly reduced friction compared to CC4. Percent reduction in COF for LCs versus CC4 is depicted in FIG. 23C. FIG. 24A shows the WSD for LC16-LC19 and CC4. FIG. 24B shows the percent change in WSD for each of LC16-LC19 compared to CC5. LC16 and LC19 give the most reduction in WSD.

Example 5

Lubricant Compositions Comprising PTFE Particles, ZDDP, and MoDTC

Additional lubricant compositions according to embodiments described herein were prepared as follows in order to assess the effect of base grease. These grease blends are denoted as Lubricant Composition 20 and Lubricant Composition 21 (LC20 and LC21). A total of 3 weight percent polytetrafluroethylene particles (PTFE) and 3 weight percent MOLYVAN® A (molybdenum dibutylthiocarbamate (MoDTC)) was added to a lithium-containing base grease, based on the total weight of the lubricant composition, and blended under standard blending conditions. The base grease for LC20 was TEXACO MARFAK multipurpose grease without antiwear additives, and the base grease for LC21 was LUBRICATION ENGINEERS LE 4622 grease without antiwear additives.

Figure 25A:
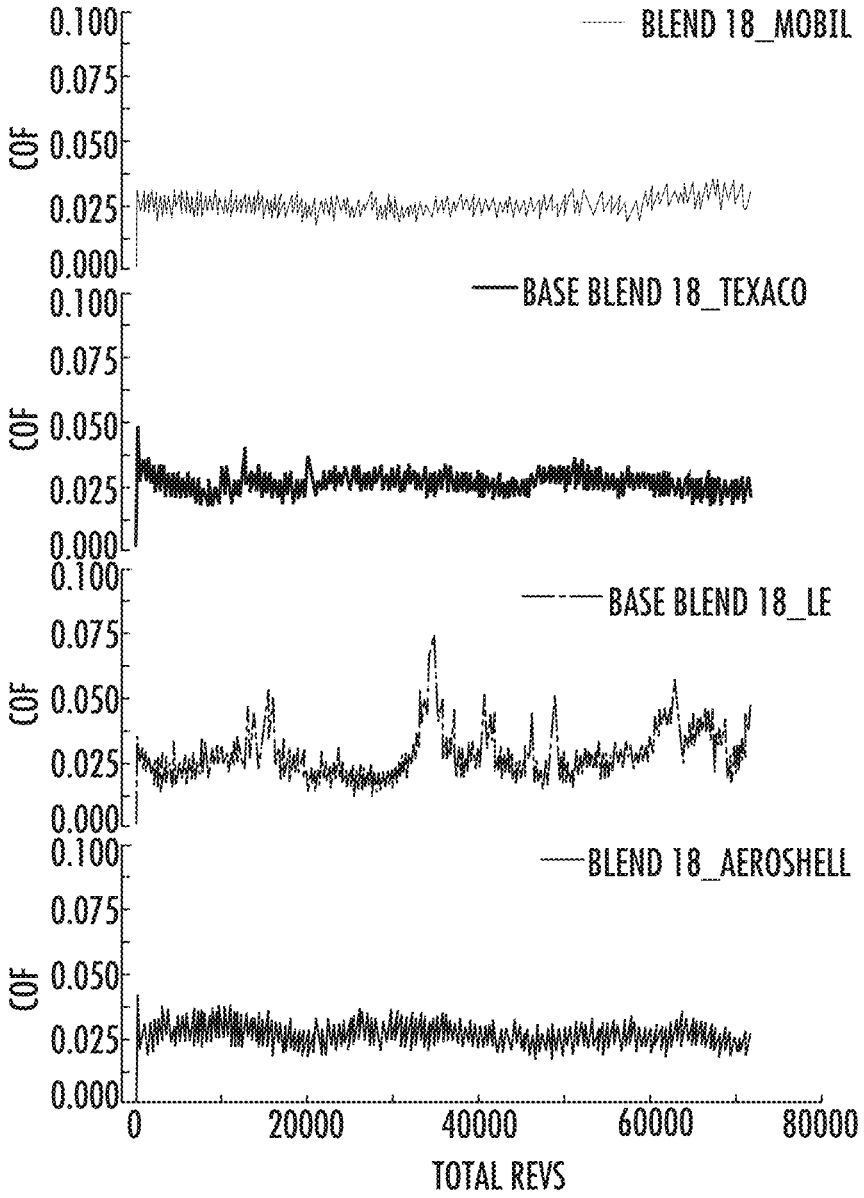
FIGS. 25A and 25B illustrate torque and COF values on metals lubricated with lubricant compositions according to some embodiments described herein.
Figure 25B:
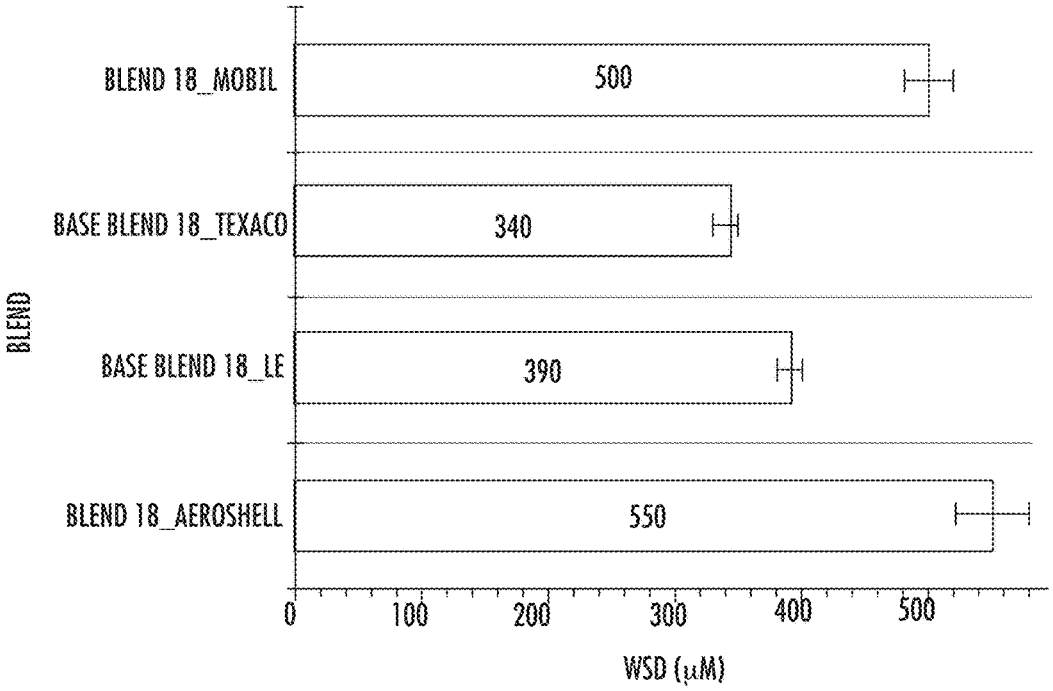
Figure 26A:
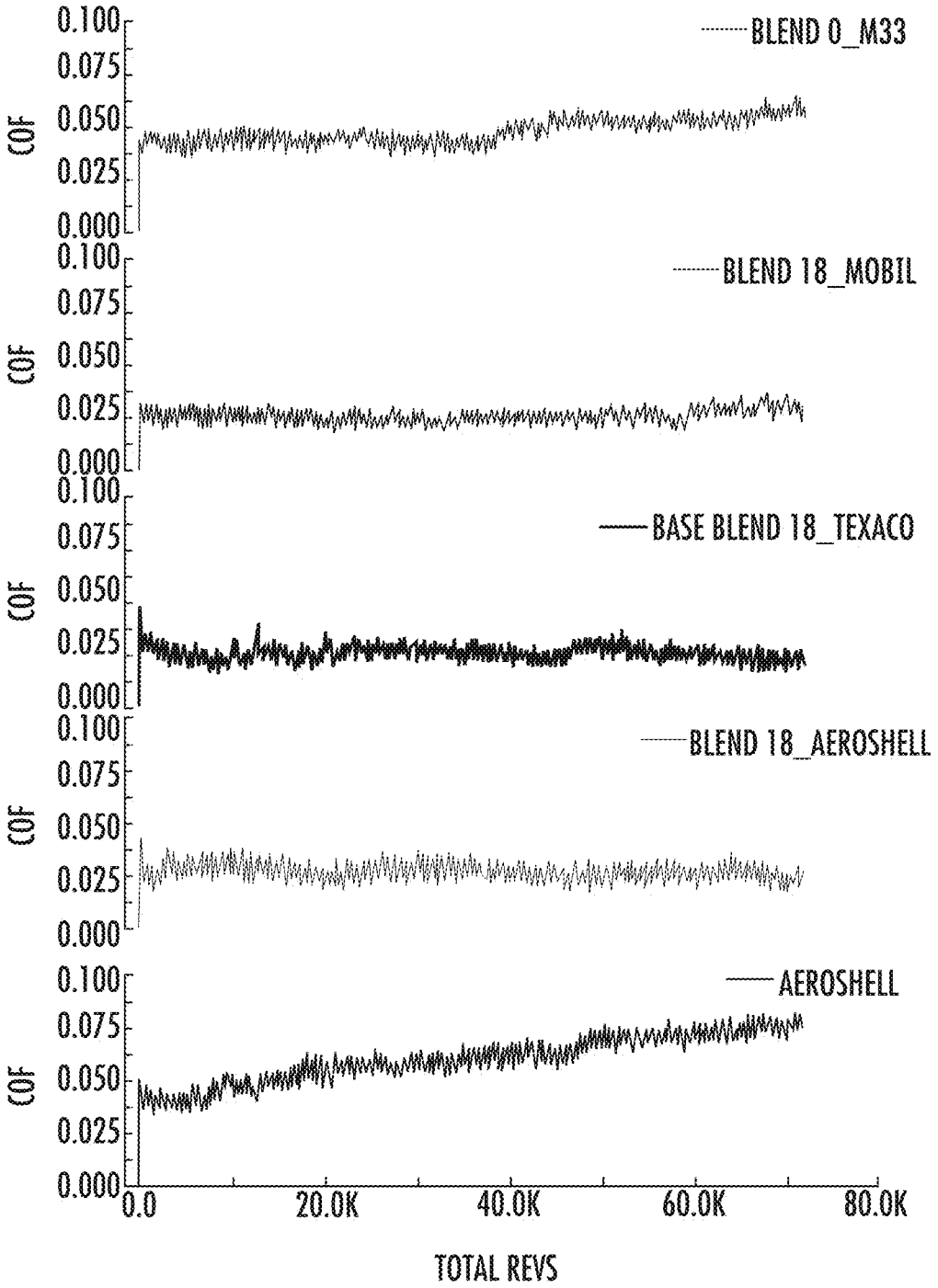
FIG. 26A illustrates torque and COF values on metals lubricated with a comparative composition and lubricant compositions according to some embodiments described herein.
Figure 26B:
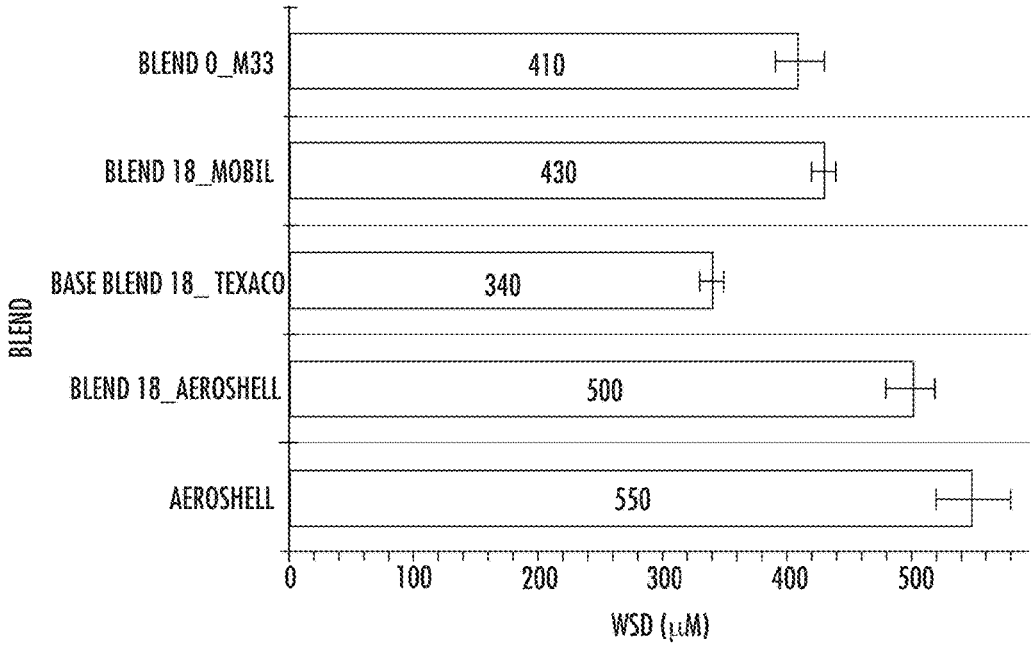
FIG. 26B illustrates WSD on metals lubricated with a comparative composition and lubricant compositions according to some embodiments described herein.

LC15 and LC19-21 were tested in a four ball tribometer (Phoenix Tribology TE92) to evaluate the wear and friction performance. Each composition was stirred with a spatula immediately before testing in order to ensure the consistency and to ensure that bleeding did not alter the compositions' performance. Four-ball tribometer wear tests were conducted in a continuous sliding mode under boundary lubrication regime using LC15 and LC19-21. COF results for test under constant 40 kg load, where temperature was 75±5° C. over 7200 cycles, are shown in FIG. 25A. LC15 is denoted as Blend 18 MOBIL, LC19 is denoted as Blend 18 AEROSHELL, LC20 is denoted as Base Blend 18 TEXACO, and LC21 is denoted as Base Blend 18 LE. FIG. 25B shows the WSD for each of LC15 and LC19-21. LC20 results in the lowest WSD. FIG. 26A shows the COF for of LC15 and LC19-20, CC3 (denoted as Blend 0 M33) and CC4 (denoted as AEROSHELL). FIG. 26B shows the percent change in WSD for compositions of FIG. 26A.

Figure 27A:
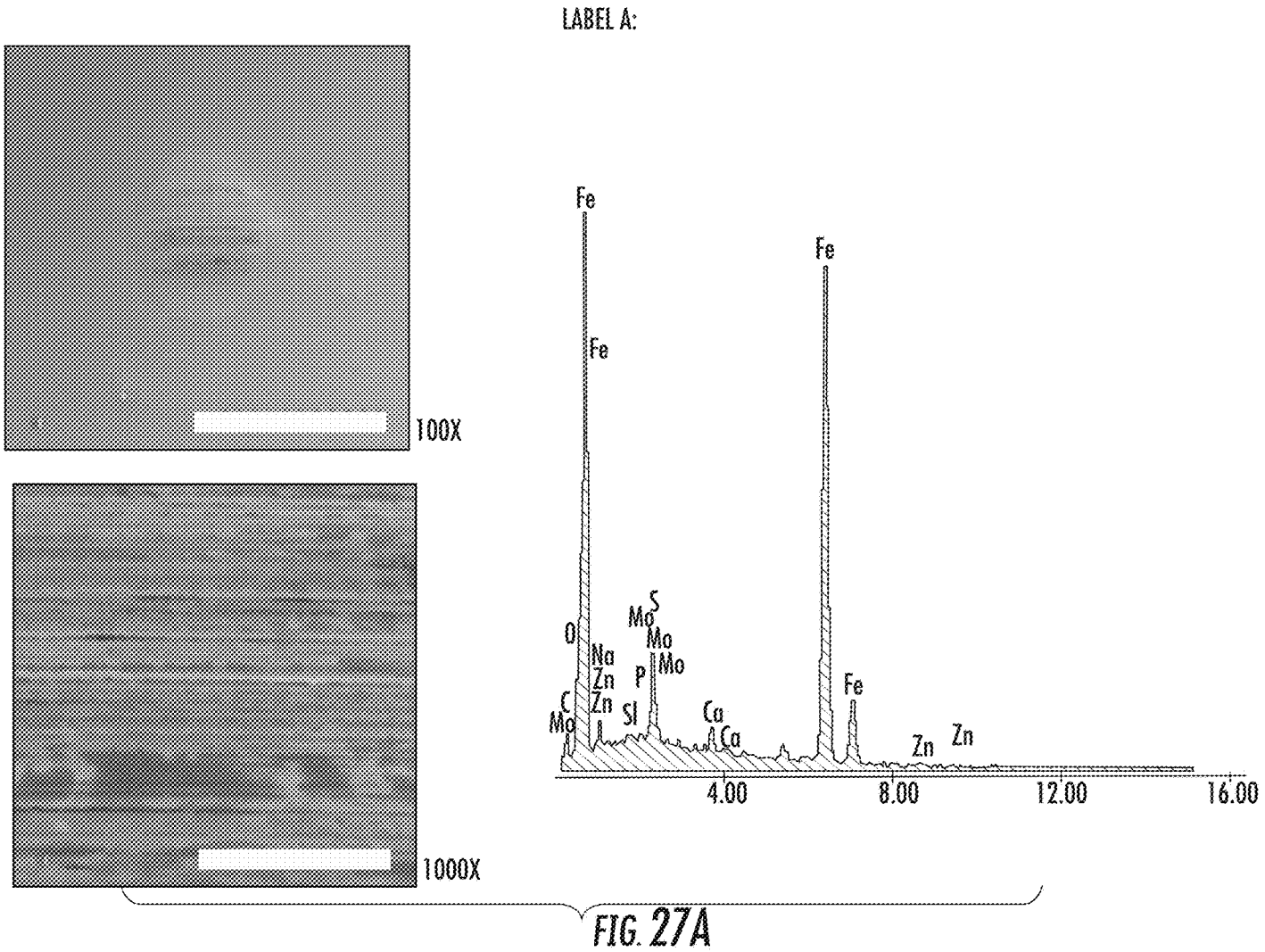
FIGS. 27A-30B illustrate Energy Dispersive Spectroscopy (EDS) elemental maps and spectra from the wear surface of a metal lubricated with a lubricant composition according to one embodiment described herein.
Figure 27B:
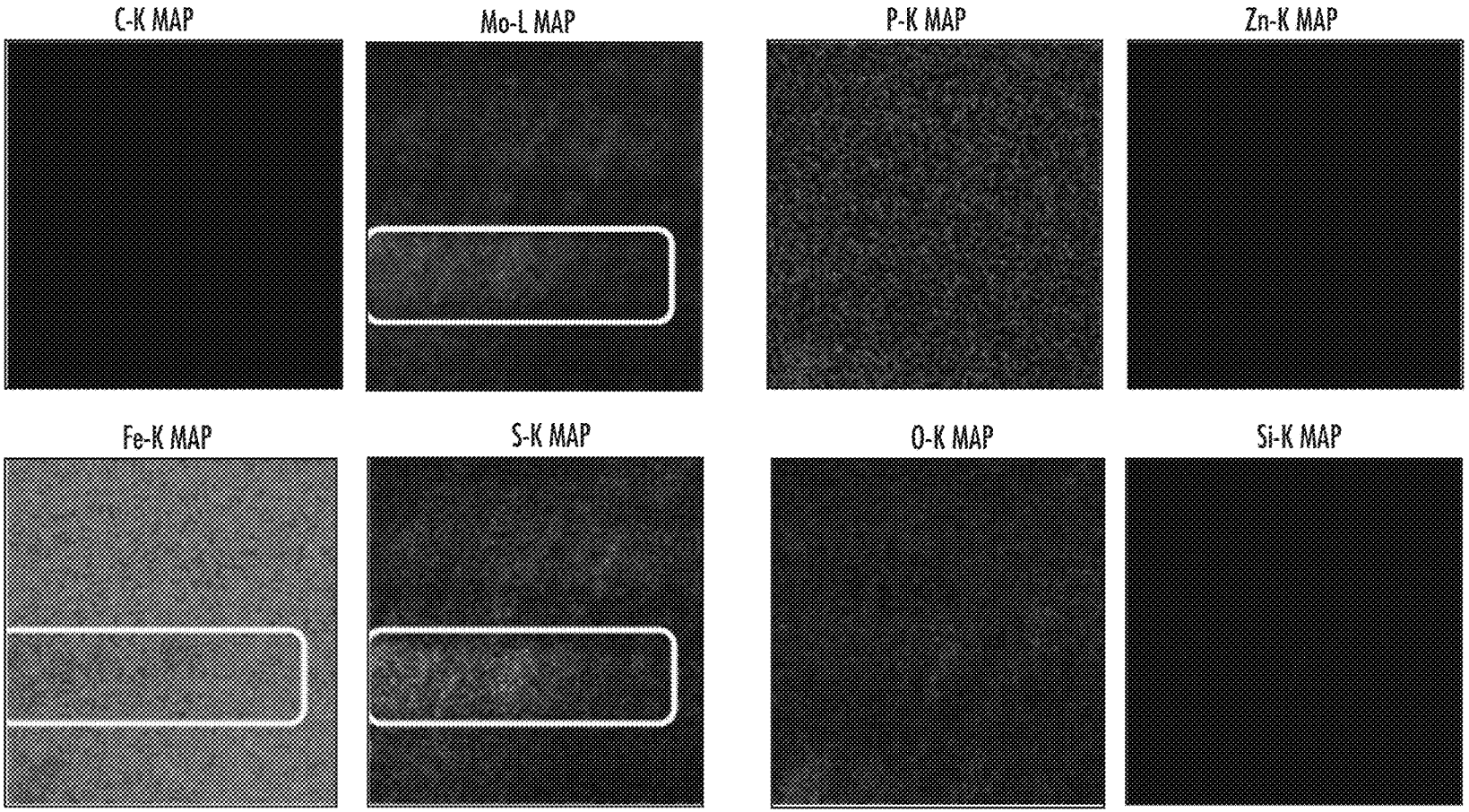
Figure 28A:
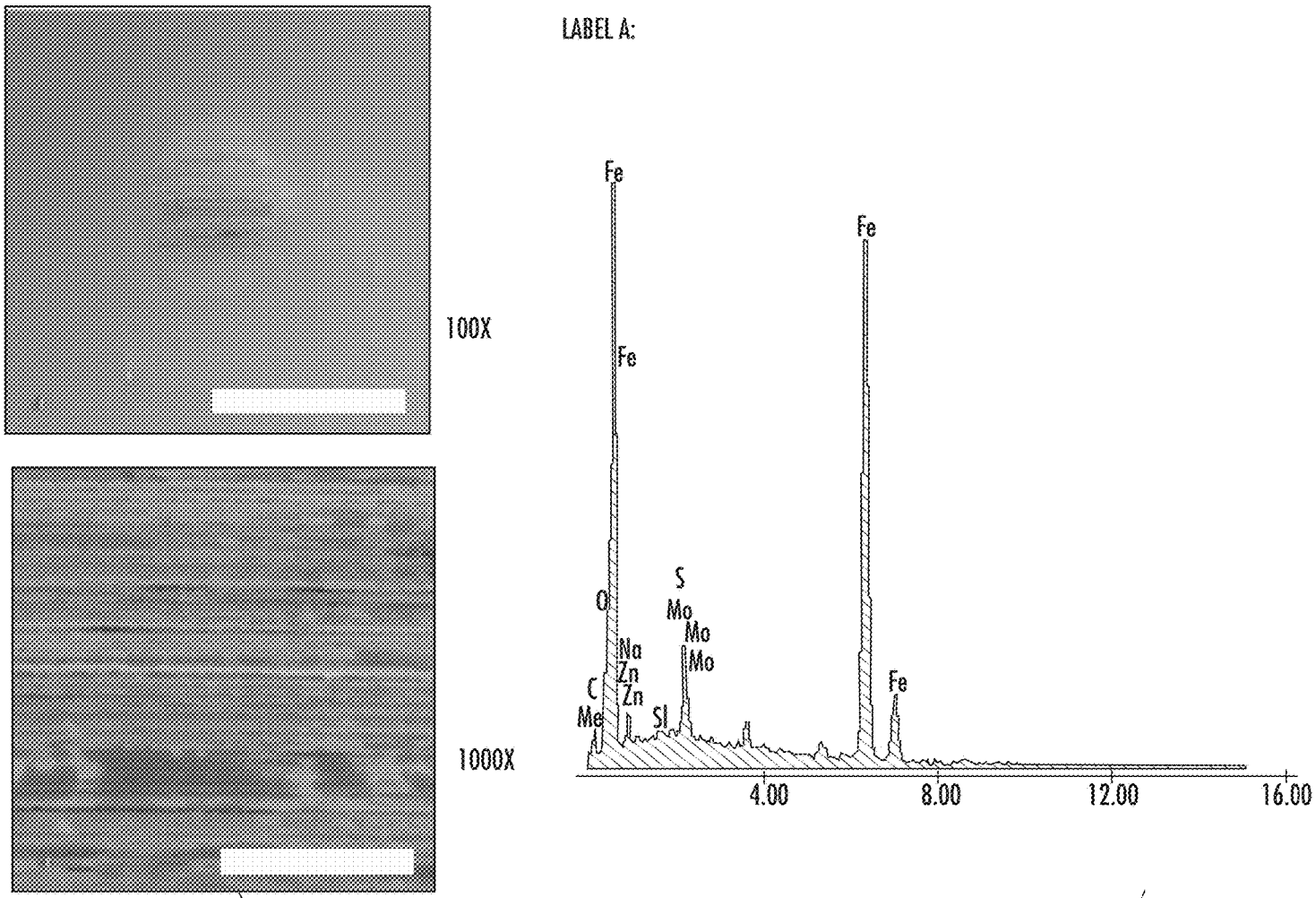
Figure 28B:
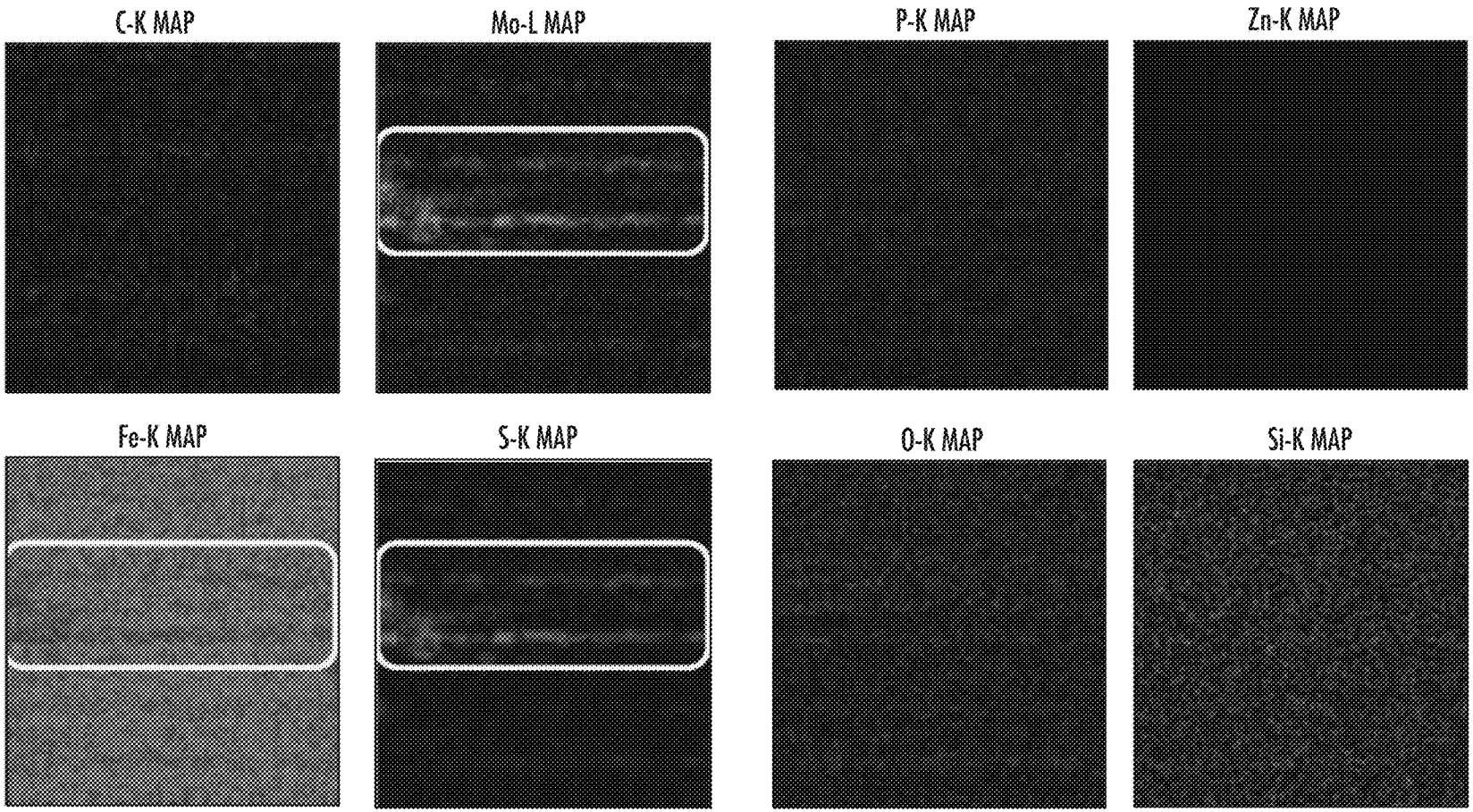
Figure 29A:
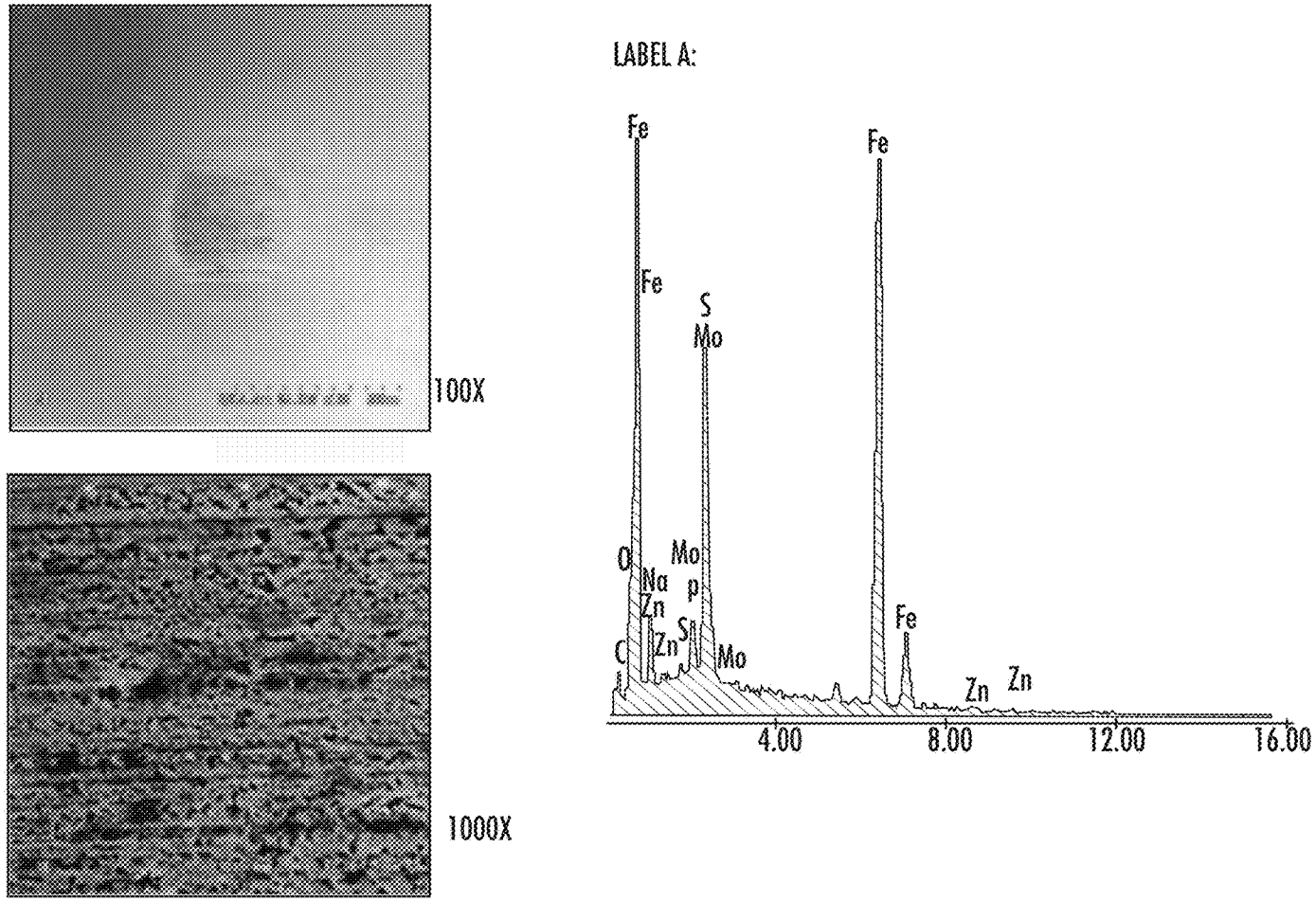
Figure 29B:
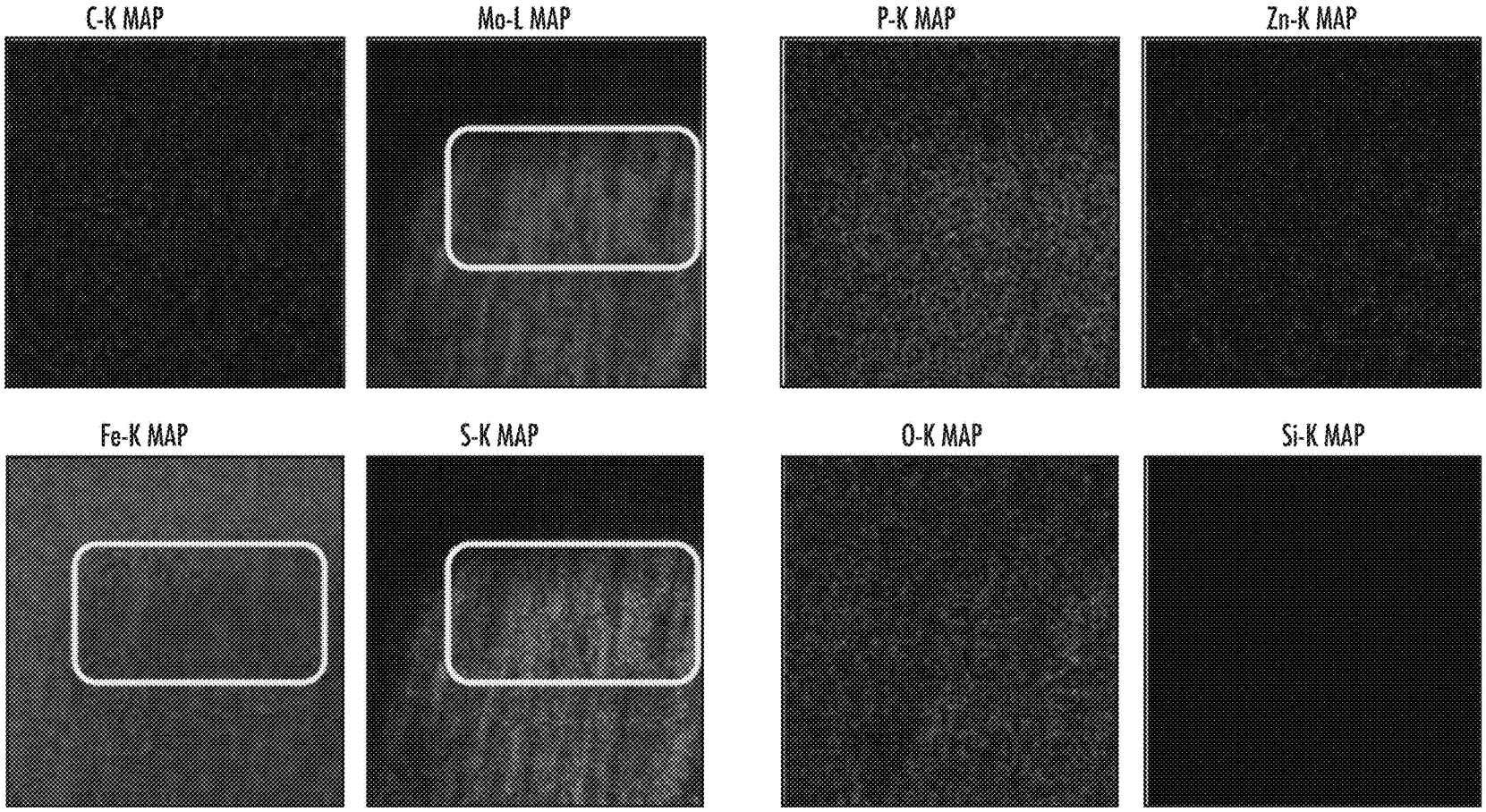
Figure 30A:
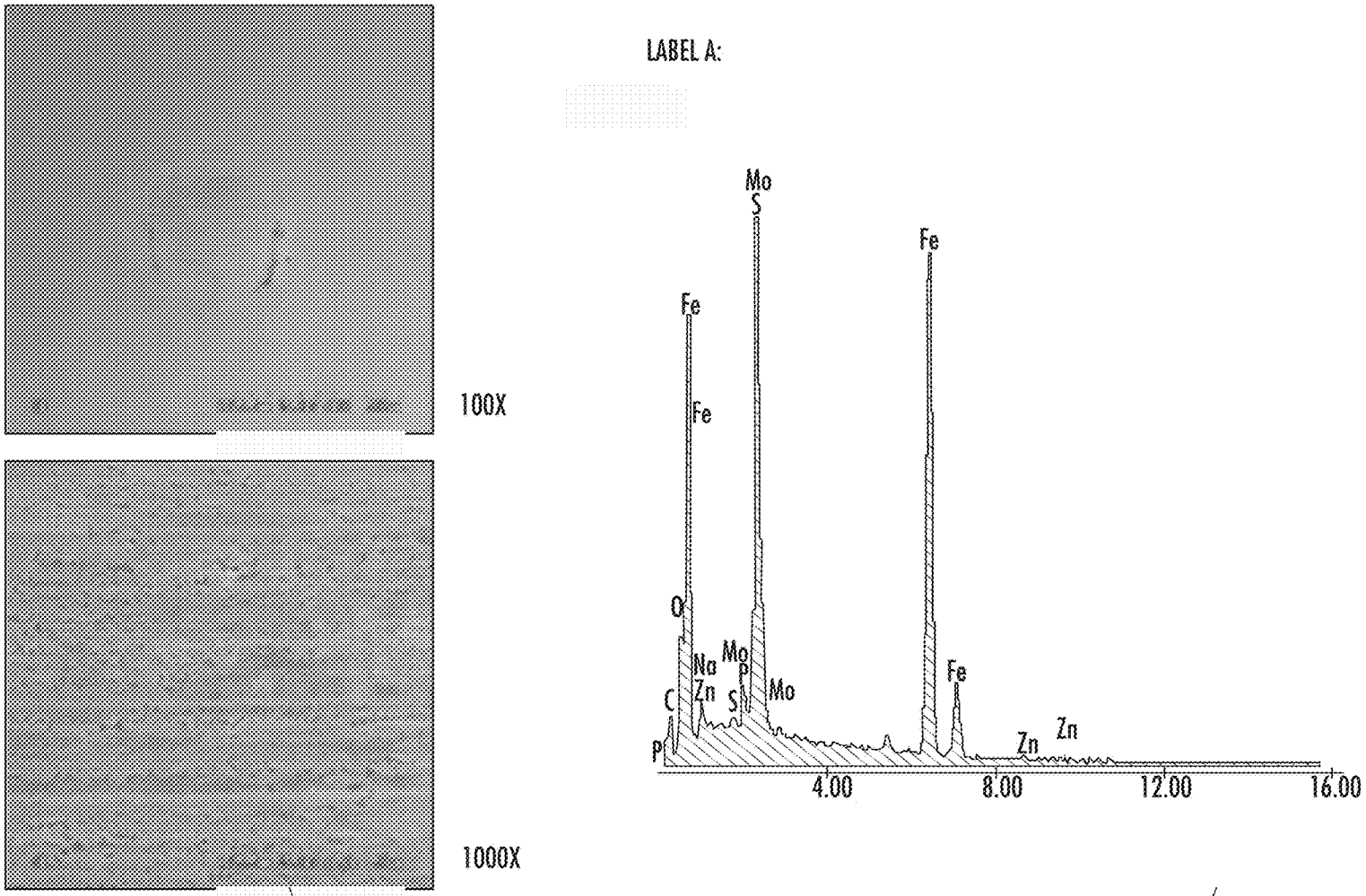
Figure 30B:
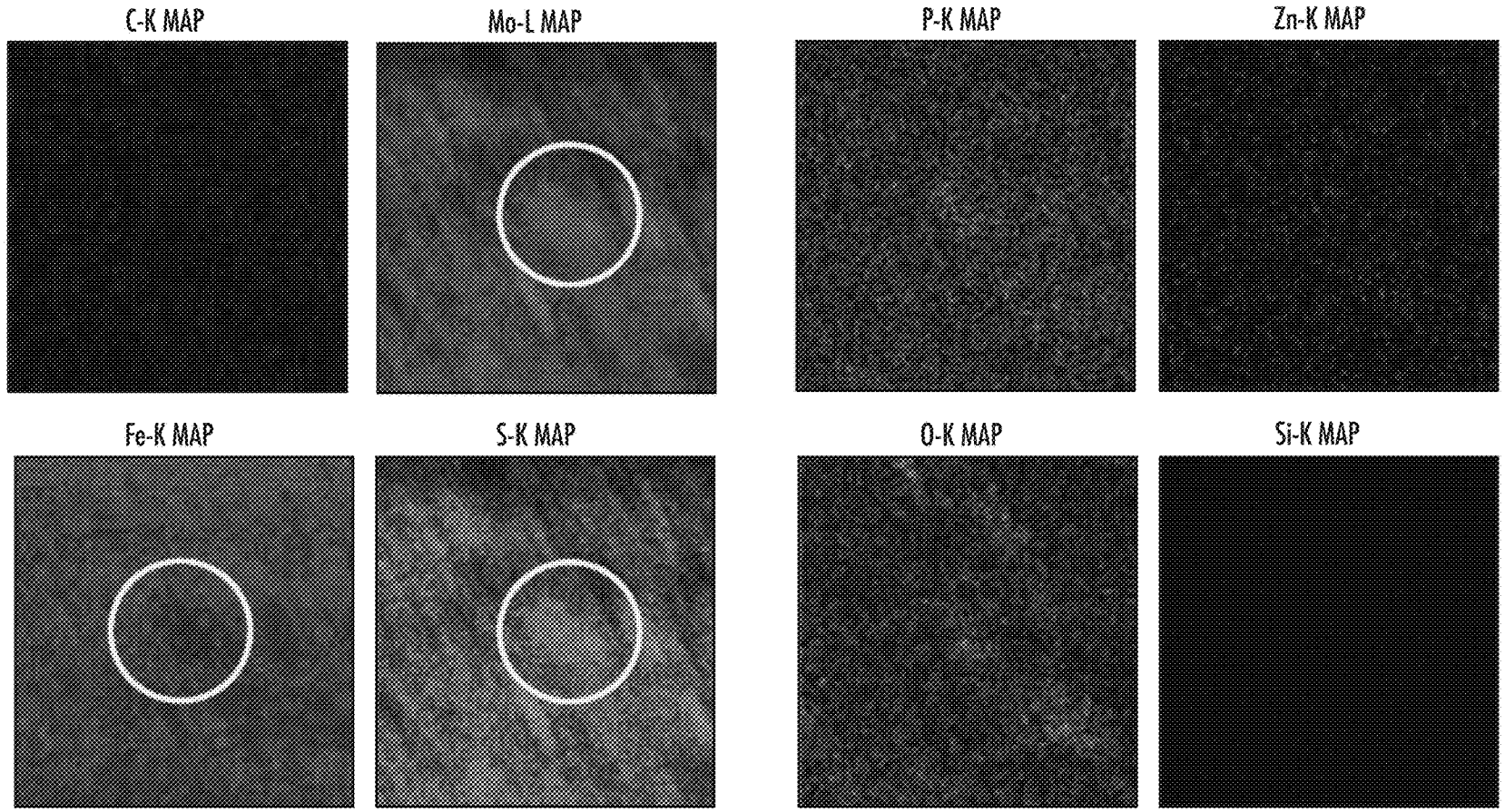

SEM images were obtained under standard SEM conditions. The wear mechanism in play on the surface as well as the tribofilm was evaluated. Specific areas on the surface which were of interest were imaged at a higher magnification to evaluate the wear mechanism. The energy dispersive spectroscopy (EDS) microanalyzer unit (EDAX Genesis) attached to the SEM was used to study the elemental composition of the wear surface. LC15 and LC19-21. FIG. 27A shows the EDS map for LC15; FIG. 27B shows elemental maps for LC15. FIG. 28A shows the EDS map for LC19; FIG. 28B shows elemental maps for LC19. FIG. 29A shows the EDS map for LC20; FIG. 29B shows elemental maps for LC20. FIG. 30A shows the EDS map for LC21; FIG. 30B shows elemental maps for LC21.

Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention.

What is claimed is:

1. A lubricant composition comprising:

a grease; and milled metal sulfide particles dispersed in the grease, wherein the milled metal sulfide particles have rounded or dulled or softened edges and an average particle size of 5 to 20 μm;

wherein the milled metal sulfide particles are formed from $WS_2$ or $MoS_2$; and wherein the milled metal sulfide particles are present in the lubricant composition in an amount of 1 to 5 weight percent, based on the total weight of the lubricant composition.

2. The lubricant composition of claim 1, wherein the grease is a lithium grease.

3. The lubricant composition of claim 1, wherein the milled metal sulfide particles are formed from $WS_2$.

4. The lubricant composition of claim 1, wherein the milled metal sulfide particles are formed from $MoS_2$.

5. The lubricant composition of claim 1, wherein the milled metal sulfide particles form a percolation network within the grease.

6. The lubricant composition of claim 1, wherein the milled metal sulfide particles have rounded edges.

7. The lubricant composition of claim 1, wherein the milled metal sulfide particles have reduced surface energy or reduced asperities compared to non-milled metal sulfide particles.

8. The lubricant composition of claim 1, wherein the lubricant composition provides a reduced average wear scar diameter on lubricated metals compared to a lubricant composition comprising non-milled metal sulfide particles.

9. The lubricant composition of claim 1, wherein the lubricant composition provides a reduced average coefficient of friction on lubricated metals compared to a lubricant composition comprising non-milled metal sulfide particles.

10. The lubricant composition of claim 1 further comprising a dispersant.

11. The lubricant composition of claim 10, wherein the dispersant comprises one or more of a non-ionic surfactant, an anionic surfactant, and a zwitterionic surfactant.

12. The lubricant composition of claim 10, wherein the dispersant comprises sorbitan monooleate or polyisobutylene succinic acid.

13. The lubricant composition of claim 1, wherein the milled metal sulfide particles are surface-functionalized with a polythiol.

14. The lubricant composition of claim 13, wherein the polythiol is present in the lubricant composition in an amount of 1 to 5 weight percent, based on the total weight of the lubricant composition.

15. The lubricant composition of claim 1, wherein:

the grease is a lithium grease; and the milled metal sulfide particles are surface-functionalized with a polythiol.

16. A lubricant composition consisting essentially of milled metal sulfide particles having rounded edges, the milled metal sulfide particles having an average particle size of 5 to 20 μm.

17. A method of making a lubricant composition, comprising:

providing metal sulfide particles having an average particle size of 5 to 20 μm; subsequently milling the metal sulfide particles to round the edges of the metal sulfide particles; and subsequently, after milling, dispersing the milled metal sulfide particles in a grease, wherein the milled metal sulfide particles are formed from $WS_2$ or $MoS_2$; and wherein the milled metal sulfide particles are present in the lubricant composition in an amount of 1 to 5 weight percent, based on the total weight of the lubricant composition.

18. The lubricant composition of claim 8, wherein the average wear scar diameter on lubricated metals of the lubricant composition is reduced by 5-30% compared to a lubricant composition comprising non-milled metal sulfide particles.

19. The lubricant composition of claim 9, wherein the average coefficient of friction on lubricated metals of the lubricant composition is reduced by 5-35% compared to a lubricant composition comprising non-milled metal sulfide particles.

* * * * *